US012624557B2

(12) United States Patent
Iqbal et al.

(10) Patent No.: US 12,624,557 B2
(45) Date of Patent: May 12, 2026

(54) SUBFLOOR SYSTEM AND METHODS OF CONSTRUCTION THEREOF

(71) Applicant: Laccoo Outdoors, LLC, Secaucus, NJ (US)

(72) Inventors: Hamza Iqbal, Ottawa (CA); Charbel Daoud, Arnprior (CA)

(73) Assignee: Laccoo Outdoors, LLC, Secaucus, NJ (US)

( * ) Notice: Subject to any disclaimer, the term of this patent is extended or adjusted under 35 U.S.C. 154(b) by 0 days.

(21) Appl. No.: 19/175,587

(22) Filed: Apr. 10, 2025

(65) Prior Publication Data

US 2025/0333968 A1 Oct. 30, 2025

Related U.S. Application Data

(63) Continuation of application No. 19/041,572, filed on Jan. 30, 2025, now abandoned.

(60) Provisional application No. 63/638,152, filed on Apr. 24, 2024.

(51) Int. Cl.
*E04F 15/18* (2006.01)
*E04F 15/024* (2006.01)
*E04F 15/04* (2006.01)

(52) U.S. Cl.
CPC ..... *E04F 15/185* (2013.01); *E04F 15/02458* (2013.01); *E04F 15/04* (2013.01)

(58) Field of Classification Search
CPC ..... E04F 15/02458; E04F 15/02452; E04F 15/02183; E04F 2015/02116; E04B 5/12
See application file for complete search history.

(56) References Cited

U.S. PATENT DOCUMENTS 3,310,922 A 3/1967 Hoffmann, Jr.
5,469,678 A * 11/1995 Zamerovsky ..... E04C 3/42 403/231
5,511,351 A * 4/1996 Moore ..... E04B 1/003 52/302.1

(Continued)

FOREIGN PATENT DOCUMENTS

CH 718836 A2 1/2023
EP 0178275 A2 4/1986

(Continued)

*Primary Examiner* — Christine T Cajilig
(74) *Attorney, Agent, or Firm* — Jason T. Daniel, Esq.; Daniel Law Offices, P.A.

(57) ABSTRACT

The invention describes a subfloor or a split subfloor system for use in the construction of a portable deck. The proposed subfloor system can be installed without any special skill set or tools. The subfloor comprises of several footings that are arranged on the ground, at least two pre-notched beams that are placed on the footings, at least two pre-notched joists that rest perpendicularly on the pre-notched beams, at least two frame units that rest perpendicularly on the pre-notched beams in a direction parallel to the pre-notched joists, and at least one rim joist secured to each end of the pre-notched joists and the frame units. These components of the subfloor system could also be split in two or more pieces for a split subfloor system that makes transportation easier. A kit comprising the components of the subfloor system and a method of construction is also provided.

28 Claims, 55 Drawing Sheets

(56) References Cited

U.S. PATENT DOCUMENTS

| | | | | | |
|---|---|---|---|---|---|
| 6,141,927 | A * | 11/2000 | Usui | E01C 9/08 | 52/263 |
| 10,526,796 | B1 * | 1/2020 | Way | B63B 35/34 | |
| 2002/0005022 | A1 * | 1/2002 | Matthews | E04B 5/10 | 52/696 |
| 2006/0048465 | A1 * | 3/2006 | Tremblay | E04F 15/02 | 52/177 |
| 2025/0223791 | A1 * | 7/2025 | Monteer | E04B 1/388 | |

FOREIGN PATENT DOCUMENTS

| | | | | |
|---|---|---|---|---|
| FR | 2987381 | A1 * | 8/2013 | E04F 15/02183 |
| FR | 3017146 | A1 | 8/2015 | |
| GB | 2126265 | A * | 3/1984 | E04F 15/22 |
| WO | WO-2004104320 | A1 * | 12/2004 | E04B 1/003 |
| WO | 2009062275 | A2 | 5/2009 | |

* cited by examiner

600

SUBFLOOR SYSTEM AND METHODS OF CONSTRUCTION THEREOF

FIELD OF THE INVENTION

The present invention relates to a subfloor system or a split subfloor system for constructing decks, stages or raised platforms. More specifically, the invention describes a subfloor system for constructing a portable do-it-yourself (DIY) subfloor system.

BACKGROUND OF THE INVENTION

Traditional methods of constructing decks often involve hiring professional contractors, which can be time-consuming and costly for homeowners. The process typically entails requesting quotes, negotiating terms, and scheduling construction, resulting in significant lead times and expenses. Moreover, these methods often require specialized skills and experience, limiting accessibility to individuals with professional training or hiring capabilities which results in premium labour cost.

Homeowners seeking to build decks themselves face various challenges, including the need for extensive tools, materials, and technical knowledge. The absence of standardized, user-friendly solutions further complicates the DIY deck construction process, discouraging many from pursuing such projects independently. Other issue is longevity, which depends on the construction technique and material used for constructing the deck. A DIYer is not a professional deck builder and may not have access to all the necessary tools which may result in a substandard outcome. Often, a weak subfloor design leads to serious problems such as sagging, collapsing or other structural issues. If not waterproofed appropriately, there could be significant damage to the deck due to water accumulation.

Additionally, the seasonality of deck construction contributes to increased costs, as companies must cover overhead expenses within a limited operational window. Homeowners may find themselves paying premium prices due to high demand and the need to offset these costs.

Building a deck traditionally takes several hours to days depending on the size of the deck being built. A DIY deck involves comparatively a lesser time commitment, however, ignoring local building codes, or the subfloor or under structure design, or underestimating the time commitment for a robust deck are common deck-building mistakes.

Manual deck squaring requires all the components to be placed accurately. First, the beam to be placed on top of posts or directly on blocks in a level way and the next step is to lay the joists on the beams. Each step requires measuring manually in between every joist to ensure that the joists are equidistant. After spacing the joists manually, the rim joist is screwed onto all of the joists. The next step is to measure the deck diagonally from corner to corner. If the measurement is off, the whole subfloor box needs to be moved left or right and requires re-measurement. So, manual deck or subfloor squaring to ensure that the diagonal measurements on both sides are identical is a long and meticulous process and beyond the skillset of most DIY'ers.

Although, DIY decks with composite decking materials are becoming increasingly popular due to their durability and low maintenance, but they do require specific installation procedures to ensure proper installation. Sometimes, the installation instructions are not easy to follow which leads to confusion and frustration.

More commonly, after investing in a costly decking company and all the required materials, if the homeowner decides to move to a different place, they are forced to leave behind the expensive decks with the house.

Traditionally, framing and squaring a deck can take anywhere between 4-8 hours depending on size of the deck. However, this is assuming that the deck is being built by a skilled carpenter and his crew that knows his lumber dimensions, angles, and can foresee framing techniques to ensure a squared deck. This not only involves levelling the beams and the joists but also using accurate dimensions to perfectly square deck. For a DIY'er, it can take anywhere between 12-16 hours to perfectly square and frame a deck, which is just to build the subfloor of a deck.

For a standard 10 feet×10 feet deck, it can take anywhere between two to three days to build a complete deck depending on the skills of the carpenter and size of the deck. If a person has no background (DIY'er) who attempts to do everything from scratch, it can take up to four to six days to build a deck with decent quality. Moreover, the DIY'er must have all the necessary tools.

SUMMARY OF THE INVENTION

Figure 1A:
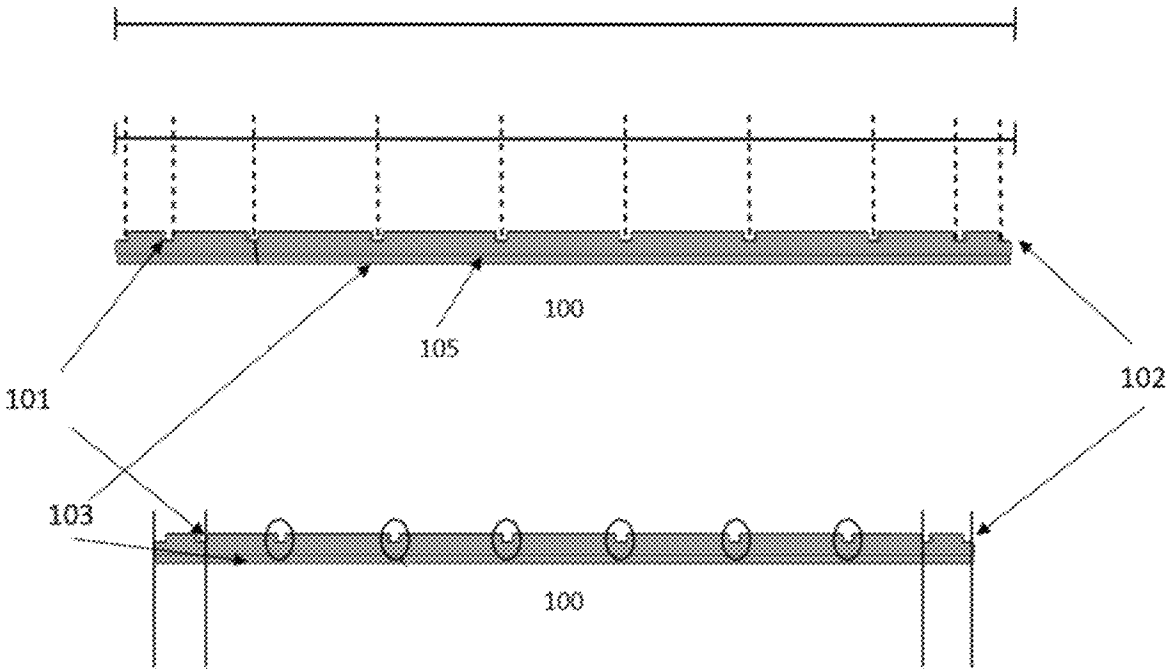
FIG. 1A shows a diagrammatic representation of an exemplary pre-notched beam design.

The invention describes a unique subfloor system. The proposed system may be used as a base for constructing a deck, platform or a stage. In an exemplary embodiment, the subfloor system may comprise a plurality of footings. The footings are placed on the ground and may be arranged in a square, rectangular, pentagonal or hexagonal form. The subfloor system may additionally comprise at least two pre-notched beams. The pre-notched beams rest on the plurality of footings. Furthermore, the subfloor system may comprise at least two pre-notched joists. The pre-notched joists rest on the pre-notched beams, generally in a perpendicular direction. Furthermore, the subfloor system may additionally comprise at least two frame units that rest perpendicularly on the pre-notched beams in a direction parallel to the pre-notched joists. The subfloor system may additionally comprise at least one rim joist. The rim joists secure each end of the pre-notched joists and the frame units. Each end of the pre-notched joists and frame units is connected to a rim joist. Each component of the subfloor system may be further secured by fastening means which may include deck coated screws, galvanized nails or various brackets known in the art.

The invention also describes an alternative split subfloor system with similar components as the original subfloor system. However, the split system comprises of components that are split in two or more halves/pieces. This form of a split subfloor system may have additional components such as filler blocks, connector blocks, deck dividers, box pieces, and joist extension/connector pieces.

The invention also proposes a portable deck, a portable stage or a portable raised platform. The portable deck, raised platform, or stage comprises the unique subfloor system with footings, pre-notched beams, pre-notched joists, frame units, rim joists, brackets and other affixing means. Additionally, the portable deck floor, platform or stage comprises one or more deck boards. The deck boards are affixed to the subfloor system by any fastening means. Alternatively, the portable deck, portable stage or a portable raised platform may be provided with the split subfloor components such as footings, split pre-notched beams, split pre-notched joists, split frame units, split rim joists, filler blocks, connector blocks, joist extension pieces, box pieces, divider pieces, brackets and other affixing means.

The invention also proposes a kit comprising the various components of the unique subfloor system or the split subfloor system. A method of constructing or building the subfloor system is also taught.

DETAILED DESCRIPTION

The following description is of preferred embodiments by way of example only and without limitation to the combination of features necessary for carrying the invention into effect.

All terms are intended to be understood as they would be understood by a person skilled in the art. Unless defined otherwise, all technical and scientific terms used herein have the same meaning as commonly understood by one of ordinary skill in the art to which the disclosure pertains. The section headings used herein are for organizational purposes only and are not to be construed as limiting the subject matter described.

Although various features of the present disclosure can be described in the context of a single embodiment, the features can also be provided separately or in any suitable combination. Conversely, although the present disclosure can be described herein in the context of separate embodiments for clarity, the present disclosure can also be implemented in a single embodiment.

The following definitions supplement those in the art and are directed to the current application. Accordingly, the terminology used herein is for the purpose of describing particular embodiments only and is not intended to be limiting.

In this application, the use of the singular includes the plural unless specifically stated otherwise. It must be noted that, as used in the specification, the singular forms "a," "an" and "the" include plural referents unless the context clearly dictates otherwise.

In this application, the use of "or" means "and/or" unless stated otherwise. The terms "and/or" and "any combination thereof and their grammatical equivalents as used herein, can be used interchangeably. These terms can convey that any and all combinations are specifically contemplated. The term "or" can be used conjunctively or disjunctively, unless the context specifically refers to a disjunctive use.

Furthermore, use of the term "including" as well as other forms, such as "include", "includes," and "included," is not limiting.

Reference in the specification to "some embodiments," "an embodiment," "one embodiment" "alternate embodiment", or "other embodiments" means that a particular feature, structure, or characteristic described in connection with the embodiments is included in at least some embodiments, but not necessarily all embodiments, of the present disclosures.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. It is contemplated that any embodiment discussed in this specification can be implemented with respect to any method or composition of the present disclosure, and vice versa. Furthermore, compositions of the present disclosure can be used to achieve methods of the present disclosure.

The term "about" in relation to a reference numerical value and its grammatical equivalents as used herein can include the numerical value itself and a range of values plus or minus 10% from that numerical value. The term "about" or "approximately" means within an acceptable error range for the particular value as determined by one of ordinary skill in the art, which will depend in part on how the value is measured or determined, i.e., the limitations of the measurement system. For example, "about" can mean within 1 or more than 1 standard deviation, per the practice in the art. Alternatively, "about" can mean a range of up to 20%, up to 10%, up to 5%, or up to 1% of a given value. In another example, the amount "about 10" includes 10 and any amounts from 9 to 11.

EMBODIMENTS

In an embodiment of the invention, a subfloor system is provided. The proposed system is a unique, quick-to install, do-it-yourself, subfloor system which may be used as a base for constructing a deck, platform or a stage. In an exemplary embodiment, the subfloor system may comprise a plurality of footings. The footings are placed on the ground and may be arranged in a square, rectangular, pentagonal or hexagonal form. The subfloor system may additionally comprise at least two pre-notched beams. The pre-notched beams rest on the plurality of footings. The pre-notched beams generally rest on two or more footings. Furthermore, the subfloor system may comprise at least two pre-notched joists. The pre-notched joists rest on the pre-notched beams, generally in a perpendicular direction. Furthermore, the subfloor system may additionally comprise at least two frame units that rest perpendicularly on the pre-notched beams in a direction parallel to the pre-notched joists. The frame units are placed at each end of the joist arrangement. Once the beams are placed parallelly on the footings, i.e. at least one beam on a pair of footings, the pre-notched joists and the frame units are placed/aligned on the beams perpendicularly. The pre-notched joists are in the center and there's at least one frame unit placed parallel to the joists at each end. Both the joists and the frame units are secured to the pre-notched beams by fastening means. The subfloor system may additionally comprise at least one rim joist. The rim joists secure each end of the pre-notched joists and the frame units. Each end of the pre-notched joists and frame units is plugged by or attached to a rim joist. This helps in stabilizing the subfloor structure and also in keeping the joists and frame units in place. Each component of the subfloor system may be further secured by fastening means which may include deck coated screws, galvanized nails or various brackets known in the art.

The plurality of footings may be placed randomly or as noted above in a specific format. However, there's no precise measurements needed as the pre-notched components fit perfectly to create a sub-floor in no time, without any specialized tools or knowledge. Any DIY'er could build the deck as there's no measurement or subfloor squaring needed as the components square by itself.

In an exemplary embodiment, the subfloor system may include at least two, three, four, five, six, seven, eight, nine or ten footings depending on the size of the deck being built. The plurality of footings may be concrete footings, buried post footings, screw/helical piles, deck blocks, precast cement footings, precast concrete deck footings or a combination of the above. The goal is to use a footing design/type that aligns with the needs of the deck system. Generally, a footing provides a solid foundation for constructing the subfloor system, and therefore, choosing an appropriate footing type is extremely important.

In another embodiment of the invention, each footing in the plurality of footings has either a groove or a bracket to receive the pre-notched beams. If the pre-notched beams have a flat underside, they are placed on the flat surface of either a flat footing or a deck post that has receiving brackets to fasten pre-notched beams of the subfloor system. Once the beam sits on the deck post/footing, it is affixed to the receiving bracket by any known fastening means. If the pre-notched beams have an underside extension i.e. a piece of lumber affixed on the underside of the beams, they are generally placed on a footing or post with grooves. The underside extension is custom designed to fit perfectly in the grooves of a standard footing e.g. concrete blocks. Accordingly, the pre-notched beams rest in the groove or the brackets of the plurality of footings.

Each pre-notched beam has a plurality of beam notches to receive the pre-notched joists. The beam notches are cut-outs on the surface of the beams which are custom designed to receive the pre-notched joists. Generally, the beam notches are all on one side or one surface of the beam i.e. the side that does not sit in the grooves or the flat surface of the deck post/footing. So, the notches or cut-outs are on the opposite surface of the underside extension or the flat surface of the beam that sits on the footing. The beam notches are designed to pair with or fit snugly with the corresponding surface notches on the pre-notched joists or the frame units. Accordingly, one the beams are placed on the footings, the pre-notched joists and frame units with surface notches are placed on the beams perpendicularly by aligning the surface notches with the beam notches. Generally, one pre-notched joist or one frame unit sits on at least a pair of beams. So, the joist/frame unit has at least two or more notches depending on the number of beams it's sitting on. For each beam (and a beam notch), there's a corresponding surface notch on the joist/frame unit. Once the beams and joists/frame units are placed on each other, the deck sub-floor is automatically squared, without any measurements or detailed calculations. The beam notches may be equipped with a pair of brackets that sit outside the notch to receive the joists and to further secure the joists to the beams. Generally, the number of beam notches is equal to the combined number of pre-notched joists and the number of frame units. So, if the deck subfloor includes five joists and two frame units, each beam would have seven beam notches to receive the joists/frame units. In an embodiment of the invention, the beam notches are equidistant from each other. In other embodiment, the beam notches are placed at a relatively equal distance from each other. In other embodiment, the beam notches are randomly provided on the beam.

Generally, the number of surface notches on a pre-notched joist/frame unit is equal to the number of beams. So, if a subfloor system is designed to have three beams, there would be three surface notches on the joist/frame unit. In an embodiment, the placement of the surface notches on the joists determines the distance between each beam. Accordingly, if the surface notches are fifty inches apart, the beams would be placed approximately fifty inches apart from each other. The brackets allow the frame units and the pre-notched joists to stay in place and closely fastened to the beams.

In an embodiment of the invention, the beam has a half-notched end specifically designed to receive the frame unit. The pre-notched beam has a plurality of surface notches to receive the pre-notched joists, but instead of a surface notch at each end of the beam, a half-notched end is provided to receive the surface notches of the frame units. Accordingly, the beam is provided with at least two half-notched ends, which are cut outs at each end of the beams, owing to which the cut outs appear as a half surface notch, referred to as a half-notched end. So, the half-notched end receives the frame units. Each half-notched end may be equipped with a pair of brackets on the outside to receive the frame unit. One bracket may be placed on the surface of the beam right outside the half-notched end, and the other bracket may be placed on the underside of the half-notched end. The brackets allow the frame units to stay in place and fastened to the beams.

In an embodiment of the invention, each pre-notched joist or frame unit has at least two, three, four, five, six, seven, eight, nine or ten surface notches. In another embodiment, these surface notches are equidistant from the center of the pre-notched joist. In another embodiment, these surface notches are placed approximately equidistant from the center of the pre-notched joist. In another embodiment, these surface notches are randomly placed on the pre-notched joist/frame units. Each surface notch sits perpendicularly on the beam notch of each pre-notched beam.

In another embodiment of the invention, each pre-notched joist may have at least two identical half-notches at each end. These half notches mat be equal in dimensions or may have custom measurements. The half-notches form a rim-support piece, a small piece protruding at each end of the pre-notched joist. The rim support piece receives and fits snugly with a rim joist.

In another embodiment, each end of the pre-notched joist has an L-shaped notch instead of half-notches. The L-shaped notch is an L-shaped cutout at each end of the joist that forms a rim-support protrusion. The rim support protrusion receives and fits snugly with a rim joist. In certain embodiments, the pre-notched joist may have two identical half notches on one end and an L-shaped notch at the other end.

In certain embodiments, the edges or ends of the pre-notched joists are smooth. The smooth end of the joist receives a rim joist and is affixed to the pre-notched joist by fastening means. In certain embodiments, the ends of the pre-notched joists are smooth and are equipped with a male bracket. The male bracket is affixed at each end of the pre-notched joist. A corresponding female bracket is attached on the rim joist which allows the rim joist to fit snugly with the pre-notched joist. The pre-notched joist may have more than one male bracket, and an equal number of female brackets can be provided on the rim joist.

In certain embodiments, the pre-notched joists are designed to receive dowel pins. Each end of the pre-notched joist is custom designed to have one or more dowel pin receiving cavities. Each dowel pin receiving cavities receive a dowel pin that's provided on the rim joist. Accordingly, the pre-notched joists and the rim joists can be secured together by means of dowel pin alignment.

In another embodiment, the pre-notched joist may have a central notch or a cut-out in the centre of the joist. Each pre-notched joist may have one or more central notches. These central notches may be exactly at the centre of the joist or anywhere along the surface of the joist. The central notches are on the opposite side of the surface notches. So, the central notch is on one surface/side of the joist and the surface notches are on the opposite side of the joist. Each central notch is designed to receive a deck blocking piece. The deck blocking piece blocks the pre-notched joists from moving thus proving a more stable subfloor-system.

In another embodiment of the invention, the subfloor system additionally comprises at least two frame units. Each frame unit is made from at least two pre-notched joists and a central connecting piece. Any variant of the pre-notched joist can be affixed together to create a frame unit. In some instanced, the frame units comprise two identical pre-notched joists i.e. the same variant affixed together to create the frame unit. For instance, the frame unit may comprise two pre-notched joists of the same type or two different pre-notched joists. The frame unit additionally comprises a central connecting piece. The central connecting piece is placed in between the two joists, and the three pieces are affixed together by affixing means. Accordingly, each frame unit comprises at least two pre-notched joists and a central connecting piece. Accordingly, each frame unit may comprise at least four identical half-notches, at least two L-shaped notches, at least two rim support pieces, at least two rim support protrusions, or at least two central notches, depending on the pre-notched joists used. As noted above, each frame unit is placed at the end/edge of the pre-notched beams.

The identical half-notches (or the rim-support piece), or the L-shaped notch (or the rim-support protrusion), the male brackets, or the dowel pin receiving cavities on the pre-notched joists or the frame unit receive the rim joist. Each rim joist is placed or is affixed perpendicular to the pre-notched joist/frame unit by means of two identical half-notches, the L-shaped notch, the male bracket or the dowel pin receiving cavities. More specifically, each rim joist has a plurality of cavities along its surface that receive the rim support piece or the rim support protrusion of the pre-notched joist/the frame unit. The cavities are placed equidistant from each other, or randomly along the surface of the rim joist. Each cavity is custom designed to fit snugly with the rim support pieces/protrusions. The cavities and rim support pieces/protrusions plug well into each other.

In another embodiment, the rim joist may have one or more U-shaped notches at each end of the rim joist. The U-shaped notch is a custom-designed cut out on each end that receives the rim support piece or rim support protrusion of the frame unit. In an embodiment, the number of U-shaped notches is equal to the number of rim-support protrusions/pieces of the frame units. The rim support piece/protrusion of the frame unit sits perfectly in the U-shaped notch of the rim joist.

In another embodiment, the rim joist is provided with a female bracket that aligns with the male brackets provided on the pre-notched joists. Alternatively, in another embodiment, the rim joist may be provided with one or more dowel pins that fit in the dowel pin receiving cavities on the pre-notched joists.

In any of the above embodiments, each of the components of the subfloor system may be divided in two or more pieces.

Each of the pre-notched beam, pre-notched joist, pre-notched frame unit, rim joist, and other components of the subfloor system may be divided in two or more pieces. For instance, each of the components may be divided in two equal halves. In another embodiment, the components may be divided in three, four, or five pieces which are in equal or unequal proportions. The pieces or halves of a given component when put together form a complete component. For instance, two or more pieces of a pre-notched beam when joined would form a complete pre-notched beam. Similarly, two or more pieces of a pre-notched joist when joined would form a complete pre-notched joist. The placement of the surface notches or other notching may vary slightly to accommodate other components of the subfloor system.

In an alternative embodiment, a split subfloor system is provided. The split subfloor system may comprise a plurality of footings, at least two split pre-notched beams that rest on the plurality of footings, at least two split pre-notched joists that rest perpendicularly on the split pre-notched beams, at least two split frame units that rest perpendicularly on the split pre-notched beams in a direction parallel to the split pre-notched joists, where the split pre-notched joists and the split frame units are secured to the split pre-notched beams by fastening means, and finally at least one split rim joist secured to each end of the split pre-notched joists and the split frame units. In some embodiments, an additional joist extension/connector piece is provided. The joist extension/connector piece is placed on each split beam in a direction perpendicular to the split beam. The joist extension piece connects the two or more split joists or split joist box units.

In another embodiment, the subfloor may additionally comprise a filler block that plugs a cavity of each footing, a connector block that sits on the filler block in a direction similar to the split beams, where the connector block connects at least two split beams, and a box piece that plugs the cavity of the split frame units.

A filler block is generally a square shaped block that is designed to plug the cavity of the footing. The filler block extends beyond the cavity and sits slightly higher than the surface of the footing. The elevated surface of the filler block allows placement of the connector block that sit on the filler blocks. A connector block connects two pieces of the split pre-notched beams. Therefore, a connector block is placed generally on the central footing where two split beam pieces connect. For instance, if the subfloor system has three rows of footings, the filler block is placed in each footing, however, the connector block is only placed on the filler blocks in the central row. The connector block is placed in the same direction as the split beams. Two pieced of a split beam are connected by means of the connector piece which strengthens the subfloor structure. The notching of the split beams accommodates is designed to accommodate the connector block. A connector block is generally rectangular.

In some embodiments, the split subfloor system additionally comprises a box piece that plugs the top cavity of split joist box. When the box piece is fitted or placed in the split joist box, the cavity of joist box is fully levelled. The box piece is generally a rectangular block that is designed to increase the robustness of the subfloor structure.

In some cases, split subfloor system has three rows of footings, and in a corresponding manner three spilt joist boxes that are all plugged with a box piece. The frame units are then placed on the split joist box and then the subfloor system is layered with deck boards. The frame units and the deck boards could also be split in two or more pieces. In some cases, a divider piece or a deck divider may be placed on the central joist box to divide the deck in two halves. A divider piece or deck divider is thinner than the deck board and is placed on the central joist in a direction parallel to the joist box.

In the above embodiment, the subfloor system comprises at least three spilt frame units, a first split frame unit on one end of the subfloor system, a second split frame unit on the other end of the subfloor system and a third frame unit at the centre of the subfloor system; at least three box pieces, a first box piece plugged in the first split frame unit, a second box piece plugged in the second split frame unit, and a third box piece plugged in the third split frame unit; and a divider piece placed on the third box piece that divides the subfloor system in two halves.

In another embodiment of the invention, a portable deck, a portable stage or a portable raised platform is provided. The portable deck, raised platform, or stage comprises the unique subfloor system with footings, pre-notched beams, pre-notched joists, frame units, rim joists, brackets and other affixing means. Additionally, the portable deck floor, platform or stage comprises one or more deck boards. The deck boards are affixed to the subfloor system by any fastening means.

In some embodiments, the portable deck floor, platform or stage, additionally comprises a deck frame affixed to the subfloor system within which the plurality of deck boards is placed. The number of deck boards, frame boards or other deck frame components depend on the sizing and dimensions of the deck. Moreover, the number and dimensions depend on the dimensions of other components of the subfloor system.

In an embodiment of the invention, the deck frame is constructed using plain deck boards. In some instances, the framing is created using special deck boards, called frame boards, or a combination of deck boards and frame boards. The framing is available may be permanently affixed to the frame units and the pre-notched joists of the subfloor system. In some instances, the framing is created by deck boards, or deck frame boards, depending on the deck, stage or platform requirements.

In some embodiments, the deck frame is constructed using at least four frame boards or deck boards. The deck boards/frame boards may be pre-cut at an angle such that the ends of the boards align to form a square deck frame. In some embodiments, the boards may be cut at an angle ranging from 30-55 degrees. In some embodiments, the deck/frame boards are wider than the frame units and the pre-notched joists of the subfloor system extend beyond the width of the subfloor system. The boards may extend a few inches or a few feet beyond the subfloor-system components to create an overhang.

In an alternative embodiment, the portable deck floor, stage or platform may comprise of split components. Instead of complete beams, joists, frame units, or rim joists, the components are split in two or more pieces. Accordingly, the portable deck floor may have two or more split pre-notched beams, two or more split joists, two or more split joist boxes/frame units, and two or more split rim joists. The deck frame boards, or deck boards may also be split in two or more pieces. Additionally, the portable floor system may additionally be provided with filler blocks, connector blocks, box pieces and deck divider pieces as described hereinbefore.

In another embodiment of the invention, a kit for constructing a subfloor system is provided. The kit may be provided with a plurality of footings, at least two pre-notched beams, a plurality of brackets, at least two pre-notched joists; and at least two rim joists. The kit may additionally comprise additional components such as brackets, any other fastening means, dowel pins, or any replacement parts as needed.

In another embodiment of the invention, a kit for constructing a split subfloor system is provided. The kit may be provided with a plurality of footings, at least two split pre-notched beams, a plurality of brackets, at least two split pre-notched joists; at least two split frame units or joist boxes, and at least two split rim joists. The kit may additionally comprise additional components such as brackets, any other fastening means, dowel pins, or any replacement parts as needed. The kit may additionally comprise filler blocks, connector blocks, box pieces and deck divider pieces as described hereinbefore.

In another embodiment, a method of constructing a subfloor system is provided. The method involves placing at least two pairs of footings on the ground to form a square. In some embodiments, more than two footings may be arranged on the ground. The number of footings depend on the size of the deck, raised platform or stage being built, and it also determines the load bearing capacity of the subfloor system. The method further involves placing one or more pre-notched beam on each pair of footing such that the pre-notched beams are parallel to each other. The method may further involve placing one or more pre-notched joists on the pre-notched beams in a direction perpendicular to the pre-notched beams. In some instances, optionally, at least one frame unit is placed perpendicularly on each end of the pre-notched beams, wherein the frame unit runs parallel to the one or more pre-notched joists. This may be followed by a step of securing the ends of the pre-notched joists and the frame units with a rim joist and affixing the pre-notched beams, the pre-notched joists, the frame units and the rim joists by affixing means. The affixing means may vary according to the type of subfloor being built and its end use. However, the affixing means may involve decking screws, galvanized nails and/or brackets.

In an alternate embodiment, a method of assembling a split subfloor system is provided. The method comprises placing at least three units of footings on the ground to form a square, wherein each unit comprises three footings, so a total of nine footings or more. In some embodiments, more than 12 footings may be arranged on the ground. The number of footings depend on the size of the deck, raised platform or stage being built, and it also determines the load bearing capacity of the subfloor system. The method further involves placing at least two split pre-notched beams on each unit of footing such that the split pre-notched beams meet or connect on the central footing. In some cases, each footing is plugged with a filler block and a connector block is placed on each footing in the centre that connects the two split pre-notched beams. The method may further involve placing at least two split pre-notched joists on the split pre-notched beams in a direction perpendicular to the pre-notched beams. In some instances, a joist extension piece may be used to connect the two split pre-notched joists. Each pre-notched joist has a full notch on one side and a half notch on the other side. Usually, the half notches of two split joists connect to form a full notch. When a joist extension piece is used, the half notches of each split joist connect with the half notch of the joist extension piece. In some instances, optionally, at least two split frame units is placed perpendicularly on each end of the pre-notched beams, wherein the split frame units/split joist box runs parallel to the one or more pre-notched joists. The split frame units are placed towards the end of the deck while the split joists are layered in between the split frame units. In some cases, three split frame units are used i.e. one on each side and last one in the centre and the split joists are layered in between the split frame units. A joist extension piece can also be used to connect two split frame units.

This may be followed by a step of securing the ends of the split pre-notched joists and the split frame units with a split rim joist that runs parallel to the split beams. Finally, the split pre-notched beams, the split pre-notched joists, the split frame units and the split rim joists are affixed by affixing means. The affixing means may vary according to the type of subfloor being built and its end use. However, the affixing means may involve decking screws, galvanized nails and/or brackets. The method may further involve placing a box piece to plug the cavity of each split frame unit. In the event, where three frame units are used, a thin divider piece may be placed on the central frame unit after it's plugged with the box piece. The thin divider piece provides a dividing line to divide the deck in two halves. The split subfloor system may then be layered with split deck boards and split frame boards.

The invention will now be described by means of the following exemplary embodiments. A person skilled in the art would understand that the embodiments and examples provided merely describe the nature of the invention and any embodiment or example not specifically recited still falls within the scope of this invention.

TECHNICAL DISCUSSION

Recognizing these limitations in the existing landscape of deck construction, there exists a demand for innovative approaches that empower homeowners to undertake DIY projects efficiently and cost-effectively. By addressing the barriers of time, cost, and expertise associated with traditional methods, novel solutions can revolutionize the industry and democratize access to deck construction for a broader audience.

In response to these challenges, the present invention teaches a subfloor system, decks built using the unique subfloor system, and methods of construction thereof. The invention streamlines installation procedures while significantly reducing costs. Through the implementation of innovative notching techniques and simplified assembly processes, homeowners can achieve professional-quality results in a fraction of the time and expense required by traditional methods. It's built such that a person with no prior experience or handyman skills can build a professional looking subfloor system which is robust. The development of such a comprehensive solution marks a significant advancement in the field of construction, promising to disrupt existing paradigms and deliver tangible benefits to homeowners seeking to enhance their outdoor living spaces affordably and conveniently.

The advantages or importance of the subfloor is provided below.

Structural Support: It provides a stable base for the deck or any raised platform, distributing weight evenly and preventing sagging or warping over time.

Moisture Protection: A subfloor creates a barrier between the decking material and the ground, reducing moisture absorption and minimizing the risk of rot, decay, and insect infestation.

Insulation: Depending on the material used for the subfloor, it can add an extra layer of insulation, helping to regulate temperatures and potentially reduce energy costs.

Smooth Surface: By installing a subfloor, one can create a smooth, level surface for the decking material, which improves the overall appearance and usability of the deck.

Noise Reduction: It can help dampen sound transmission, making your deck a quieter and more enjoyable space.

Longevity: Properly constructed subfloors can extend the lifespan of your deck by protecting it from moisture damage and structural issues.

Versatility: Subfloors allow for a variety of decking materials to be used, including wood, composite, and PVC, giving you flexibility in design and aesthetics.

The invention describes and proposes a subfloor system that involves the following components:

Footings

Footings provide a solid foundation to build a deck. It also helps in bringing the floor height to a desired level. The number of footings depend on the size of the deck being built. One can use any type of footing that are sold in the market, the most common ones being concrete footings, buried post footings, screw/helical piles, deck blocks, precast cement footings and precast concrete deck footings. For instance, one can use the standard 4"×4" concrete deck blocks/footings (500) for constructing the subfloor system.

Generally, the number of footings (500) required depends on the deck size. A few non-limiting examples are provided in the table below:

| Deck Size | No. of Footings |
|---|---|
| 10 × 10 | 4 (2 footings per beam) |
| 12 × 12 | 4 to 6 (2 or 3 footings per beam) |
| 16 × 16 | 9 (3 footings per beam) |

It's important to understand that not all deck footings would be useful in different regions and/or climates. For instance, a homeowner in Florida, USA may require a completely different footing than someone in Calgary, Canada.

The following factors may help decide the correct solution for the subfloor system.

1. Building Codes: It is extremely important to check the local laws, building codes and regulations It's quite possible that some materials may not be permitted in certain areas. If a location is prone to natural calamities like earthquakes, high winds, hurricanes or other serious weather conditions, it's likely that the building codes or municipal regulations will allow only some specific types of footings.
2. Sloping of the Property: If the deck is being built on a sloped floor, a stronger footing may be required to provide stability to the subfloor design and deck.
3. Deck Size and Shape: A larger deck will require a stronger foundation than a small one, regardless of its height.
4. Local Weather and Soil: Wet or sandy ground is less stable than dry ground. The soil that naturally exists will play a big role in the type of deck footing required.

Posts

Both footings (500) and posts form the foundation on which the deck is built. The proposed subfloor system may also be used with deck posts. Footings (500) form the concrete base on which the posts sit, and the posts provide structural support to the joists and cross beams (100). Any standard deck post can be integrated with the proposed subfloor system. Most common sizes include a 4"×4" and a 6"×6" deck post.

Beams

Traditionally, decks have been constructed without the use of structural beams. However, some building codes mandate the use of beams to provide stability and longevity to the subfloor and deck.

The invention presents a unique beam (100) design for deck construction. The beam (100) optionally features precisely milled extensions (103) on its underside to fit snugly into a corresponding deck footing (500), see FIGS. 1 and 5B. This design ensures a seamless and secure integration between the beam (100) and the deck footing (500), enabling the beam (100) to fully rest on the footing (500) without any gaps. This method is essential for the beam's (100) function in supporting and uniformly distributing the weight of the deck, thereby enhancing the deck's overall structural integrity and stability. However, if concrete footings (500), helical piles, or deck posts are employed, the beams (100) can be constructed without any underside extensions (103) [FIGS. 1C-1H]. For instance, the concrete footing (500) could be fitted with a bracket to accept the beams (100) with a notched surface (101, 102) but without any underside extensions (103). Similarly, one can use posts with the concrete blocks (500) or the other footing types if they want to raise the deck height. In such cases, the beams (100) would be provided without underside extensions (103). The post can be placed with a 4"×4" or 6"×6" bracket mounted on top that would connect the flat bottom beam (100) to the post. The beam (100) would still be equipped with surface beam notches and half-notched ends (101, 102) which allow for the joists to properly sit in place and squaring the deck. A pre-notched beam (100) without the underside extension (103) and only a single surface beam notch (101) with the half-notched ends (102) is also envisioned, see FIGS. 1F-1H.

Figure 1B:
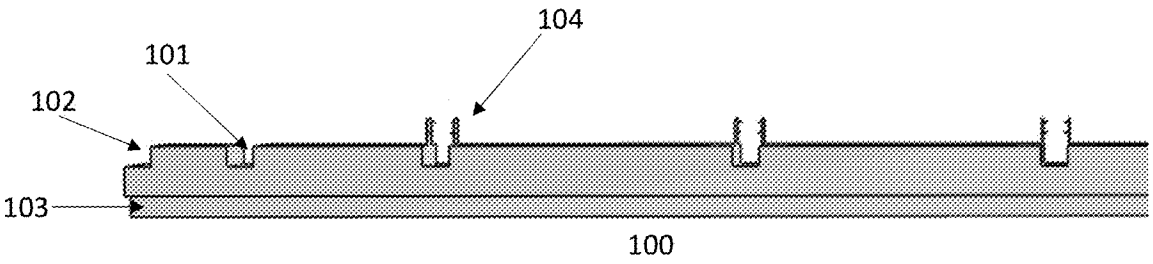
FIG. 1B shows a diagrammatic representation of the exemplary pre-notched beam and brackets.

The number of beams (100) and precise dimensions may vary depending on the size of the deck. For instance, a 10×10 deck may require 2-4 beams (100) with the length ranging from 100 inches to 150 inches. A few non-limiting examples are provided in the table below. A diagrammatic representation of an exemplary pre-notched beam (100) design is shown in FIG. 1A, 1B.

| Deck Size | No. of Beams |
|---|---|
| 10 × 10 | 2 |
| 12 × 12 | 2-3 |
| 16 × 16 | 3 |

Notching: The proposed beam (100) design simplifies alignment and assembly. Each beam (100) is equipped with precise notching arrangement that allows the beam (100) to fit snugly with the joists. The length of each beam notch (101) may vary from 3 inches to 10 inches, the depth of each notch (101) may vary from ¼ inch to 2¾ inch, and the width of each notch (101) may vary ½ inch to 5 inches. In an exemplary embodiment, the beam (100) has precisely milled notches (101) with a length of 5½ inches, depth of ¾ inches and width of 1½ inches, see FIG. 1A. The number of beam notches (101) may vary depending on the size of the deck. Optionally, the beam (100) may have half-notched ends (102) at each end for receiving the frame units (300) of the picture frame box (300). Each frame unit (300) would sit in the half-notched end (102) and a regular beam notch (101) besides it. For instance, the beam (100) may have 8-12 beam notches (101, 102) for a 10×10 deck. E.g. 10×10 deck, the subfloor system may include two beams (100), each 117 inches long, designed to support six joists and two picture frame boxes (300), resulting in ten beam notches (101, 102). A few non-limiting examples are provided in the table below. The present invention thereby simplifies deck construction by eliminating the need for manually squaring the subfloor structure.

| Deck Size | No. of Beam Notches |
|---|---|
| 10 × 10 | 10 |
| 12 × 12 | 11 |
| 16 × 16 | 14 |

Figure 1C:
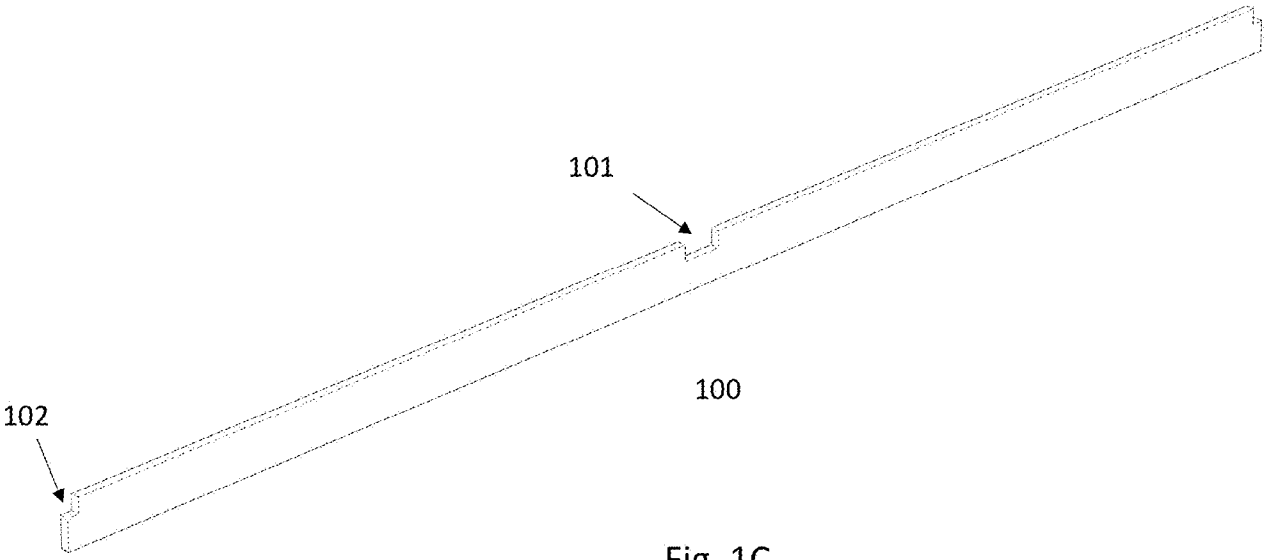
FIG. 1C shows a side-perspective view of a pre-notched beam with the half-notched ends and with one beam notch and without the underside extension.
Figure 1D:
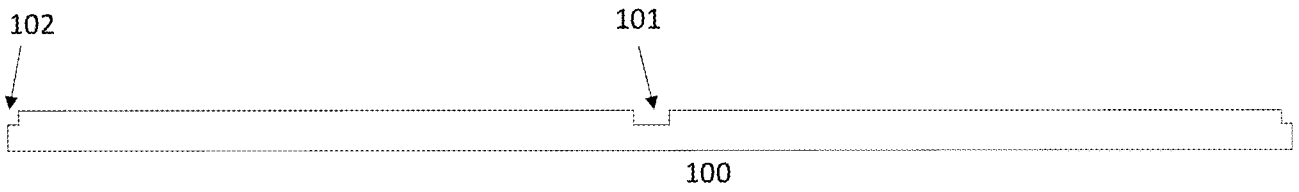
FIG. 1D shows a side view of a pre-notched beam with the half-notched ends and only one beam notch but without the underside extension.
Figure 1E:
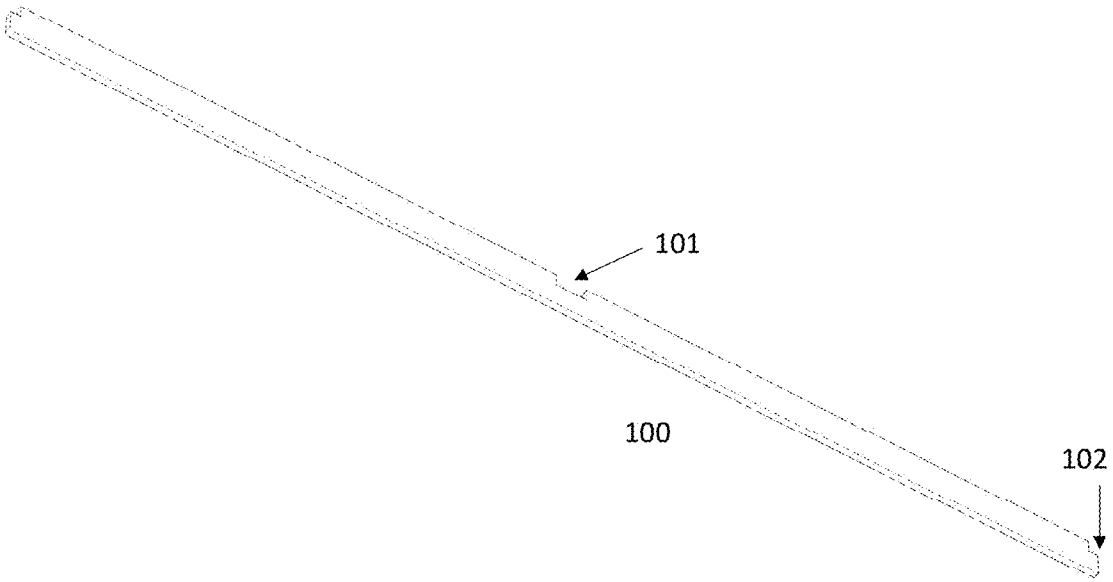
FIG. 1E shows a bottom-perspective view of a pre-notched beam with the half-notched ends and only one beam notch but without the underside extension.

A few possible variants and various views of the pre-notched beams are shown via diagrammatic representations in the following figures. A pre-notched beam (100) with beam notches (101) and half-end notches (102) but without the underside extension (103) is also envisioned. A side-perspective view of a pre-notched beam with the half-notched ends (102) and only one beam notch (101) but without the underside extension (103) is shown in FIG. 1C. A side view of a pre-notched beam with the half-notched ends (102) and only one beam notch (101) but without the underside extension (103) is shown in FIG. 1D. A bottom-perspective view of a pre-notched beam with the half-notched ends (102) and only one beam notch (101) but without the underside extension (103) is shown in FIG. 1E.

In some cases, the pre-notched beams may be divided in two or more pieces (100A). For instance, the pre-notched beam (100A) may be provided in two equal halves or three or more equal or unequal pieces. The pieces when put together would form one complete beam (100A). The split pre-notched beams (100A) may or may not be provided with an underside extension. The underside of each split beam piece may be provided with an extended notch such that the two notches when put together make a complete rectangular notch for the connector block (900A).

Figure 1F:
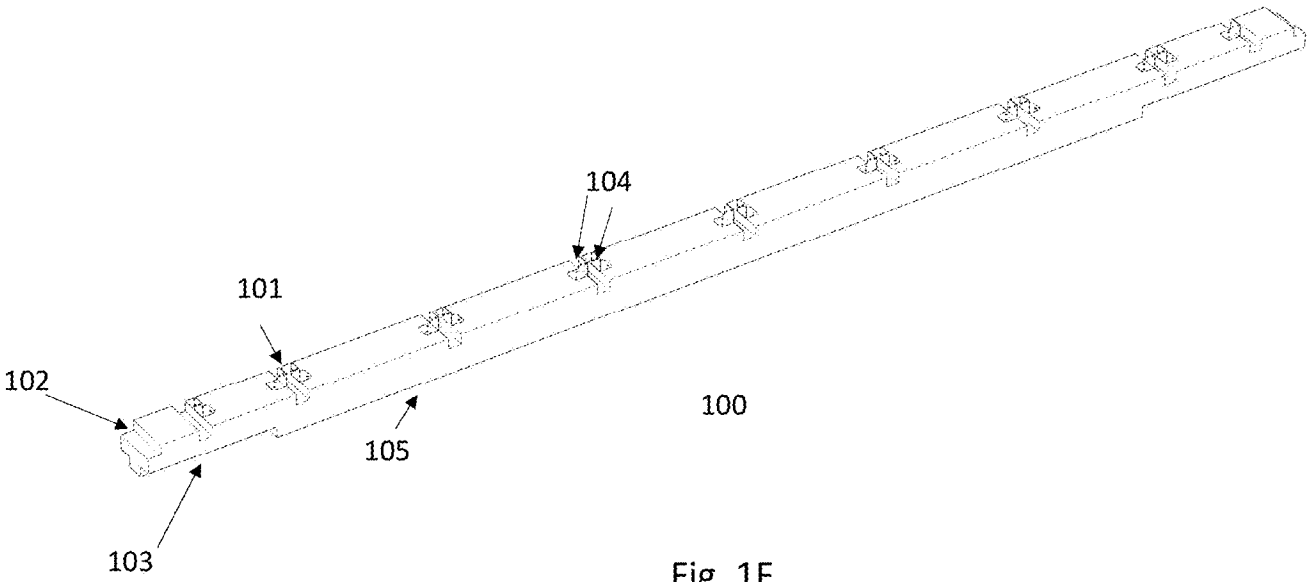
FIG. 1F shows a side perspective view of a variant of the underside extension.
Figure 1G:
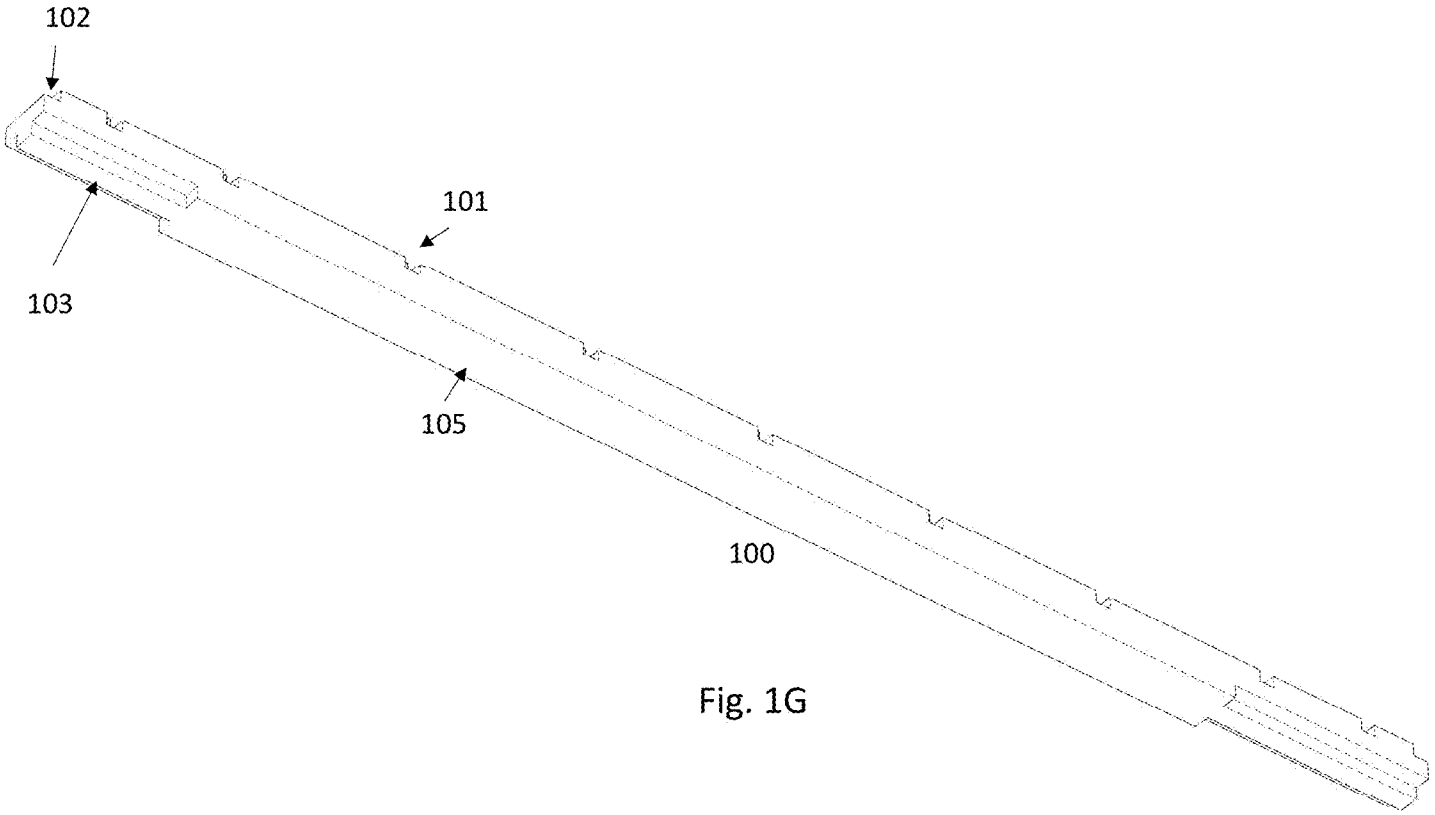
FIG. 1G shows a bottom perspective view of a variant of the underside extension.
Figure 1H:
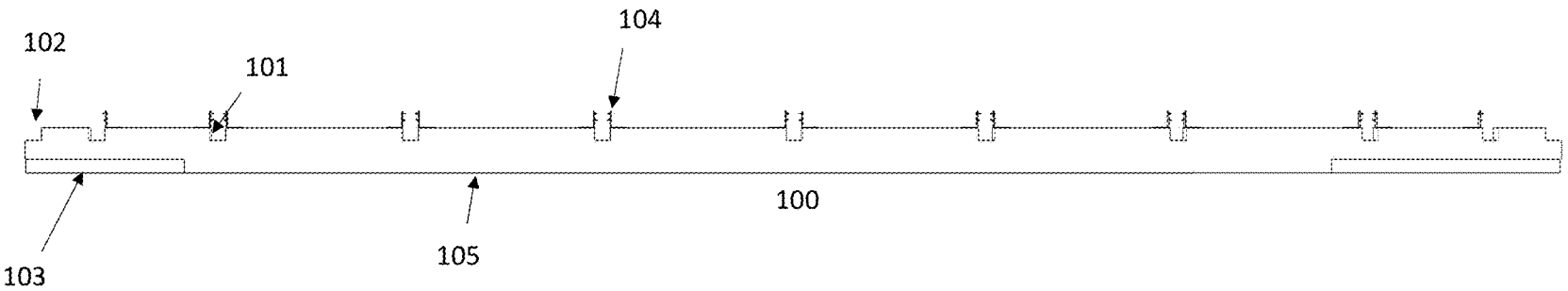
FIG. 1H shows a side view of a variant of the underside extension.

In some embodiments, the underside extension (103) may run along the whole undersurface (105) of the pre-notched beam (100), as shown in FIGS. 1A and 1B. In these cases, the undersurface (105) of the beam (100) would be cut out all throughout to provide the underside extension (103). In some embodiments, the underside extension (103) may only be as long as the size of the footing (500), as shown in FIG. 1F-1H. In such cases, the undersurface (105) of the pre-notched beam (100) would be flat and only the edges of the undersurface (105) would be cut out to provide the underside extension (103) at each edge of the beam (100). The length of the cut-outs or extensions (103) would be equal to the size of the footing. A side perspective view is shown in FIG. 1F, a bottom perspective view is shown in FIG. 1G, and a side view is shown in FIG. 1H.

This design allows the underside extension (103) to fit perfectly in the grooves of the footing (500), and also provides a blocking or locking mechanism for the footing (500), as once the underside extensions (103) sit in the footings (500), the footings won't move or slide as they would be blocked by the solid undersurface of pre-notched beam (100).

Brackets

Optionally, each beam (100) may be equipped with L-shaped brackets (104) (e.g. metal brackets) that are spaced apart to anchor joists in predetermined locations. In an exemplary embodiment, the subfloor system may use L-shaped metal brackets (104), to attach horizontal supports, called joists, to the beams (100). This arrangement ensures that each joist (200) is parallel and perpendicular to the beams (100), thereby eliminating the need for manual deck squaring.

Each bracket pair (104) is associated with a beam notch (101, 102) on the beam (100) allowing a precise and seamless fit for the joist (200). To further secure the joists, any fastener or deck screw e.g. deck coated screws could be used with each L bracket, providing a strong and lasting connection, which is essential for the deck's structural integrity. These brackets (104) are generally small and fit into special cuts in the beam (100) to hold the joists tight. The brackets (104) can be screwed on the beam (100) using any type of fastener or screw e.g. deck coated screws. A diagrammatic representation of the brackets (104) can be seen in FIG. 1B.

The number of bracket pairs (104) will depend on the number of beam notches (101, 102). Generally, the bracket pairs (104) are spaced apart equally from each other. For example, in a 10×10 deck, spacing between each bracket pair (104) could be between 10 inches-20 inches from the center of one pair to the other. In an exemplary embodiment, the spacing could be 14⅞ inches. The space between each pair depends on the thickness of the joists. For instance, the spacing between each pair would be 1½ inches for the common 2 by 8-inch joists. One skilled in the art would understand that other variations of the brackets and its dimensions are possible. The pair of brackets (104) can be placed right outside each beam notch (101, 102). One bracket is placed on each side of the notch (101) to hold the joist (200) tightly while it sits in the beam notch (101) between the brackets (104). If the beam (100) has half-notched ends (102), then a single bracket can be placed at the underside of the half-notched ends (102) to assist with fastening the frame units (300) in place. Alternatively, a bracket pair (104) can be used, one right on the outside of the half-notched ends (102) and one on the underside of the half-notched ends (102).

Alternatively, the subfloor system can be constructed without the use of brackets similar to traditional deck construction. The joists can be affixed directly on top of a main supporting beam (100). Instead of utilizing metal brackets for this connection, the joists could be secured to the beams (100) by any known techniques e.g. using a framing nail gun or any other fastening means such as deck screws, galvanized nails or brackets. This tool is employed to drive nails from both sides of the joist (200) into the beam (100), effectively fastening the joist (200) in place. This method is straightforward and widely used and relies on nails to ensure the structural integrity of the deck by firmly attaching the joists to the beam (100). Traditionally, fastening means include deck coated screws, galvanized nails, and/or brackets.

Overhang

Optionally, the proposed subfloor system may use beams (100) that are a few inches shorter than the deck's intended surface size. For instance, for a 10 by 10 feet (or 120 inches by 120 inches) deck, the beams (100), the joists and optionally the rim joists (400) could all be made a few inches shorter e.g. 117 inches long. This approach reduces the deck's structure to 117 inches by 117 inches, creating a 1½-inch overhang on all sides of the deck. Similarly, the components could be made 115 inches long, which creates a 2½-inch overhang on all sides of the deck. A person skilled in the art would understand that the overhang dimensions could be varied depending on decking design and requirements. This overhang not only contributes to an appealing visual effect but also simplifies and standardizes the construction process for all deck sizes.

An overhang, in the context of deck construction, refers to the portion of the deck surface that extends beyond the main structural frame, including beams (100), joists (200), and rim joists (400). This deliberate periphery/overhang creates a border or lip around the deck's perimeter. Here's a breakdown of its purpose and benefits:

Aesthetic Appeal: The overhang adds a finished look to the deck by creating a visually pleasing border that frames the deck area. It enhances the deck's design by providing a clean and polished edge, contributing to the overall aesthetics of the outdoor space.

Protection and Durability: By extending over the structural frame, the overhang helps protect the sides of the deck structure from the elements, such as rain or snow, potentially reducing water ingress and damage to the frame. This can prolong the lifespan of the deck by minimizing exposure to moisture and decay.

Safety: The overhang can also serve as a safety feature by preventing trips and falls. It provides a clear boundary of the deck's usable area, making it easier for people to recognize the edge of the deck without looking down constantly.

Functional Space Usage: This design element can also be functional, allowing for the attachment of accessories like deck lighting, or providing a slight ledge for sitting in some designs. It can also facilitate better drainage by directing water away from the deck's foundation.

For instance, in the example provided above, a 1½-inch overhang all around means that the deck's surface extends 1½ inches past the edge of the underlying structural supports on all sides. This design decision not only enhances the deck's appearance but also incorporates practical benefits related to durability, safety, and functionality. It's a thoughtful detail that elevates the overall design and user experience of the deck.

Joists

Joists (200) are the repeated structural members that are used to build a deck frame. The minimum size and dimension of a joist (200) used in deck construction depends on the distance the joists (200) span between bearing points. The present invention proposes a few different variations of the joists (200). The subfloor system can be constructed using any variation of the joist (200).

Version 1: The joist (200) is crafted with a minimum of two exact surface notches (201) on one side to interlock precisely with the corresponding beam notches (101, 102) on the support beams (100). The number of surface notches (201) may range from 2-10 notches (201) depending on the decking size. The notches (201) on the joist (200) fits snugly with the corresponding beam notch (101, 102) on the beam (100). When the joist (200) is placed on the beams (100), these surface notches (201) ensure it is automatically squared and aligned straight, at a perfect right angle to the beams (100). This design element streamlines the construction process by eliminating the need to manually square the deck. In addition, the joist (200) features an equal overhang at both ends when seated on the beams (100). This design consideration is essential for the even distribution of the deck's weight across the beams (100), which is a critical factor for the structural stability of the deck. The careful design of the surface notches (201), coupled with the balanced overhang of the joist ends (205), simplifies the assembly while contributing to the overall strength and visual harmony of the deck structure. The joist ends (205) have at least two identical half notches (202) which creates a rim support piece (203) that sticks out. The rim support piece (203) on each end of the joist (200) allows fitting a rim joist (400). This design lets the rim joist (400) sit right into place with the joist ends (205), making it much easier to put together. One doesn't have to hold up the rim joist (400) while attaching it, which saves time and effort. Not only does this make the assembly process very simple, but this design will provide more strength to the deck. Optionally, any fastener such as deck coated screws can be used to further fasten the rim joist (400) on the joist ends (205).

Figure 2A:
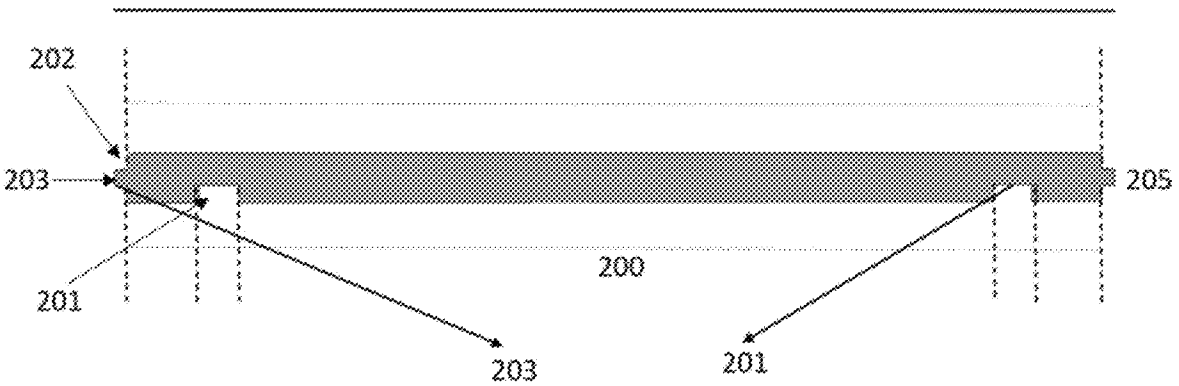
FIG. 2A shows a side view of version 1 of the pre-notched joist.

The precise dimensions of the joist (200), notching (201, 202) and the rim support piece (203) will depend on the size of the deck and corresponding components of the subfloor system. The length of each joist end half notch (202) may vary from ½ inches to 5 inches, the depth of each half notch (202) may vary from ¼ inch to 4½ inches, and the width of each half notch (202) may vary ½ inch to 5 inches. In an exemplary embodiment, as shown in FIG. 2A, the joist end half notches (202) may be 1½ inch long, 1½ inches wide and 2 inches deep. The length of each joist surface notch (201) may vary from ½ inches to 5 inches, the depth of each notch (201) may vary from ¼ inch to 3½ inches, and the width of each notch (201) may vary 2 inches to 10 inches. In an exemplary embodiment, as shown in FIG. 2A, each joist surface notch (201) may be 1½ inch long, 5½ inches wide and 1 inch deep. The dimensions of the rim support piece (203) depend on the dimensions of the half notches (202). The rim support piece (203) can be provided on one or both ends of the joists (200). Accordingly, in a variant, the proposed joist (200) can have a rim support piece (203) sticking out from one end of the joist (200) and the other end is un-notched to provide a smooth end. The smooth end of the joist (200) can be connected to rim joist (400) if needed by traditional means e.g. any fasteners known in the art.

Figure 2B:
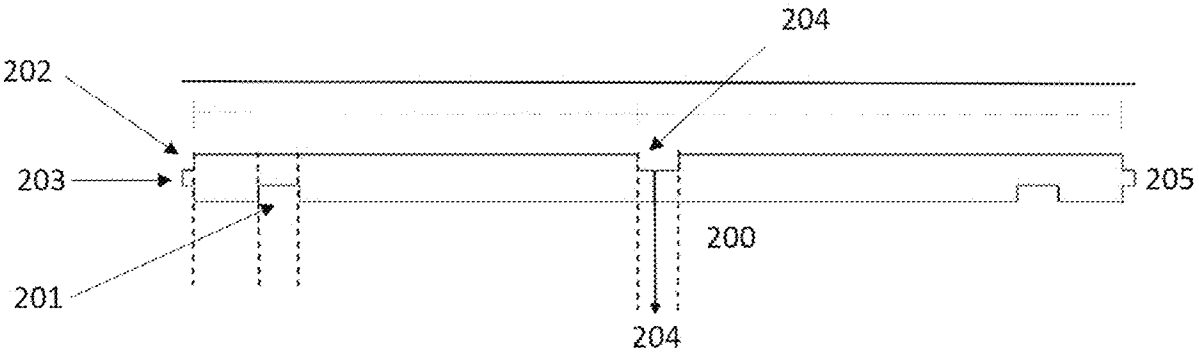
FIG. 2B shows a side view of version 2 of the pre-notched joist.

Version 2: This joist (200) design maintains the features of version 1, with the addition of a central notch (204). Accordingly, the joist (200) is equipped with a minimum of two surface notches (201) on one side and at least one central notch (204) on the opposite side of the joist (200) i.e. on a side that's opposite to the side that's equipped with surface notches (201). The joist (200) can optionally be equipped with joist end half notches (202) to provide a rim support piece (203) that sticks out. The dimensions of the surface notches (201), end half notches (202) and rim support piece (203) can vary as defined in Version 1. The central notch (204) also referred to as the joist blocking notch (204) may be ½ inch to 5 inches long, ¼ inch to 3½ inches deep, and ½ to 7 inches wide. In an exemplary embodiment, as shown in FIG. 2B, the central notch (204) is 1½ inch wide, 1 inch deep and 3½ inches wide.

Figure 2C:
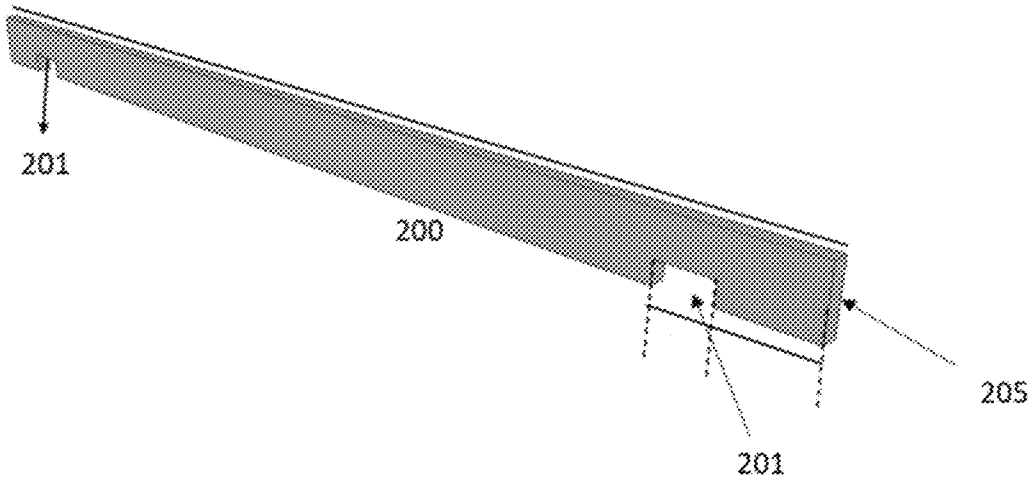
FIG. 2C shows a side view of version 3 of the pre-notched joist.
Figure 2D:
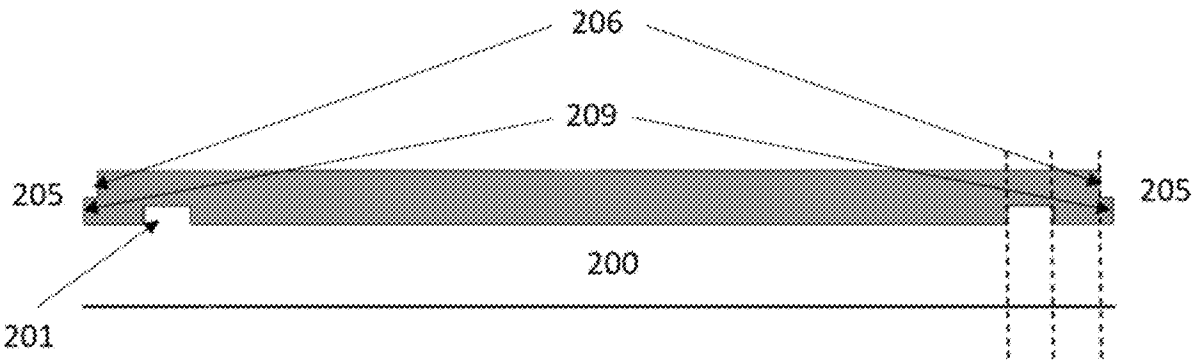
FIG. 2D shows a side view of version 4 of the pre-notched joist.
Figure 2E:
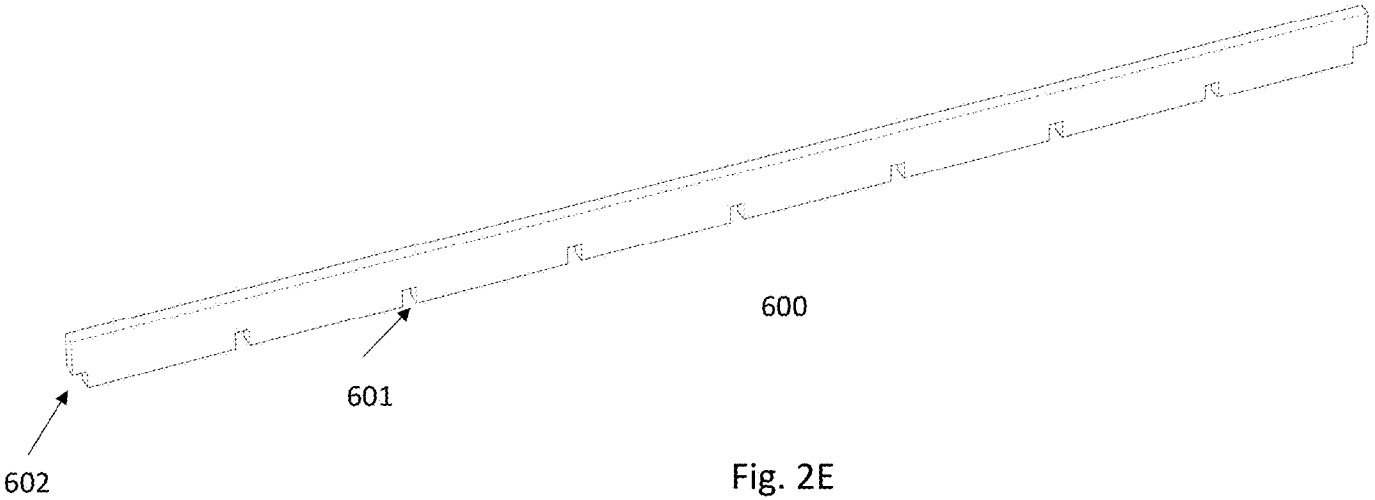
FIG. 2E shows a side perspective view of the deck blocking piece.
Figure 2F:
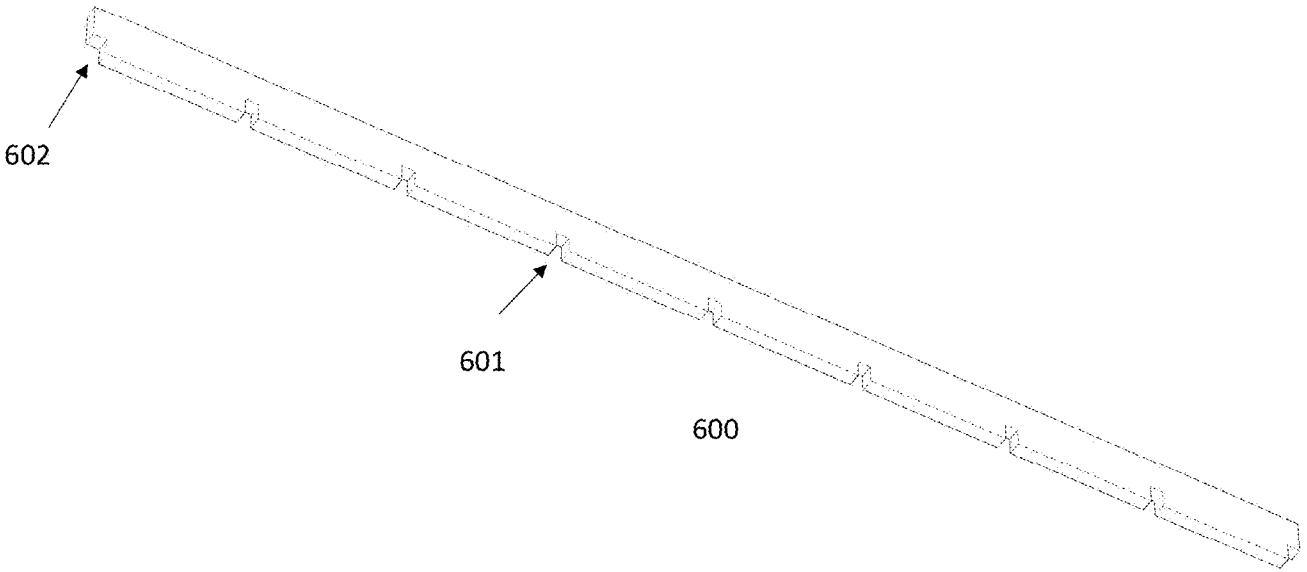
FIG. 2F shows a bottom perspective view of the deck blocking piece.
Figure 2G:
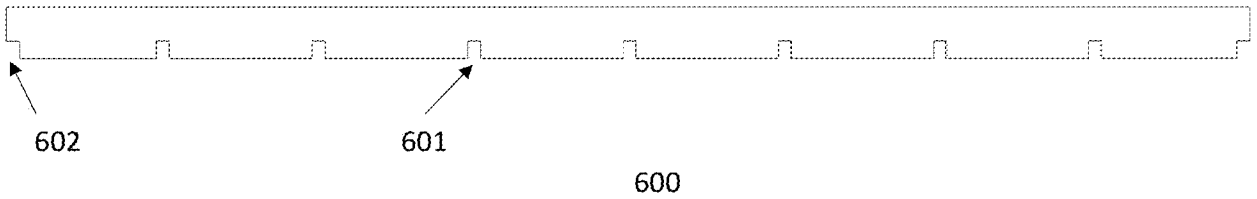
FIG. 2G shows a side view of the deck blocking piece.

Traditional decks are sometimes equipped to receive multiple small blocks for added stability. This technique is known as deck blocking, wherein the multiple small blocks (hereinafter referred to as "deck blocking piece (600)") are placed between each joist (200). The proposed subfloor system may be integrated to receive small blocks through the central notch (204). The proposed design streamlines this process by integrating a notch (204) in the center of the joist's (200) surface. This central notch (204) can be sized to accommodate a standard 2×4 block, or any other dimension which, when inserted into the central notches (204) across all joists (200), forms a singular, elongated deck blocking piece (600). By doing so, it eliminates the need for separate small deck blocking pieces, simplifying the construction and enhancing the structural cohesiveness of the deck. The result is a deck that is quicker to assemble and offers increased stability through this unified deck blocking system. Each deck blocking piece (600) has one or more joist blocking grooves (601) that sit in the central notch(es) (204) of one or more pre-notched joists (200). In some cases, the deck blocking piece (600) may have a half-frame blocking groove (602) at each end to block the central notch (204) of the frame units (300). A proposed diagrammatic representation of the deck blocking piece (600) with the joist blocking grooves (601) and half-frame blocking grooves (602) is shown in FIG. 2E-2G. A side perspective view is shown in FIG. 2E, a bottom perspective view is provided in FIG. 2F, and a side view is provided in FIG. 2G.

The rim support piece (203) can be provided on one or both ends of the joists (200). Accordingly, in a variant, the proposed joist (200) can have a rim support piece (203) sticking out from one end of the joist (200) and the other end is un-notched to provide a smooth end (205). The smooth end (205) of the joist (200) can be connected to rim joist (400) if needed by traditional means e.g. any fasteners known in the art.

Version 3: The proposed subfloor system could be constructed using another variation of the joist (200). The joist (200) is crafted with a minimum of two exact surface notches (201) to interlock precisely with the corresponding notches (101) on the support beams (100). When the joist (200) is placed on the beams (100), these notches (101, 201) ensure it is automatically squared and aligned straight, at a perfect right angle to the beams (100). This design element streamlines the construction process by eliminating the need to manually square the deck.

However, this joist (200) design does not have any joist end half notches (202), and therefore, no rim support pieces (203). Neither will the joist (200) have a central notch (204). The dimensions of the joist (200), and surface notches (201) could be as defined in Version 1 and 2. An exemplary embodiment of this variant is shown in FIG. 2C.

In addition, similar to Versions 1 and 2, the joist (200) features an equal overhang at both ends when seated on the beams (100). This design consideration is essential for the even distribution of the deck's weight across the beams (100), which is a critical factor for the structural stability of the deck. This careful design of the surface notches (201), coupled with the balanced overhang of the joist ends (205), simplifies the assembly while contributing to the overall strength and visual harmony of the deck structure. Not only will this make the assembly process very simple, but this design will provide more strength to the deck.

Figure 3A:
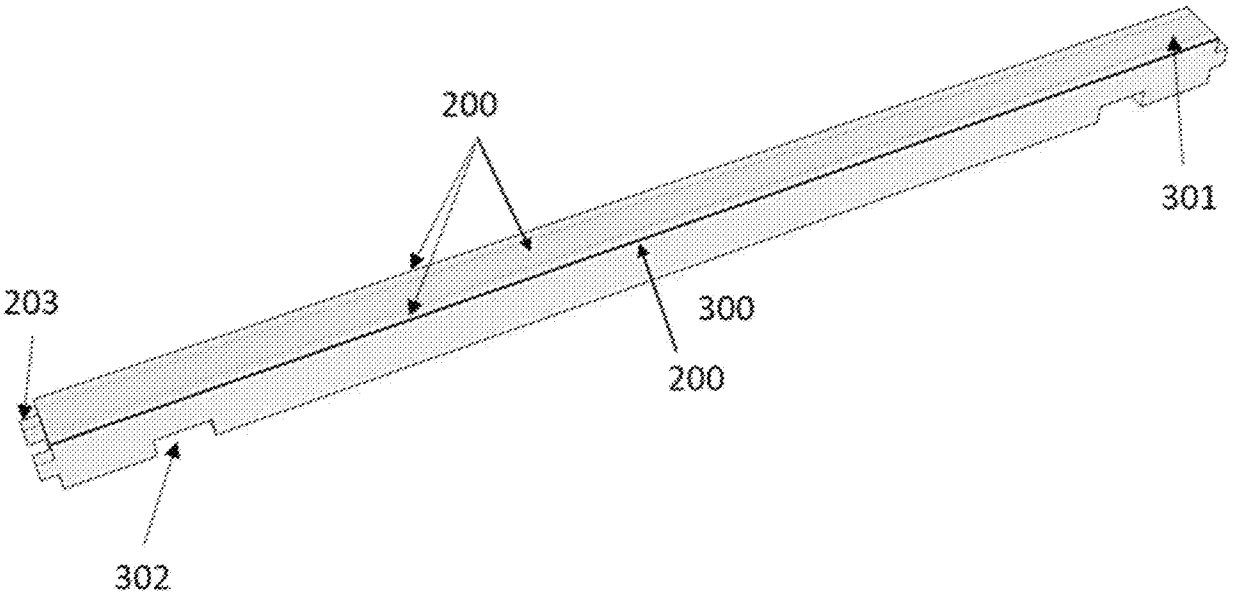
FIG. 3A shows a diagrammatic representation of a frame unit with pre-notched joist version 1.
Figure 3B:
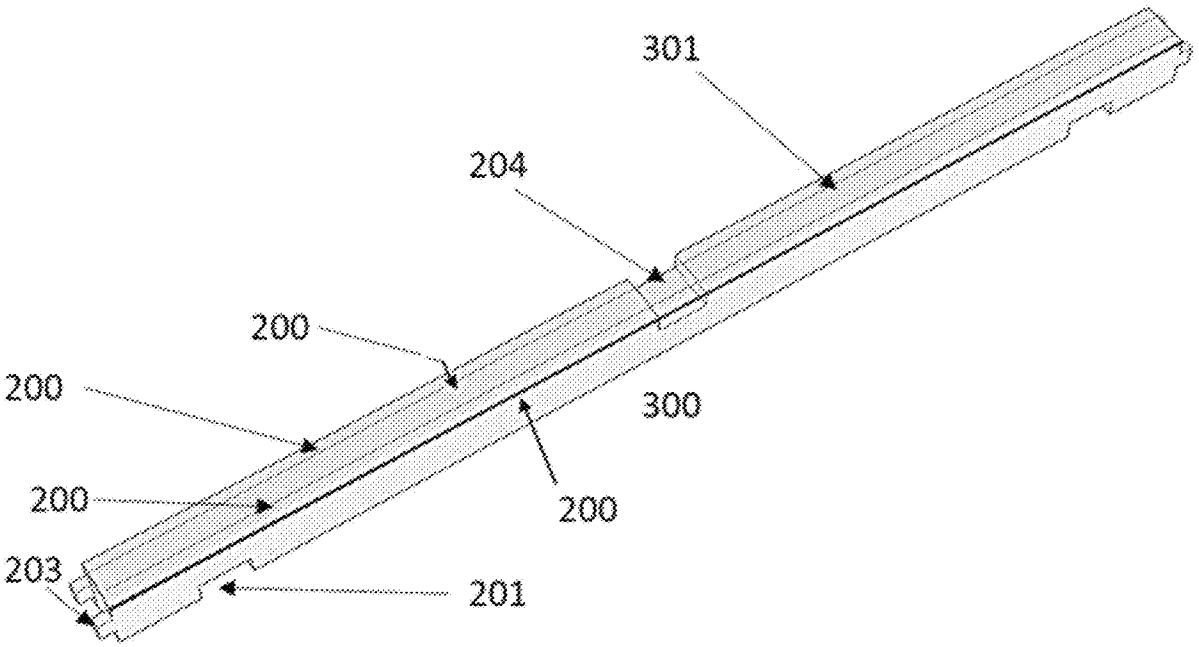
FIG. 3B shows a diagrammatic representation of a frame unit with pre-notched joist version 2.
Figure 3C:
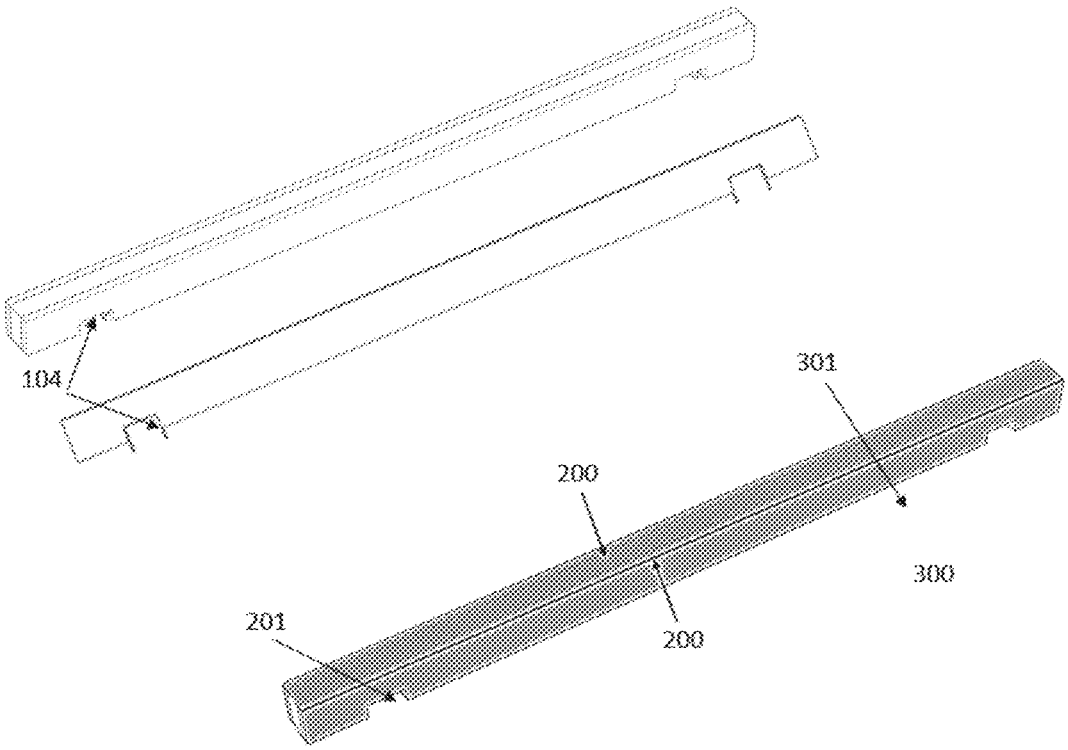
FIG. 3C shows a diagrammatic representation of a frame unit with pre-notched joist version 3.
Figure 3D:
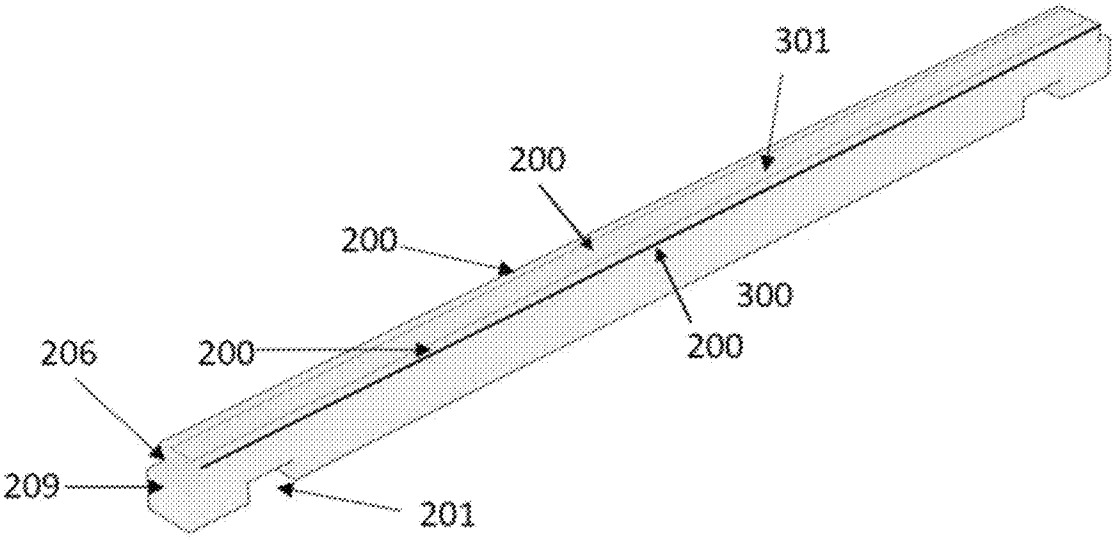
FIG. 3D shows a diagrammatic representation of a frame unit with pre-notched joist version 4.

Since this variant does not have a rim support piece (203), any standard deck coated screws or any other fastener can be used to fasten the rim joist (400) on the joist ends (205). Optionally, the joist ends (205) could be equipped with male brackets (208) that fit perfectly with the female brackets (not shown in the figures) attached on the rim joists (400) to provide seamless connection. [as shown in FIG. 3D]. In an alternate variant, the joist end (205) can be provided with holes/cavities that receive a dowel pin (403). For instance, the joist (200) can be provided with two holes/cavities (also referred to as "dowel pin receiving cavities") on the each of the joist ends (205) that receive the corresponding dowel pins (403) on the rim joists (400) to fasten the rim joist on the joist ends (205).

Version 4: The proposed subfloor system can be constructed using a fourth variant of joist (200). This joist (200) design is crafted with a minimum of two exact surface notches (201) to interlock precisely with the corresponding notches (101) on the support beams (100). When the joist (200) is placed on the beams (100), these notches (101, 201) ensure it is automatically squared and aligned straight, at a perfect right angle to the beams (100). This design element streamlines the construction process by eliminating the need to manually square the deck.

The dimensions of the joist (200) and surface notches (201) can be similar to the Versions 1, 2 and 3. However, in addition, the joist ends (205) have an interior L-shaped notch (206), that provides a seat to allow a standard rim joist (400) to sit on the L-shaped notch (206). This design lets the rim joist (400) sit right on top of the joist ends (205), making it much easier to put together. With the L-shaped notch (206), one doesn't have to hold up the rim joist (400) when attaching it, which saves a lot of time and effort. The L-shaped notch (206) is 1.5" in length×3.5" in depth. The L-shaped notch (206) creates a rim support protrusion (209) which is different from the rim support piece (203) of Version 2. The rim support piece (203) is in the center of the joist (200), whereas the rim support protrusion (209) forms on one side of the joist (200), mostly the same side on which the surface notches (201) are provided. The length of the rim support protrusion (209) for a joist (200) that is 2"×6", which technically is 1.5"×5.5", will be 1.5". The rim joist (400) for a 2"×6" joist (1.5"×5.5") is a 2"×4" which technically is 1.5"×3.5". The 5.5" inch portion of the joist (200) will have an L-shaped notch (206) that is 3.5' in depth. This allows the rim joist (400) to sit perfectly onto the L-shaped notch (206), while being flush to the joist (200) surface and not sticking out past it. The area where the rim joist (400) is resting now that was originally 5.5" is now 2" plus the 3.5" for the rim it creates 5.5".

In addition, the joist (200) features an equal overhang at both ends when seated on the beams (100). This design consideration is essential for the even distribution of the deck's weight across the beams (100), which is a critical factor for the structural stability of the deck. The careful design of the surface notches (201), coupled with the balanced overhang of the joist ends (205), simplifies the assembly while contributing to the overall strength and visual harmony of the deck structure. Not only does this make the assembly process very simple, but this design provides more strength to the deck. Any standard fastening mechanism such as deck coated screws, galvanized nails or brackets can be used to further fasten the rim joist (400) on the joist ends (205). An exemplary embodiment of Version 4 joist (200) is shown in FIG. 2D.

The rim support protrusion (209) can be provided on one or both ends of the joists (200). Accordingly, in a variant, the proposed joist (200) can have a rim support piece (203) sticking out from one end (205) of the joist (200) and the other end (205) is un-notched to provide a smooth end. The smooth end (205) of the joist can be connected to a rim joist (400) if needed by traditional means e.g. any fasteners known in the art.

Alternatively, the joist (200) may be equipped with a two joist end half notches (202) on one end (205) and an internal L-shaped notch (206) on the other end (205), thereby providing a rim support piece (203) one end and a rim support protrusion (209) on the other end.

In some cases, the pre-notched joists may be divided in two or more pieces (200A). For instance, the pre-notched joists (200A) may be provided in two equal halves or three or more equal or unequal pieces. The pieces when put together would form one complete pre-notched joist (200A). The split pre-notched joists (200A) may be provided with additional notches or an extended notch such that the two notches when put together make a complete rectangular notch. The split joist design may be provided in any of the versions described above.

In some embodiments, an additional joist extension/connector piece is provided. The joist extension/connector piece is placed on each split beam in a direction perpendicular to the split beam. The joist extension piece connects the two or more split joists or split joist box units. The half notches of the joist/joist box are connected or extended by means of the extension piece.

Picture Frame Box

Traditional picture frame boxes are created using scrap materials of by connecting lumber pieces to create a stable surface that would accept picture frame deck boards (700). However, traditional picture frame boxes do not provide any additional functionality to allow gazebo installation.

The proposed subfloor system features a 'picture frame box (300)' designed for enhancing the structural robustness of a deck while facilitating the installation of a deck board picture frame. The picture frame box (300) comprises of at least two frame units (300). Each frame unit (300) is constructed using at least two pre-notched joists (200) as and a central connecting piece (301) to form a sturdy U-shaped unit which is assembled with fastener's e.g. screws. The pre-notched joist (200) can be selected from any of the above joist (200) variants (Version 1 to Version 4). The dimensions of the connecting piece (301) would depend on the dimensions of the joists (200) and the overall decking size. The picture frame box (300) can also be referred to as a "joist box (300)" as in the proposed subfloor system, the joist box (300) is constructed using at least two pieces of joists (200) and a flat piece of wood (connecting piece (301)) on top or in between the joists (200) to make it a box. It is pertinent to note that the picture frame box, joist box, or frame units all refer to the same component.

For instance, the connecting piece (301) can be a standard 2 feet×4 feet lumber piece that sits in between two joists (200). A diagrammatic representation of a frame unit (300) with Version 1 joist (200) is shown in FIG. 3A, with Version 2 joist (200) is shown in FIG. 3B, with Version 3 joist (200) is shown in FIG. 3C, and with Version 4 joist (200) is shown in FIG. 3D. In an exemplary embodiment, the dimensions of the piece (301) that connects the two joists (200) together creating the joist box (300) is 2"×4" lumber×the length of the joists for that kit size. In any of the above versions of joist box/frame units (300), one or more brackets (104) might be provided on the outside of the surface notches (201) to further secure the frame units with the pre-notched beams (100), as sown in FIG. 3C.

Each of the frame units (300) of the proposed joist box (300) are installed on the deck beams (100) analogous to the joists (200). However, the frame units (300) are placed towards the end of the beams (100). For instance, if the proposed subfloor system is constructed using two beams (100) with 12 surface notches (101, 102), one would need 10 joists (200) and 2 frame units (300) that would fit snugly in the 12 beam notches (101, 102), where the 2 frame units (300) would be placed at the extremes and 10 joists (200) would be placed in between the 2 frame units (300).

The top surface of the frame units (300) provides a broadened surface owing to the connecting piece (301) and multiple joists (200). The top surface of the frame unit (300) can be broadened to accommodate a width of 4 inches to 14 inches. In the exemplary embodiment, the frame units (300) have a top surface of 6.5 inches, providing a solid foundation for the frame deck boards (700) to sit upon.

Optionally, the picture frame units (300) could be provided with additional brackets (104) e.g. metal brackets (104) to hold them in place once placed on the beams (100). Since, the top of the frame unit (300) is smooth and there is no access to screw the bracket. Therefore, for added structural integrity of the frame units (300) of the picture frame box (300), a bracket is placed on the underneath of the frame units (300) of the picture frame box (300). Optionally, a bracket can also be placed on the beam (100) that allows fastening the picture frame units (300).

Deck boards run along the regular joists (200) and overlap a few inches of the frame units (300) of the picture frame box (300) on both sides, ensuring stable support. In an exemplary embodiment, the deck boards overlap about 3-7 inches of the frame units (300). Therefore, the remaining width of the frame units (300) is precisely sized to support the picture frame boards (700). This dual function is pivotal as the picture frame box (300) not only frames the deck's edge with the frame units (300) but also contributes additional stability, especially as the box components are spaced about 5-7 inches apart on center, which is a wider spacing than typical joist (200) configurations.

Optionally, to further reinforce the frame units (300) of the picture frame box (300), additional support blocks could be affixed to the bottom side of each notched (201, 202) area. These blocks enhance the strength of the frame units (300), particularly supporting the notch (201, 202) against stress and wear. For instance, a support block measuring 3.5 inches by 3.5 inches could be used.

Figure 3E:
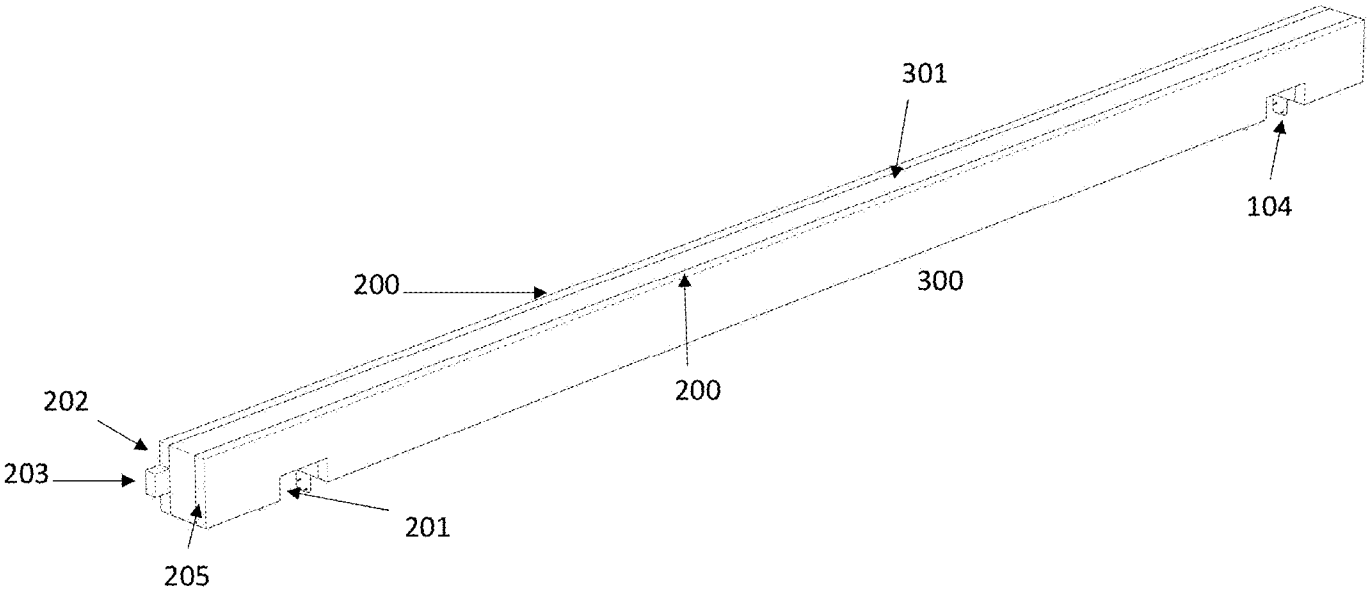
FIG. 3E shows a side-perspective view of a frame unit with pre-notched joist version 1 and pre-notched joist version 3 with optional brackets.
Figure 3F:
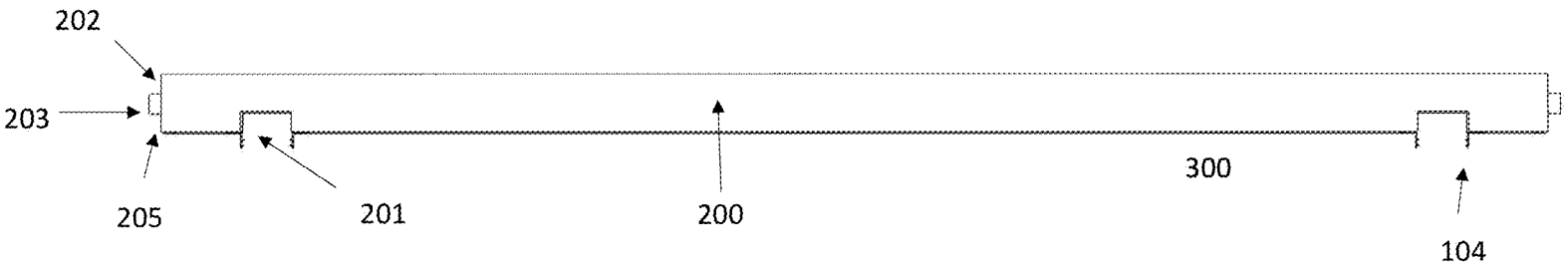
FIG. 3F shows side view of the proposed frame unit with pre-notched joist version 1 and pre-notched joist version 3 with optional brackets.
Figure 3G:
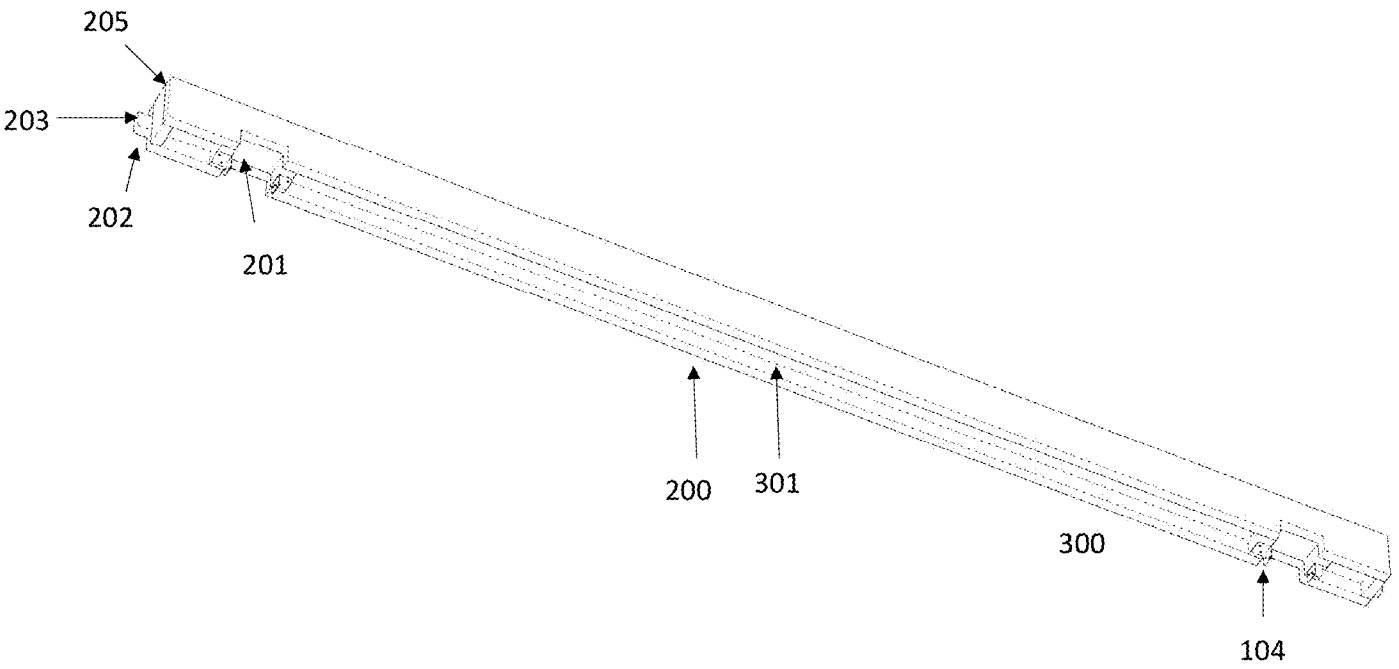
FIG. 3G shows a bottom-perspective view of the proposed frame unit with pre-notched joist version 1 and pre-notched joist version 3 with optional brackets.
Figure 3H:
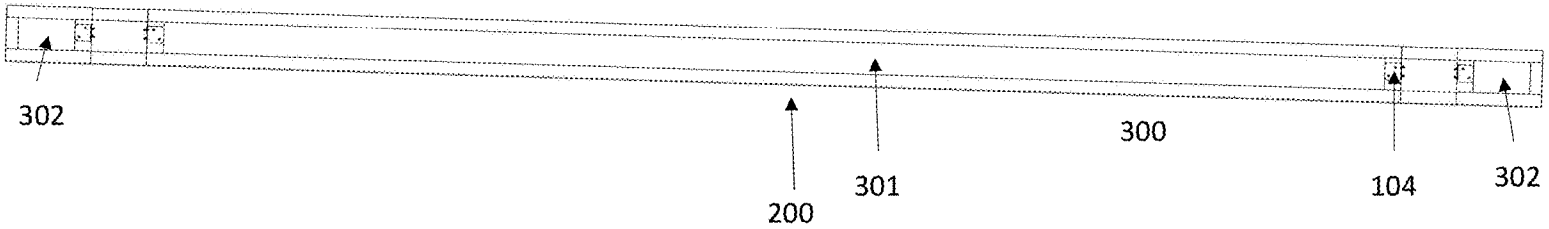
FIG. 3H shows a frame unit with wood struts.

The frame units (300) incorporate at least two supporting wood struts (302) beneath the surface of the frame unit (300), e.g. a wooden strut (302) measuring 2 inches by 4 inches, spanning the width between the joists (200), as shown in FIG. 3H. These struts (302) serve a dual purpose: they protect the box (300) during transportation and significantly increase its structural integrity.

Figure 3I:
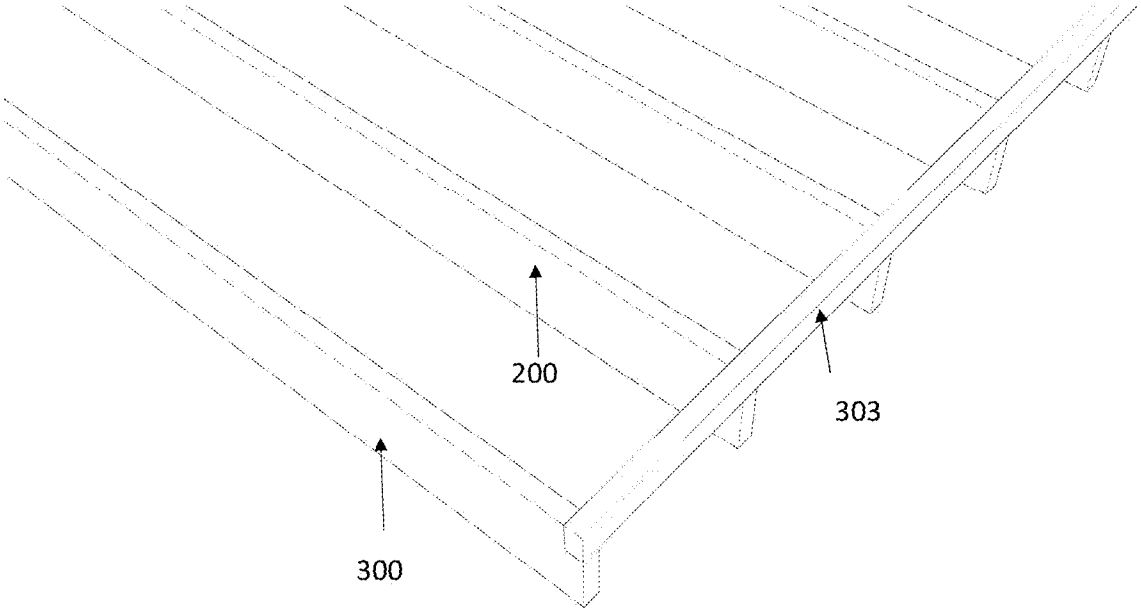
FIG. 3I shows a frame unit and pre-notched joist arrangement with a corner piece.

Optionally, the pre-notched joists (200), frame units (300) or the picture frame box (300) may include a robust thick piece on each corner called the corner piece (303), that helps in creating a solid anchoring point for adding structures like a gazebo or bench to the deck after construction, as shown in FIG. 3I. This integration of functionality and support typifies the innovative approach taken in the design of the deck system, offering practical assembly and enhanced stability for the finished deck.

All frame units (300) of the proposed subfloor system are constructed using at least two joists (200), which are joined together by a central connecting piece (301) e.g. a lumber piece measuring 3.5 inches wide, 1.5 inches thick, and running the length of the joist (200) appropriate to the deck size. This piece serves to firmly connect the two joists (200), forming the primary structure of the box. The connecting piece (301) could be a piece of wood or lumber.

To further bolster the durability and stability of the picture frame box (300), especially in areas subjected to higher stress, additional reinforcement could be provided by support blocks. For instance, each block, measuring 3.5 inches by 3.5 inches, is attached to the underside of the picture frame box (300) at the notches (201, 202). This strategic placement of the blocks aids in fortifying the box where the notches (201, 202) are located, thereby resisting stress and reducing wear over time. These enhancements ensure that the picture frame box (300) can support the necessary structural and functional demands of the deck. The picture frame boxes (300) could be constructed using any version of joists (200) described above with predetermined spacing of 7 inches-21 inches e.g. 14 inches and ⅞ of an inch on center, ensuring optimal structural support and visual appeal.

In an embodiment of the invention, the proposed frame units (300) or the joist box could be constructed using different versions or variants of pre-notched joists (200). For instance, the joist box may comprise a pre-notched joist (200) version 1 and another pre-notched joist (200) version 3, along with a central connecting piece (301), as shown in FIG. 3E. The frame units may optionally be provided with brackets, where the brackets are affixed right outside the surface-notches (201) for additional support, as shown in FIG. 3E. A side-view of this variant is also shown in FIG. 3F. A bottom-perspective view of this proposed frame unit (300) variant is shown in FIG. 3G.

In a proposed variant of the subfloor system, the subfloor can be constructed with four or six frame units (300) such that two or three frame units (300) are placed on end of the beam (100) with joists (200) in between. This may be useful to create decks that require added strength or significant load bearing capacity.

In some cases, the pre-notched joist box/frame unit may be divided in two or more pieces (300A). For instance, the pre-notched joist box (300A) may be provided in two equal halves or three or more equal or unequal pieces. The pieces when put together would form one complete pre-notched joist box/frame unit (300A). The split pre-notched joist box (100A) may be provided with additional notches or an extended notch such that the two notches when put together make a complete rectangular notch. Each split joist box (300A) may have a cavity on when put together would create a single extended cavity. The extended cavity may be plugged with a box piece (1200A) that plugs the entire cavity of the combined split joist boxes (300A). In some embodiments, three or more joist boxes may be used in a subfloor system. After plugging the joist box (300A) with the box piece (1200A), a deck divider (1000A) may be placed on top of the plugged joist box and deck boards (800A) are placed on either side of the deck divider (1000A).

Figure 7:
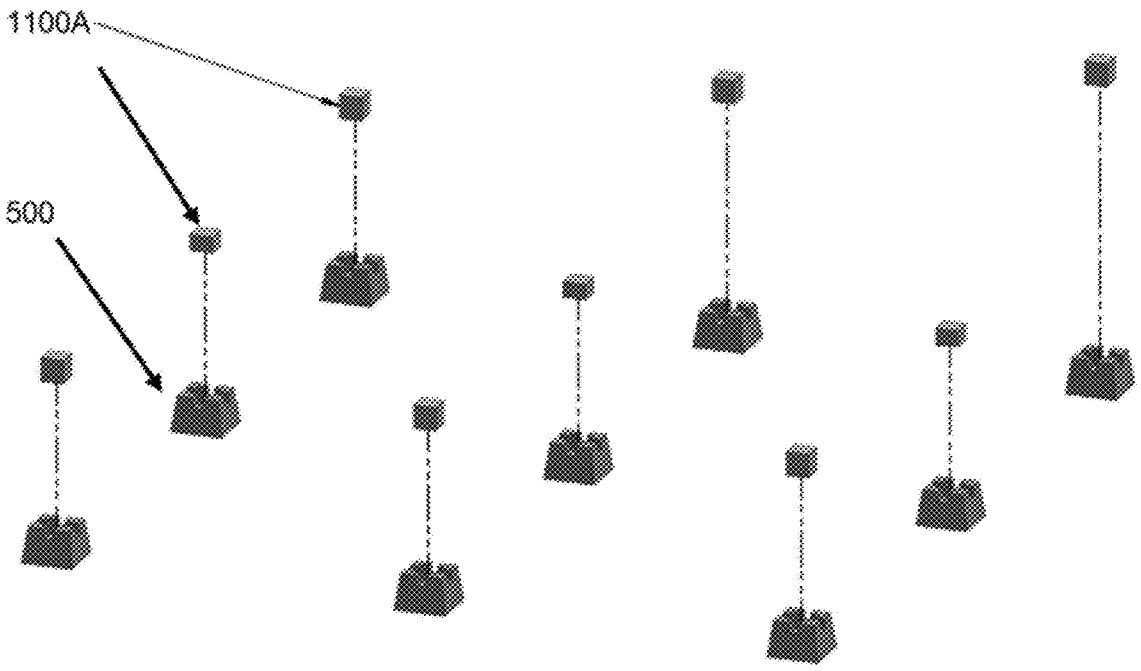
FIG. 7A to 7R provides a step wise overview of the assembly of a split subfloor and split deck system.
Figure 7:
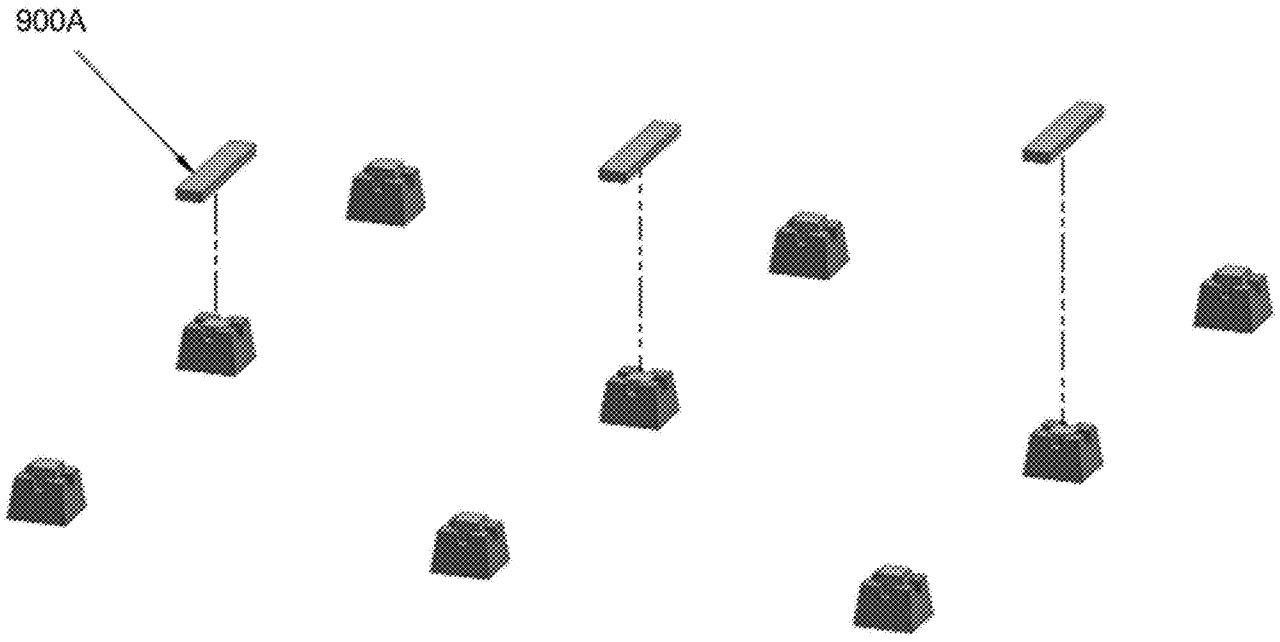
Figure 7:
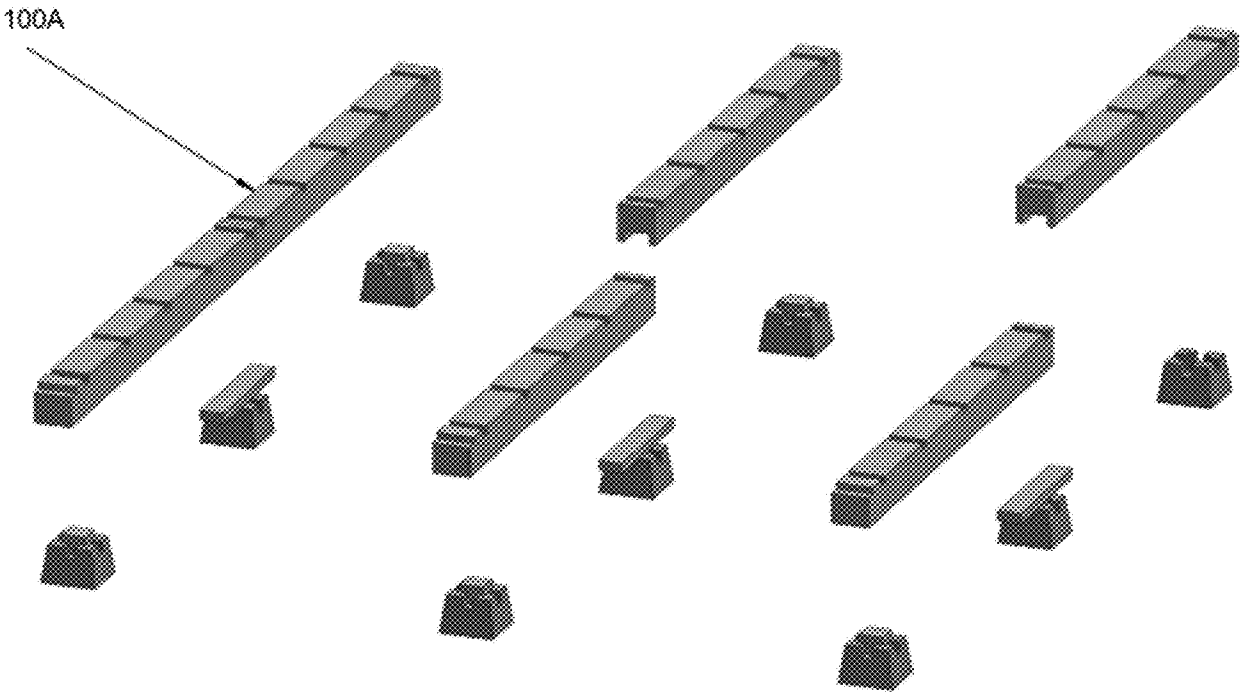
Figure 7:
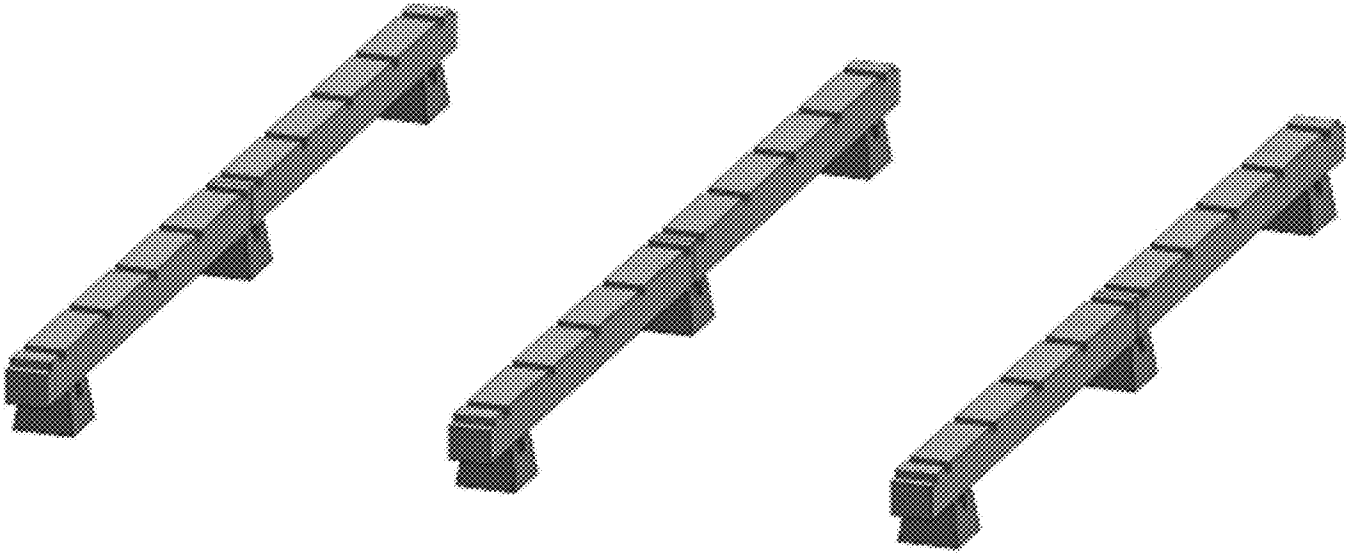
Figure 7:
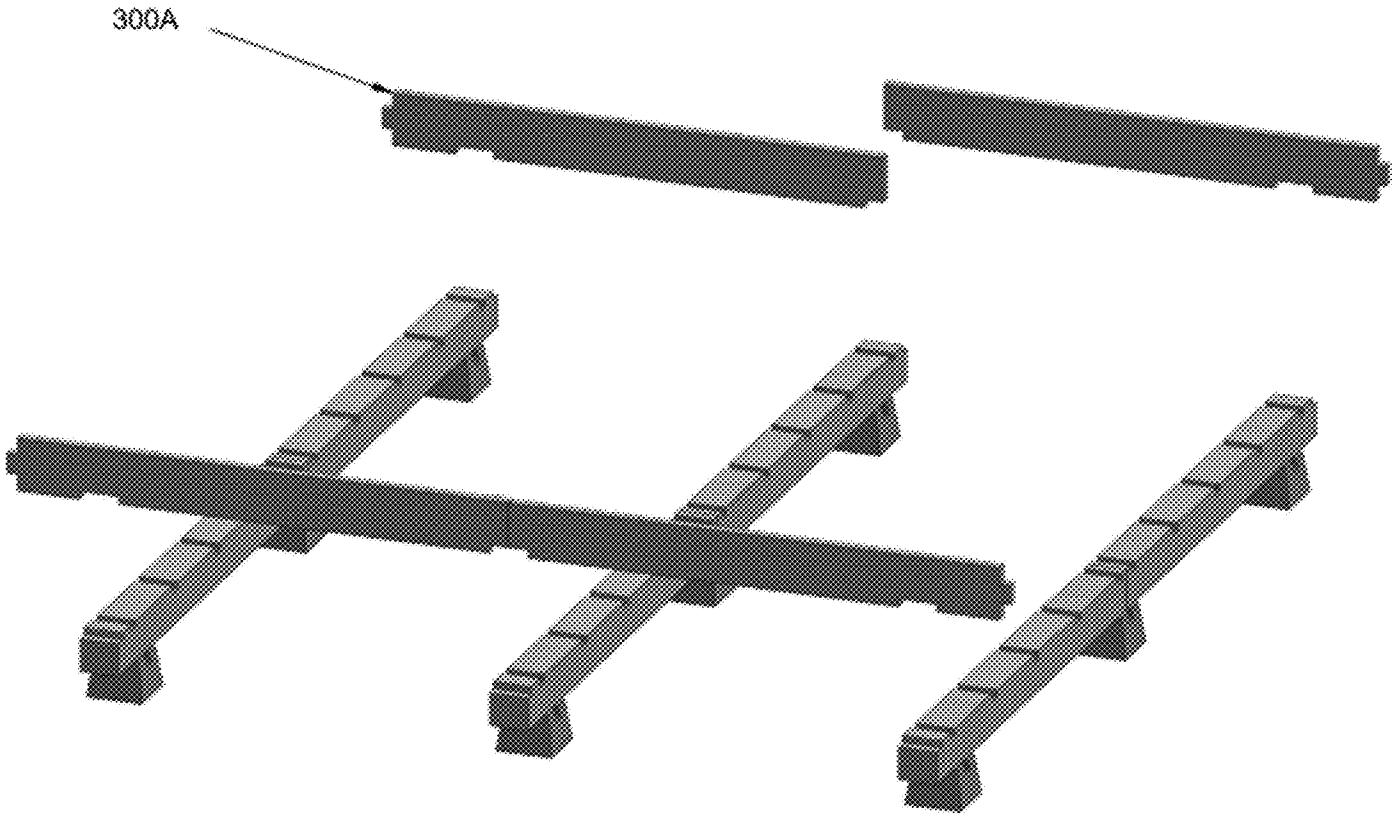
Figure 7:
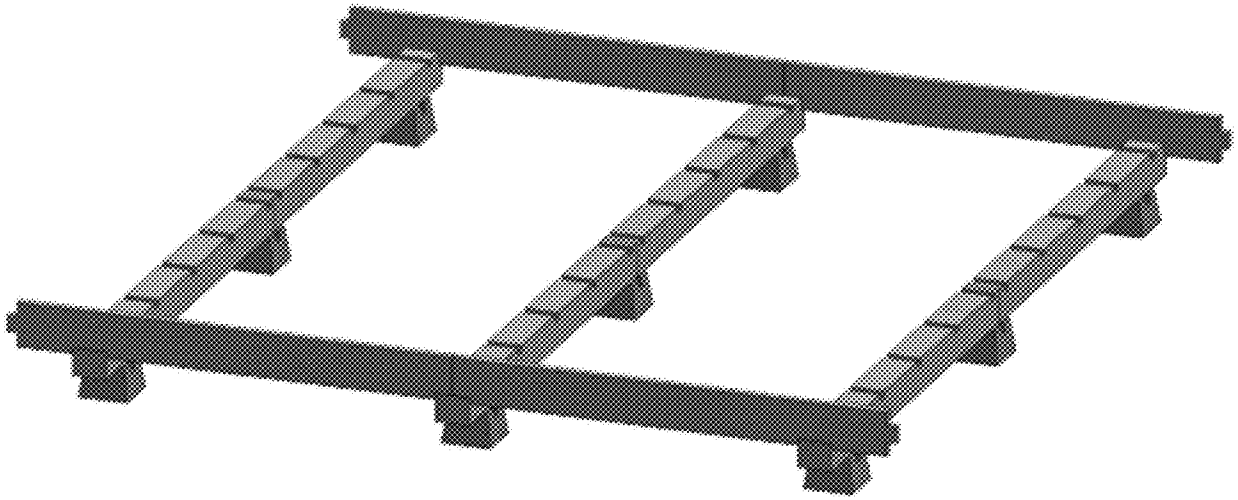
Figure 7:
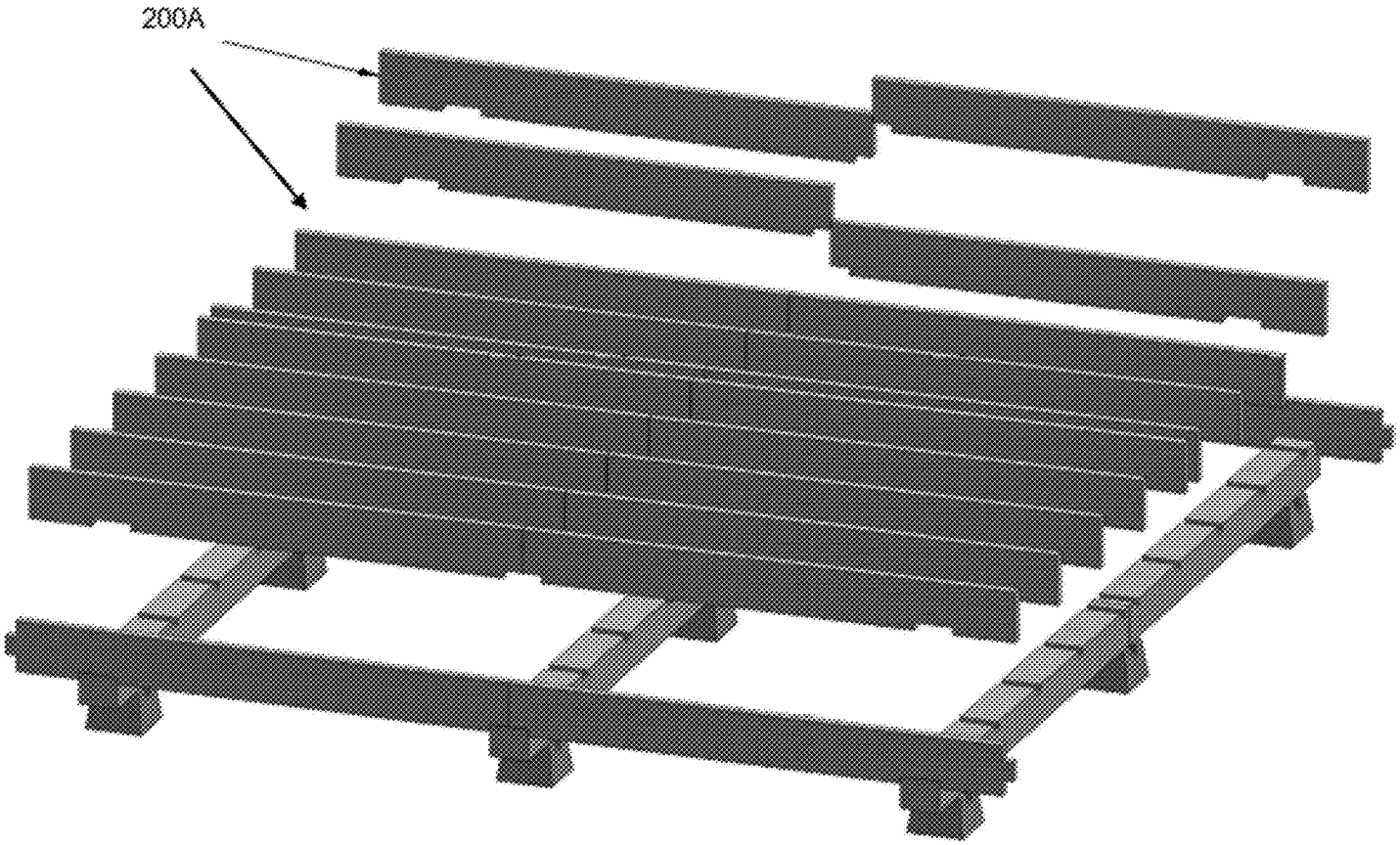
Figure 7:
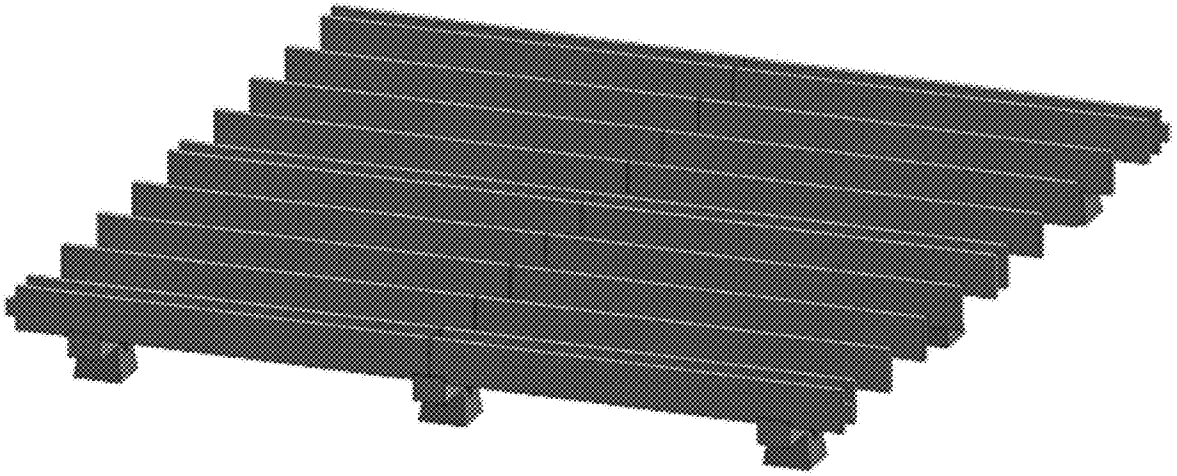
Figure 7:
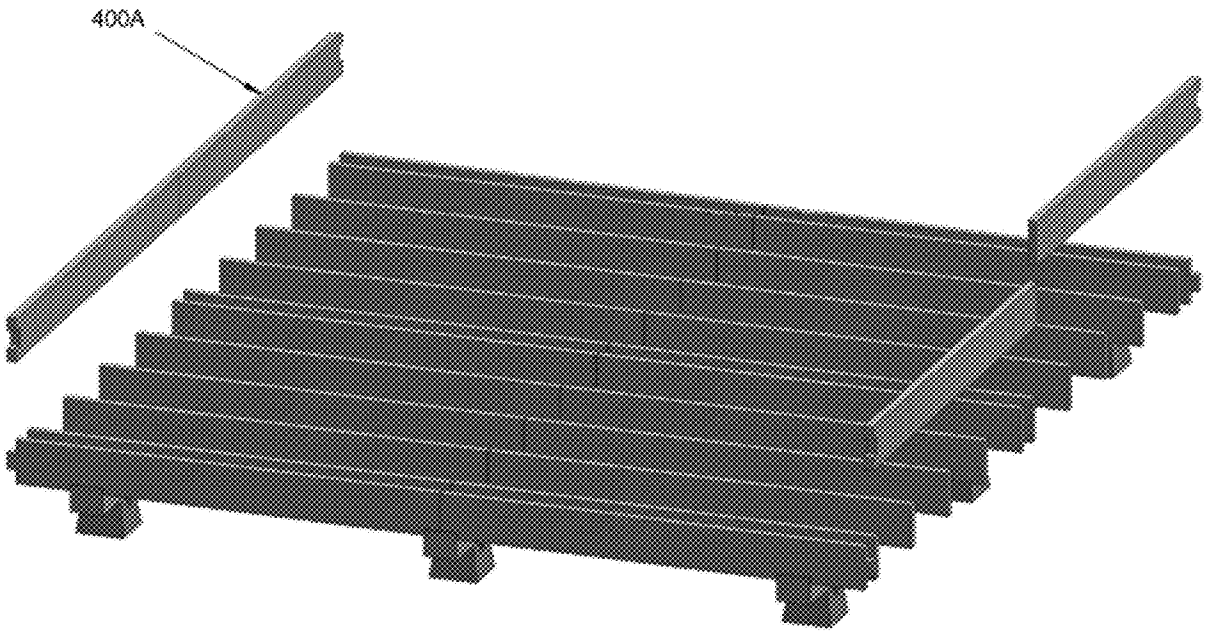
Figure 7:
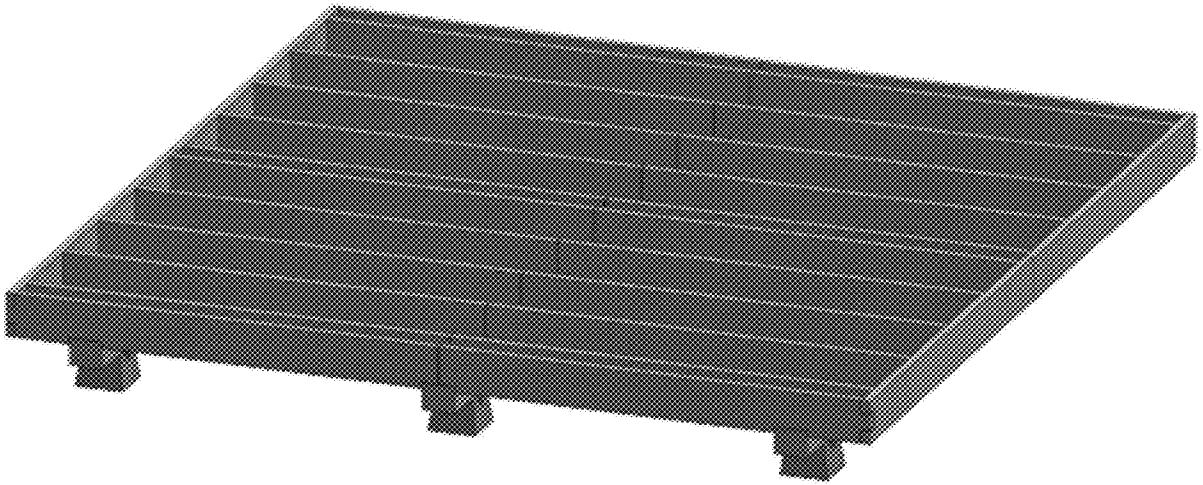
Figure 7:
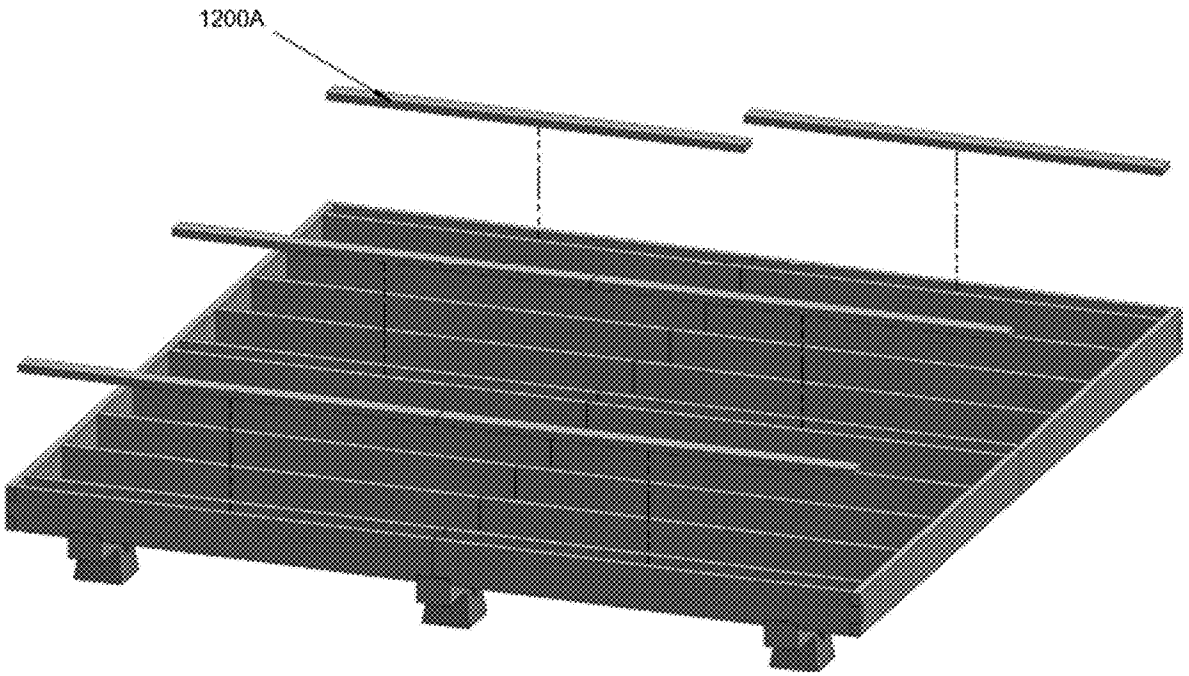
Figure 7:
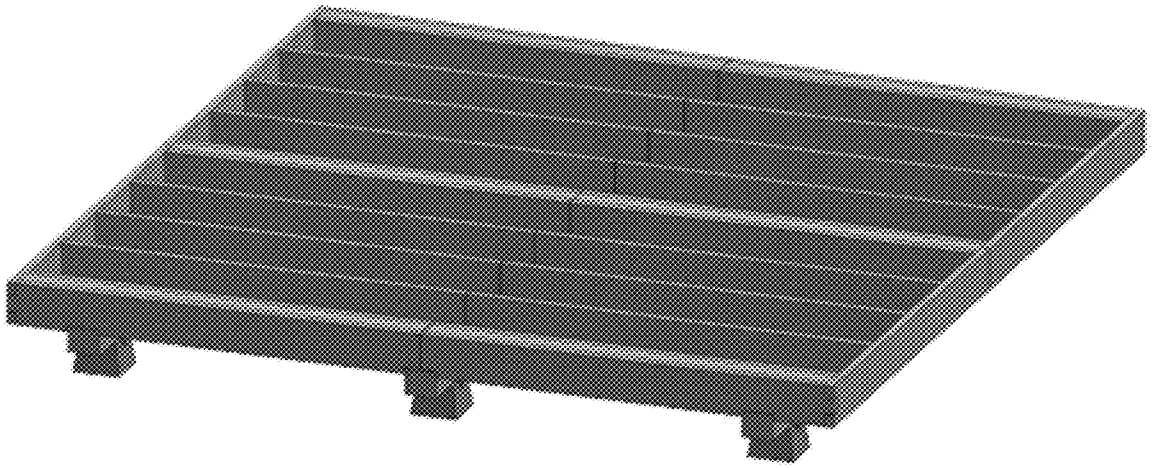
Figure 7:
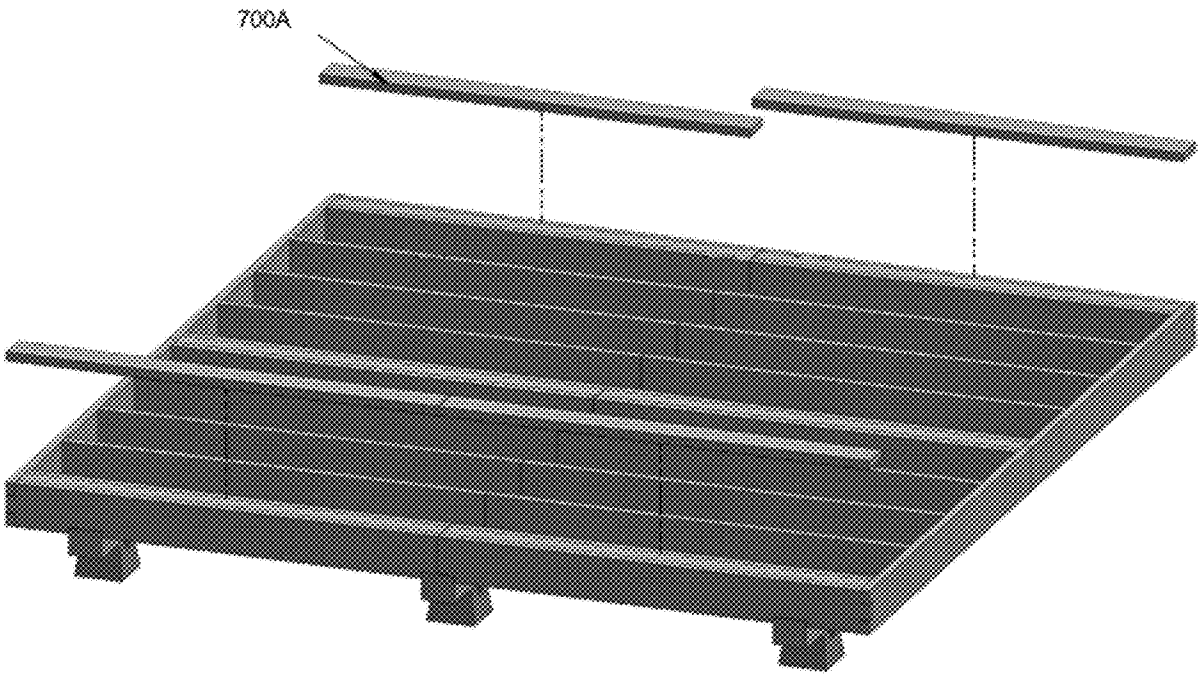
Figure 7:
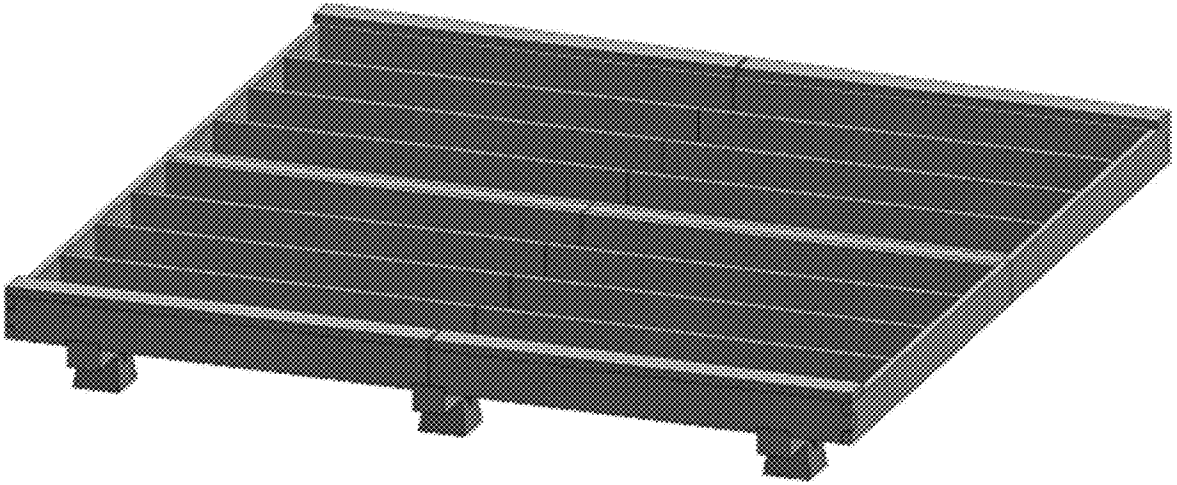
Figure 7:
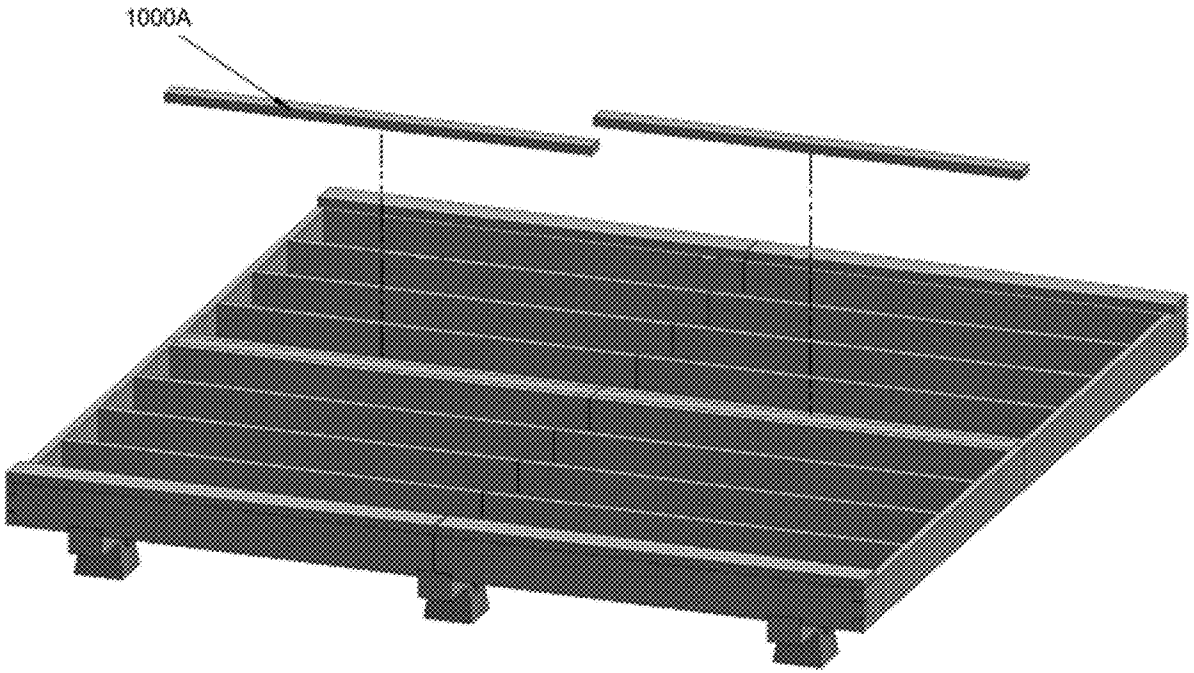
Figure 7:
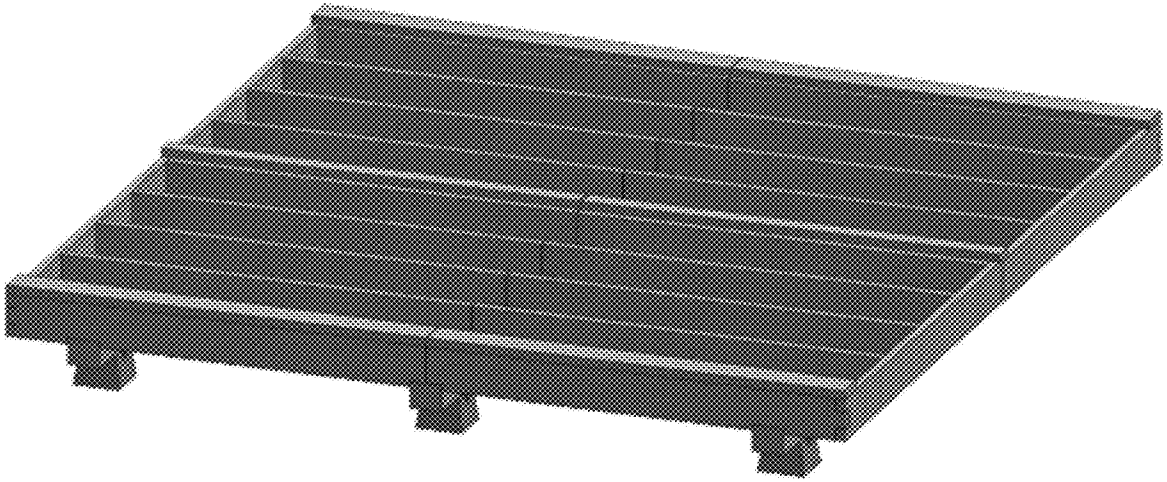
Figure 7:
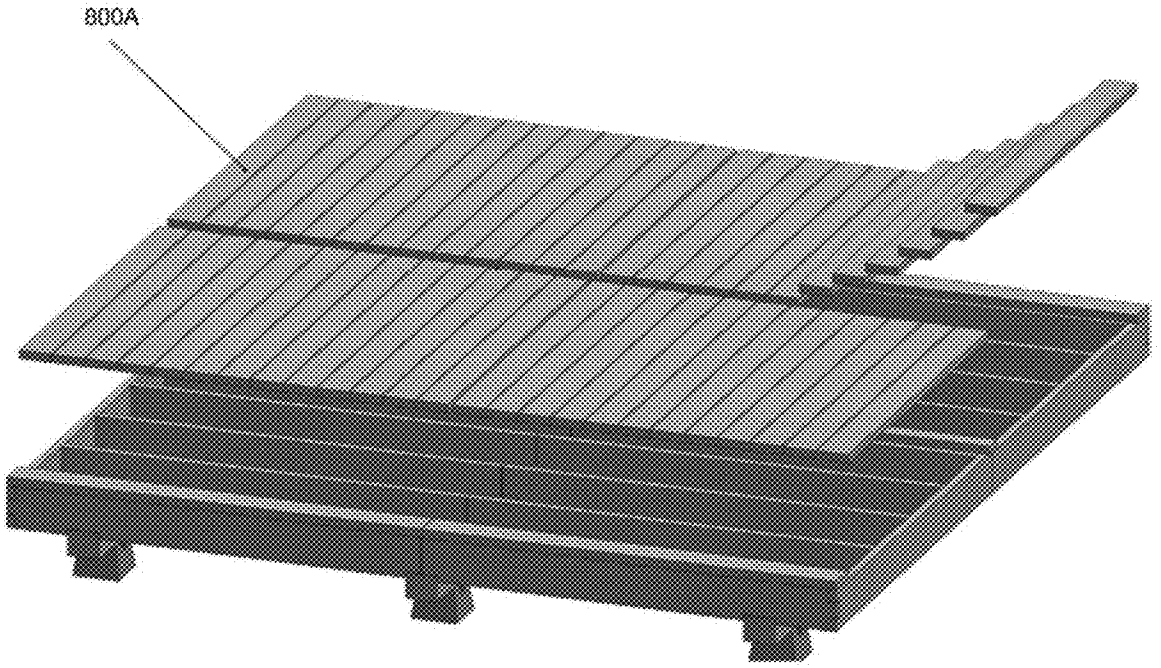
Figure 7:
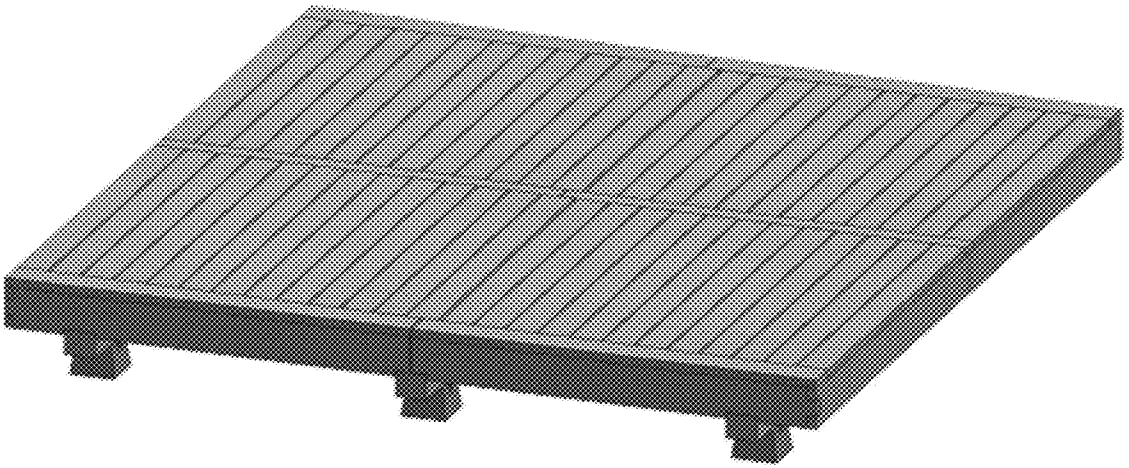

In some instances, the box piece (1200A) may be placed in the cavity formed between the end frame unit (300A) and the split joist (200A) besides it. In this design, the joist box/frame unit (300A) are not formed of two wooden blocks or joists. Instead, the frame unit (300A) is a single piece of wood divided in two or more pieces and placed at the edges of the subfloor system and then split joists (200A) are layered between the two frame units (300A). The joist (200A) placed immediately beside the frame unit (300A) form a cavity which is plugged by the connector block (900A), as shown in FIG. 7A to 7R.

Rim Joists

A rim joist (400) is generally attached perpendicular to the joists (200) and provides lateral support for the ends of the joists (200) while capping off the end or sides of the deck system. Rim joists (400) are standard for every deck and for every subfloor system. The standard installation requires at least 2 people. One person holds the rim joist (400) while the other screws it into every joist (200) to hold them together. This process is then repeated to attach the rim joist (400) on the other side.

The proposed subfloor system is designed for one person installation such that the rim joists (400) fit in perfectly by means of rim support pieces (203), rim support protrusions (209), dowels (403) or male/female brackets (208, 404). The proposed subfloor system is constructed using a minimum of two rim joists (400). The invention proposes the following variants of rim joists (400).

Rim Joist: Version 1 (Pre Notched)

As discussed before, joist (200) versions 1, 2 and 4 comes with either a rim support piece (203) or a rim support protrusion (209). These joists (200) have either half end notches (202) or internal L-shaped notches (206) to allow a small piece/protrusion (209) to stick out on either one or both ends of the joists (200). For instance, the joist (200) has two half notches (202) or one L-shaped notch (206) to provide a 1½ inch piece or protrusion (209) sticking out.

The proposed rim joist (400) is provided with corresponding cavities (401) that match the spacing of the rim support piece (203) or rim support protrusion (209) when the joist (200) is parallelly placed on the beams (100). For instance, if the spacing between the joists (200) is 15½ inches, the spacing between the joist (200) end rim support pieces (203) or protrusions (209) will also be the same. In this example, the proposed subfloor system comes with a rim joist that has corresponding cavities (401) with 15½ inches spacing that would take the rim support pieces (203) or protrusions (209) of the joists (200), thereby providing a seamless connection. This simplifies the construction process significantly, as one doesn't need to hold the long rim joist (400) and align it perfectly with the joist ends while fastening the rim joist (400) to the joists (200). One can simply attach the proposed rim joist (400) to the perpendicular joists (200) using cavities (401) that connect with the corresponding rim support pieces (203) or protrusions (209). Since the rim support pieces (203) or protrusions (209) insert directly in the cavities (401) of the rim joist (400), the rim joist (400) can be placed and aligned perfectly with the joists (200) in no time. The rim joists (400) can be further fastened to the perpendicular joists (200) using any fastening means, such as deck screws, galvanized nails or brackets. Optionally, the ends of the rim joist (400) may have a U-shaped notch (402) towards the ends that fits with the frame units (300) of the picture frame box (300) that are placed on two sides of the subfloor system. In an exemplary embodiment, the U-shaped notch will be 1.5" in depth×2". Meaning, the inside of the U will be 2"×1.5" and the leftover materials outside the U that are un-notched remain 1¾ of an inch. However, this measurement can vary depending on the size of rim support protrusion/piece (209/203).

Figure 4A:
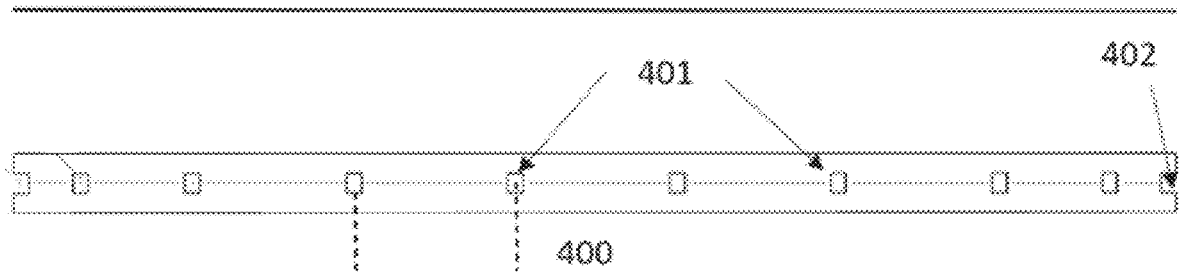
FIG. 4A shows a diagrammatic representation of version 1 of the rim joist.

The proposed variant of rim joists (400) fits with Joist (200) version 1, 2 and 4. The dimensions of the rim joist (400) depends on the number of joists (200) and frame units (300) being used, and the size and dimensions of the beams (100). In an exemplary embodiment, the rim joist (400) can be 117 inches long as shown in FIG. 4A. In the same embodiment, the cavities (401) are 1½ inches each with approximately 15 inches spacing. The U-shaped notches (402) at the end of the rim joists (400) are also 1.5 inches deep. In an embodiment, the cavities (401) or notches (402) can be at the center of the rim joist (400) or provided closer to the surface. For instance, in an embodiment the cavities (401) are centrally placed that fits with the rim support pieces (203) of Joist (200) version 1, 2 and rim support protrusions (209) of Joist (200) version 4. Alternatively, in an embodiment the cavities (401) can be placed closer to the surface that align with the rim support protrusions (209) of Joist (200) version 4.

Rim Joist Version 2 (Semi Notched System)

Figure 4B:
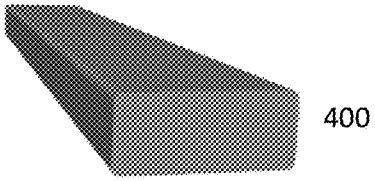
FIG. 4B shows a diagrammatic representation of version 2 of the rim joist.

In this version, the rim joist (400) is equipped with the U-shaped notches, similar to Version 1, however the rim joist (400) does not have any cavities (401). Accordingly, this version of rim joist works well with a joist box (300) that is constructed using joists (200) version 1, version 2 or version 4. However, the joists (202) that sit on the beams (100) are un-notched i.e. joist (200) version 3. The dimensions of the rim joist (400) version 2 would be exactly similar to version 1, minus the central cavities (401), as shown in FIG. 4B. The rim joist (400) is affixed to the joists using any standard affixing means, deck screws for example.

In an embodiment, a standard rim joist (400) i.e. without any cavities (401) or U-shaped notches (402) can also be used to hold the joists (200) in place, as shown in FIG. 4B.

Rim Joist Version 3 (Dowel System)

In this version, the rim joists (400) are equipped with a unique dowel system (403). Dowels (403) are provided at least at both ends of the rim joist (400) with corresponding holes in the frame units (300) of the picture frame box (300) that accepts the dowel pins (403). Additional dowel pins (403) could be provided on the rim joist (400) that with corresponding holes on the joists (200) that are placed in between the frame units (300). In an embodiment, the rim joist (400) comes with multiple dowel pins (403) from one end to the other that fits in the holes/cavities provided in the frame units (300) and joists (200). Once the rim joist (400) is held in place, one can then screw it into every joist (200) to secure it.

Figure 4C:
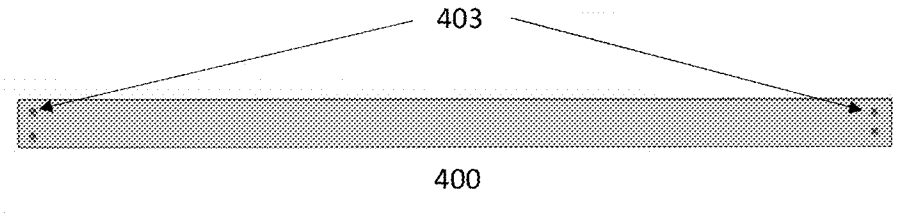
FIG. 4C shows a diagrammatic representation of version 3 of the rim joist.

The dowel pins (403) are strategically placed, for instance, at every corner. In an exemplary embodiment, as shown in FIG. 4C, the measurement can be approximately 1" from the top and side of the edge of the rim joist (400) board. Standard dowel pins (403) that are ½"×2" long can be used. In an embodiment dowel pins (403) can be provided for every joist (200) and every frame unit (300) for additional stability. This version of the rim joist (400) also makes the construction process easier, as one cane simply fit the dowel pins (403) into the corresponding holes/cavities on the joist (200) and frame units (300). Multiple variants of dowel pins (403) can be used. This version of rim joists (400) can be used with joist (200) version 3.

Rim Joist Version 4: Male/Female Brackets

In this version, the rim joists (400) are provided with female brackets (404), e.g. metal brackets, which receive the corresponding male bracket (208) provided on the joist end (205) e.g. joist (200) version 3. For instance, at least two female brackets (404) could be provided on the rim joist (400) that aligns perfectly or receives the corresponding male brackets (208) provided on the frame units (300). In some cases, the rim joists (400) can be provided with multiple female brackets (404) that receive male brackets (208) provided on the frame units (300) and the joists (200). This again provides seamless connection and avoids the need to hold the rim joist (400) while it's being fastened to the joists (200) and picture frame box (300). One can simply match the brackets (208, 404) to hold the rim joist (400) in place and then it can be fastened to the joists (200). An exemplary embodiment is shown in FIG. 4D.

A few non-limiting examples of the pre-notched beams (100), joists (200, joist box (300), and rim joists (400) are provided below.

| Deck sizes | Beam | Joist/joist box | Rim joist |
|---|---|---|---|
| 10' × 10'<br>12' × 12'<br>16' × 16' | 6" × 6"<br>6" × 8"<br>6" × 10"<br>4" × 8"<br>4" × 6"<br>6" × 10"<br>6" × 12" | 2" × 6"<br>2" × 8"<br>2" × 10"<br>2" × 12" | 2" × 6"<br>2" × 8"<br>2" × 10"<br>2" × 12" |

A few non-limiting examples of the sizing of pre-notched beams, beam notches pre-notched joists, surface notches, rim joist, brackets and materials that can be used are provided in the table below.

| Subfloor Size | Beam | Beam notches | Joist | Surface Notch | Rim Joist | L metal brackets | Examples of materials |
|---|---|---|---|---|---|---|---|
| 10' × 10' | 6" × 6"<br>6" × 8" | ¼"-½"-<br>¾"-1" | 2" × 6"<br>lumber<br>2" × 8"<br>lumber | ¼"-½"-<br>¾"-1'-<br>1½"-1¾"-<br>1⅓'-2"' | 2" × 6"<br>2" × 8" | 1.5" × 1.5"<br>3" × 3"<br>4" × 4"<br>6" × 6" | Pressure<br>treated<br>Cedar<br>Composite<br>Pine<br>Douglas fur<br>Hemlock<br>IPE<br>Spruce |
| 12' × 12' | 6" × 6"<br>6" × 8" | ¼"-½"-<br>¾"-1'-<br>1½"-1¾"' | 2" × 6"<br>lumber<br>2" × 8"<br>lumber<br>2" × 10"<br>lumber | ¼"-½"-<br>¾"-1'-<br>1½"-1¾"-<br>1⅓'-2"' | 2" × 6"<br>2" × 8"<br>2" × 10" | 1.5" × 1.5"<br>3" × 3"<br>4" × 4"<br>6" × 6" | Pressure<br>treated<br>Cedar<br>Composite<br>Pine<br>Douglas fur<br>Hemlock<br>IPE<br>Spruce |
| 16' × 16' | 6" × 6"<br>6" × 8"<br>8" × 8" | ¼"-½"-<br>¾"-1'-<br>1½"-1¾"-<br>1⅓'-2"' | 2" × 6"<br>lumber<br>2" × 8"<br>lumber<br>2" × 10"<br>lumber | ¼"-½"-<br>¾"-1'-<br>1½"-1¾"-<br>1⅓'-2"' | 2" × 6"<br>2" × 8"<br>2" × 10" | 1.5" × 1.5"<br>3" × 3"<br>4" × 4"<br>6" × 6" | Pressure<br>treated<br>Cedar<br>Composite<br>Pine<br>Douglas fur<br>Hemlock<br>IPE<br>Spruce |

A few non-limiting examples of joist (200) and rim joist (300) spacing are provided below.

| Deck sizes | Joist/Rim joist spacing |
|---|---|
| 10' × 10' | 10"-12"-14⅞"-16" |
| 12' × 12' | 10"-12"-14⅞"-16" |
| 16' × 16' | 10"-12"-14⅞"-16" |

In some cases, the pre-notched rim joists may be divided in two or more pieces (400A). For instance, the pre-notched rim joists (400A) may be provided in two equal halves or three or more equal or unequal pieces. The pieces when put together would form one complete pre-notched rim joist (400A). The split pre-notched rim joists (400A) may be provided with additional notches or an extended notch such that the two notches when put together make a complete rectangular notch. The split rim joist design may be provided in any of the versions described above.

Picture Frame & Deck Boards

The proposed subfloor system may optionally be used to construct an outdoor deck, a stage or any raised platform. When being used for a deck, the proposed subfloor system can be covered by four pieces of deck frame boards (700) that may optionally be cut at a 45-degree angle on each end. This allows creating a perfectly square deck framing. The deck frame board dimensions can vary significantly depending on the size of the deck being built. In an embodiment, the thickness and width of the deck frame boards (700) can be such that it forms an overhang on all four sides of the subfloor system. E.g. a 1 foot-5 feet overhang on all four sides of the deck.

In between the frame deck boards (700), regular deck boards (800) can be layered besides each other with the deck frame boards (700) forming a square boundary around the regular deck boards (800). The deck board pieces can be fastened to the subfloor system, e.g. the joists (200), picture frame units (300), or beams (100) by means of any known fasteners, e.g. deck screws.

Forming a square frame is optional and only adds aesthetic appeal to the overall deck. In other embodiments, the floor of the deck can only be built using regular deck boards (800) and the frame deck boards (700) can be completely avoided. If a square frame is being built, one can use frame deck boards (700) cut at an angle ranging from 30°-60° to achieve high end results. Once the square framing is screwed, the remaining on the deck boards (800) that are already pre-drilled to match the location of the joists (200) under them are placed on the deck frame inside the picture frame and screwed into the joists (200) to secure them. For instance, every deck board can be fastened using at least two or more deck screws into the joists (200).

Optionally, the surface of the picture frame box (300) i.e. surface of the frame units (300) are covered by the frame deck board's overhang. The frame deck boards (700), or the regular decking boards (800) surpasses the frame of the deck by ½ feet to 5 feet.

The number and dimensions of deck boards (800) or frame boards (700) would depend on the size of the subfloor system and the overall deck size. For instance, for a 10 feet×10 feet deck, 20 deck boards (800) may be required that are approximately 110 inches long. Some non-exhaustive examples of number and sizing of deck board and frame board are provided in the table below.

In some cases, the frame boards (700A) and deck boards (800A) may be divided in two or more pieces. For instance, the frame boards (700A) and deck boards (800A) may be provided in two equal halves or three or more equal or unequal pieces. The pieces when put together would form one complete frame board (700A) or one complete deck board (800A).

The proposed subfloor system primarily consists of beams (100), joists (200) and rim joists (400). Optionally, the subfloor system may additionally include footings (500), posts and frame units (300) for picture frame box (300). The overhang is created by deck boards (700, 800) that surpasses the subfloor boundaries. The frame units (300) on two sides of the picture frame box (300) i.e. the side that runs parallel with the joists (200), provides a wider surface for the frame deck boards (700) to rest and be screwed on. If regular joists (200) are used at the end i.e. without the frame units/picture frame box (300), one might have to complete the deck using regular deck boards (800) instead of creating a square frame with angular frame boards (700) as there would be little to no support, and the angular framing deck board might not hold well. However, on the remaining two sides of the subfloor system i.e. the side that is perpendicular to the joist (200) direction, the deck boards (800) will be placed perpendicular to the joists (200), and they will have room to rest and overhang with stability.

The proposed split subfloor system primarily consists of split beams (100A), split joists (200A) and split rim joists (400A). Optionally, the subfloor system may additionally include footings (500), posts and split frame units (300A). The overhang may be created by deck boards (700A, 800A) that surpasses the subfloor boundaries. The split frame units (300A) on two sides of the picture frame box (300) i.e. the side that runs parallel with the split joists (200A), may be provided with box pieces (1200A). The split beams may be connected by a connector block (900A) and the footings may additionally have a filler block (1100A). The split frame boards (700A) are placed on the split joist box (300A) at the edges, whereas a deck divider (1000A) is placed instead of frame boards (700A) on the central joist box (300A). The deck boards (800A) are placed on either side of the deck divider (100A) and in between the two frame boards (700A).

Traditional deck construction process is generally summarized below:

a. A carpenter would go to a lumber store such as Home Depot, or any home improvement store and pick up the required amount of lumber, concrete blocks, any other type or footings, deck block, and other hardware needed for framing, finishing, and fastening all the pieces together. All of these require thorough calculations.
b. Once all the materials are on site, manual calculation begin to determine the exact location of the footings as one needs to ensure that the footings are at least one inch inside the frame.
c. Once the footings are located, concrete footings are dug and cemented, or alternatively deck block is placed.
d. If posts are used, each post is cut and placed in the deck block or metal bracket. The posts need to be cut at a precise height to ensure that once the beam is placed on top of the deck blocks and the joists on top of the beams, the elevation has to be leveled to the rim joist on the house to ensure that the deck surface is leveled.
e. The next step is to install the rim joist on the house or over the beam location close to the house if it's freestanding. If it's not freestanding, joist hangers need to be installed on the joist every 16" on center.
f. Once the beam is built using two- or three-layers lumber (depending on structure size and height of the deck), the 3 layers that make the beam are nailed or screwed together on an angle for ultimate connection.
g. Once the beam is ready, it is placed on top of the posts that were cut and placed in the footing. The beam is moved left to right while measuring diagonally from the opposite rim joist corner. The measurements both ways need to be exactly the same.
h. Once squared, the beam is mounted to the posts using brackets and nails.
i. In the next step, joists are placed on both beams if it's freestanding. If it's not freestanding, one places the joists into the joist hangers located on the rim joist and let the joist rest on the beam away from the house.

j. Once all the joists are placed on the platform at 16" on center, begin nailing the sides of the joists into the joist hangers.

k. One needs to ensure that the joists have the right spacing before one begins to mount rim joist on joist ends to close the frame. In that step, a piece of wood identical to the joist is placed on the outside and several nails are driven into it through the joists.

l. The subfloor is measured again from corner to corner to ensure its perfectly square. Sometimes it takes a lot of back and forth to ensure that the measurements and alignment is accurate.

m. Once squared, nails are then driven into the joists through the beams from both sides and this step is repeated for all joists or fasten joist to beam using joists brackets.

n. The next step is to cut scrap materials and place it in between the first 2 joists on the left and right side to create a base for the picture frame boards.

o. Once blocking is made, begin measuring and cutting picture frame boards (make sure to measure and include your overhand)

p. Once picture frame boards are cut, they are screwed with 3" decking screws (coated)

q. The next step is to measure the area from side to side and corner to corner to ensure its still square.

r. Now begin to measure the distance across and start cutting deck boards to length.

s. Once all the boards are cut, place them on the frame and drive 2 screws into every joist.

t. Your last deck board most likely will need to be ripped into a slimmer piece to fit the odd opening at the end. This can be avoided if extensive measurements are made prior to deck construction. 90% of deck builders end up ripping the last piece slimmer.

Method of Construction: Proposed Subfloor System

In contrast, the construction steps required for the proposed subfloor system. One doesn't need to have any complex set of tools and even a DIY'er can fully install the subfloor system with 45 minutes to 1 hour (compared to 12-16 hours if the subfloor is built traditionally). Moreover, a complete deck can be built by a DIY'er using the proposed subfloor system, in about 3-6 hours, compared to 4-6 days if the deck is built traditionally.

Another significant advantage of the proposed subfloor system is that the system is portable. This means that the deck can be taken apart easily and ported to a new location e.g. when a person moves to a different house, that person can either leave behind the deck or just dismantle it quickly and port it to his/her new house. Since, all the components of the subfloor system i.e. the footings (500), pre-notched beams (100), pre-notched joists (200), frame units (picture frame box (300)), and rim joists (400) fit like a puzzle, without any complex engineering, they can b easily dismantled, and the entire subfloor can be ported to a different location if needed.

Figure 5A:
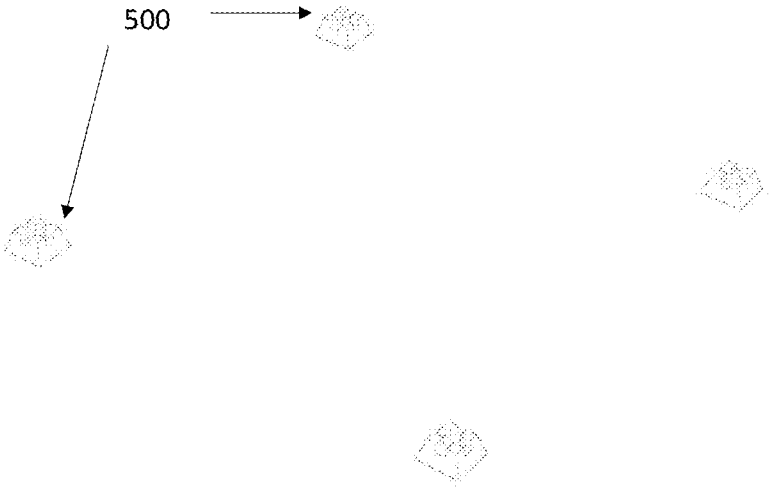
FIG. 5A shows an exemplary placement or arrangement of footings.
Figure 5B:
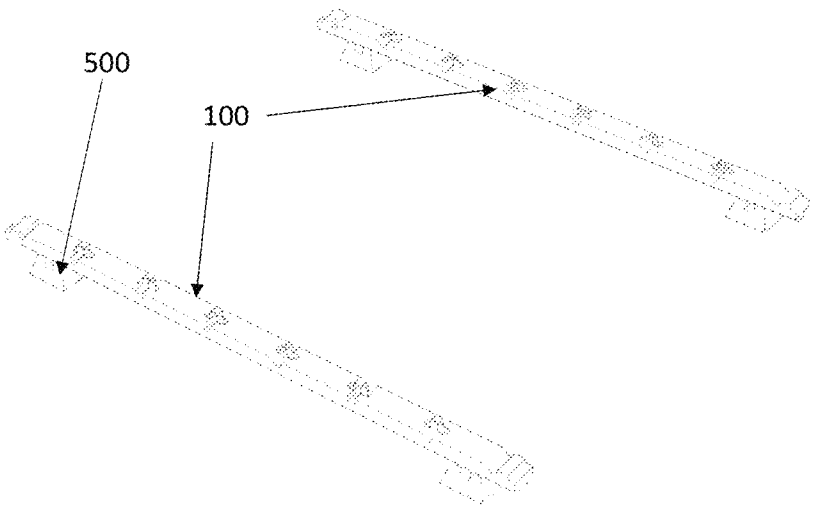
FIG. 5B shows an exemplary placement of the pre-notched beams on the footings.
Figure 5C:
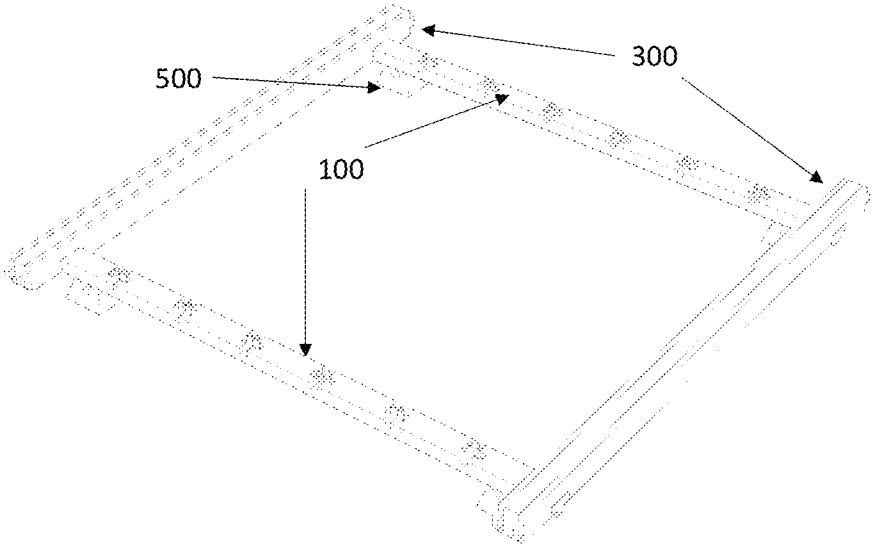
FIG. 5C shows an exemplary placement of the joist box or the frame units on the pre-notched beams.
Figure 5D:
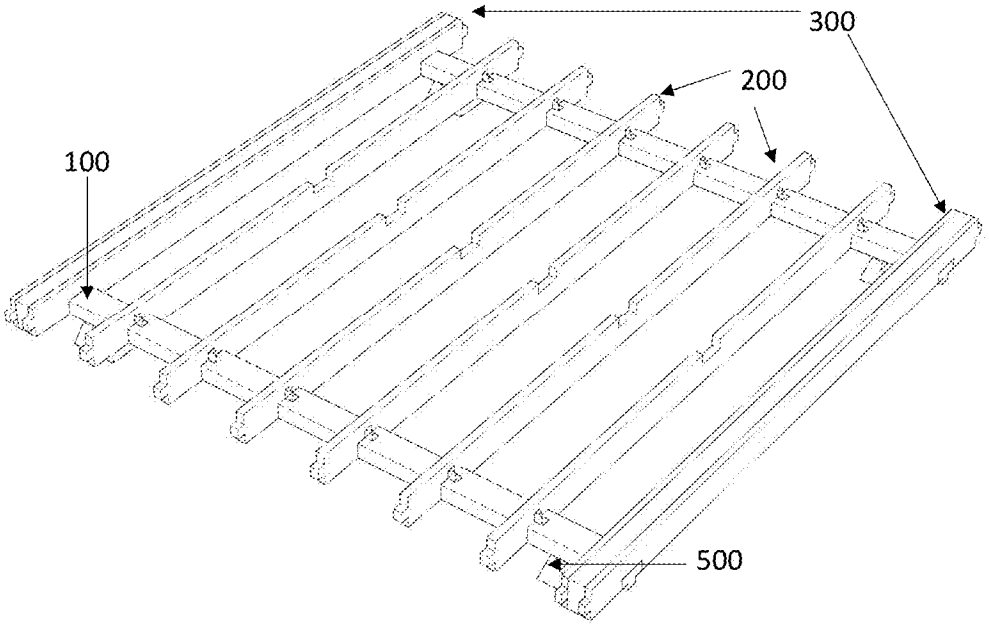
FIG. 5D shows an exemplary placement of the pre-notched joists on the pre-notched beams.
Figure 5E:
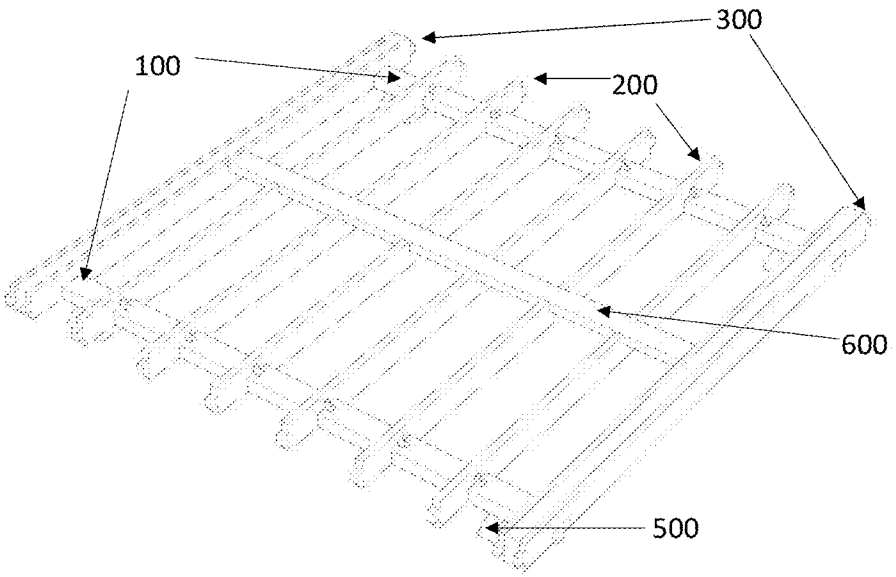
FIG. 5E shows an exemplary placement of the deck blocking piece on the central notches of the pre-notched joists.
Figure 5F:
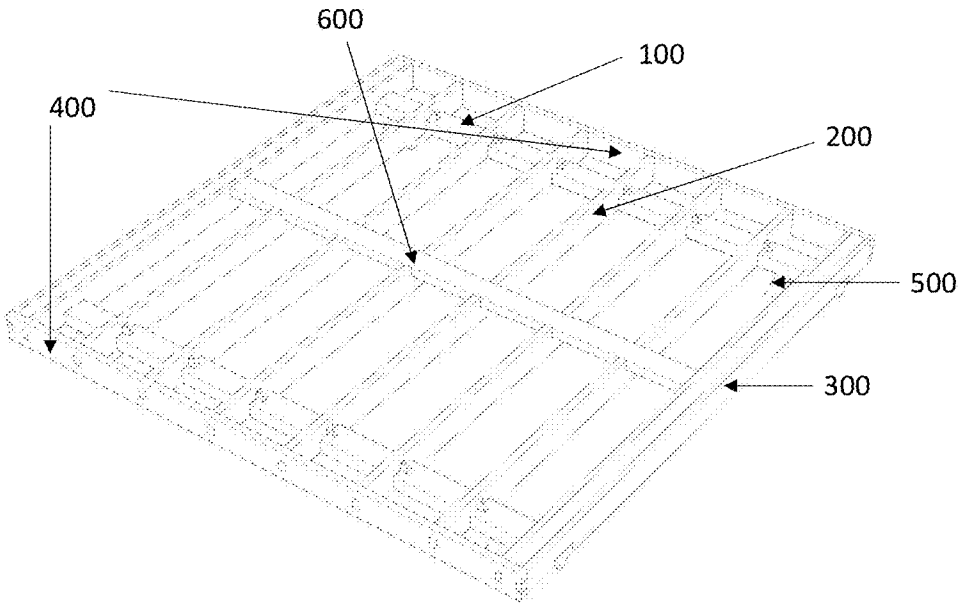
FIG. 5F shows an exemplary placement of the rim joists on the frame units and pre-notched joists.
Figure 5G:
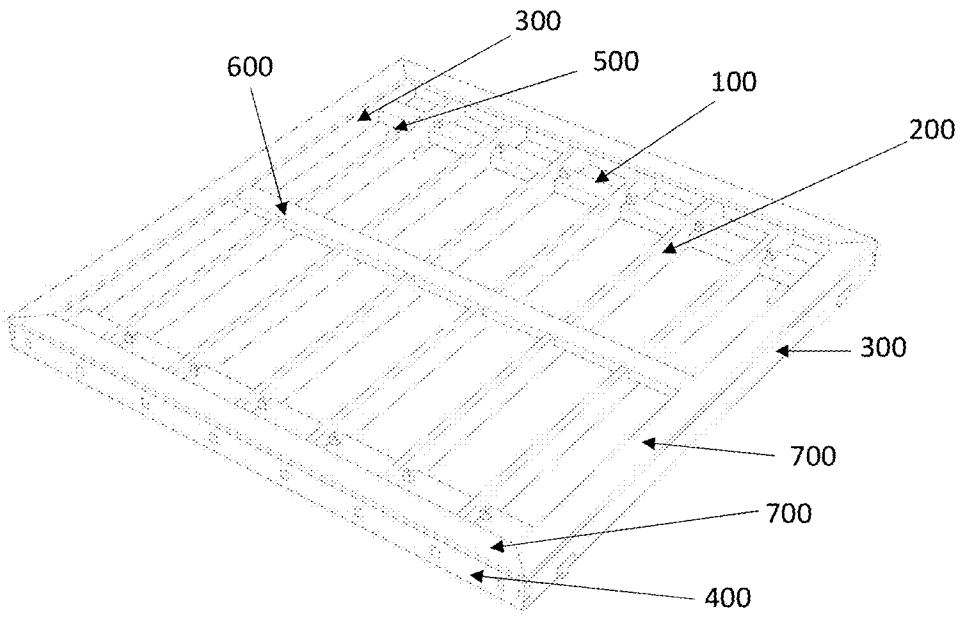
FIG. 5G shows an exemplary placement of deck framing boards or deck frame unit on the subfloor system.
Figure 5H:
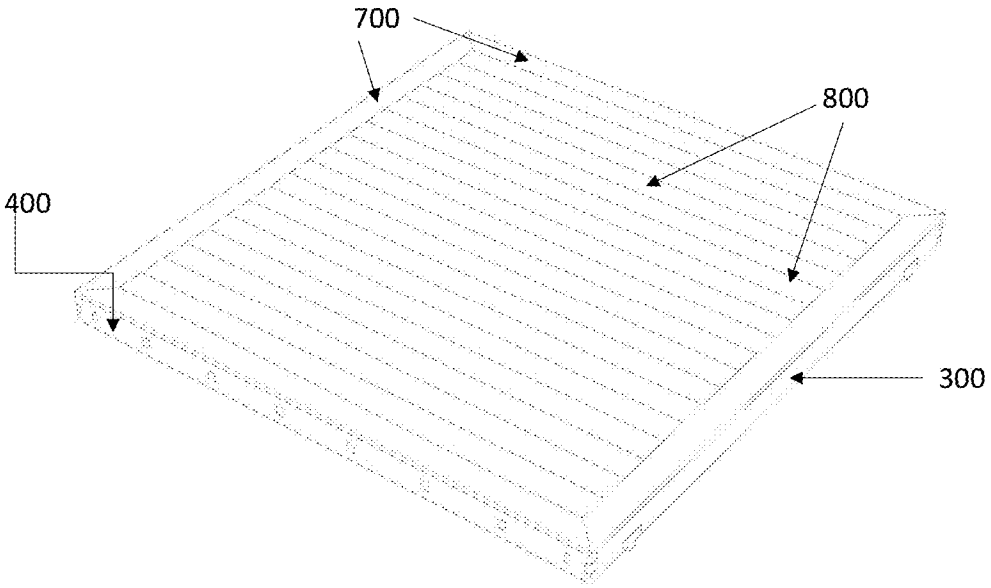
FIG. 5H shows an exemplary placement of the deck boards on the subfloor system.

As an example, the proposed subfloor system can be built as noted below. One skilled in the art would understand that one or more steps might be optional depending on the type and sizing of deck being built. In an exemplary embodiment, the subfloor system is constructed by following the steps noted below.

a. Footings (500) e.g. concrete deck blocks or concrete pored blocks, are placed on the ground in a square format, as shown in FIG. 5A.

b. At least two beams (100) are inserted in the footings (500), thereby creating parallel beams (100), as shown in FIG. 5B.

c. The pre-notched frame units (300) of the joist box (300)/picture frame box (300) are then placed on the beams (100). One frame unit (300) is placed on each end, as shown in FIG. 5C.

d. This is followed by placement of all the regular notched joists (200). While inserting the notched joists (200) into the notched beam (100), one doesn't need to run any calculations, as the correct distance/spacing between the beams (100) forms itself. One doesn't need to worry about deck squaring as pre-notched joists (200) and pre-notched beams (100) fit perfectly to form a square deck. This allows even a DIY'er to build a deck quickly as one doesn't require any special tools or skillset to build the proposed subfloor system, which is the most difficult aspect of constructing a deck. The notched joists (200) sit inside the grooves/notches (101, 102) on the beam (100), forcing their direction to be perpendicular to the beam (100), thereby creating a square subfloor by default, as shown in FIG. 5D.

e. Once the beams (100), frame units (300) and joists (200) are in place, one can place rim joists (400), one for each end of the joists (200). The rim joist (400) is inserted into the joist ends (205) either by means of rim support pieces (203)/protrusion (209) on the joists (200) and corresponding cavities (401) on the rim joists (400), or by means of male/female brackets (208, 404), or by means of dowel pin alignment (403), or any other fastening mechanism known in the art. Once the rim joist (400) is attached to the joists (200), the connection is further strengthened by means of additional fasteners e.g. deck screws to screw the rim joist (400) fully on the joist ends (205). This step is shown in FIG. 5F.

f. This completes the construction of the proposed subfloor system. Once the subfloor system is built, it can be used to build a deck or a stage or any raised platform.

g. Optionally, if the joists (200) have a central notch (203) on its surface, the subfloor system may additionally include a deck blocking piece (600) which fits perfectly in the series of central notches (203) on the joist (200) surfaces. This is shown in FIG. 5E.

h. Once all the frame parts are connected by notches (101, 102, 201, 202, 203, 206), one can begin fastening the joists (200) to the bracket pair (104) mounted on the beams (100) by means of any fastener, e.g. deck screws.

i. Optionally, if one is constructing a deck, they can place the frame boards (700) which my optionally be cut at an angle e.g. 45-degree angle, to create a framing design. Alternatively, one can use regular deck boards (800) to frame around the deck. If angular frame boards (700) are used, it may create an overhang, i.e. the frame boards (700) may stick outside the subfloor by a few inches on each side of the deck. The frame boards (700) or regular deck boards (800) are then fastened into the subfloor units. E.g. fastened on the frame units (300) of joist box (300) and the notched joists (200). In an exemplary embodiment, the frame boards (700) are manually placed on the subfloor to create a 1½ feet overhang on each side. Once the frame boards (700) are fastened it creates a seamless seam on all sides of the deck floor. This step is shown in FIG. 5G.

j. Then, the rest of the deck boards (800) are paced on the subfloor within the frame board boundary, or regular deck board boundary. Each deck board is ten fastened onto the subfloor e.g. on the joists (200) by means of any known fastener. E.g. deck screws. This step is shown in FIG. 5H.

Split Subfloor System

An alternative split subfloor system is also envisioned by the inventors. The split subfloor system may comprise a plurality of footings (500) depending on the size of the deck. The beams (100A), joists (200A), picture frame/joist box (300A), rim joists (400A), frame boards (700A) and the deck boards (800A) are spilt in equal parts (i.e. halves, thirds, quarters, and so on) or unequal parts (custom lengths). For instance, an 8' deck may have two split beams (100A) of equal sizing i.e. each beam is 4' in length, and together they form a full beam of 8'. However, in a 10' deck, the beam (100A) may be split into three unequal parts i.e. two beams (100A) of 4' and one beam (100A) of 2'. Additionally, the split subfloor system may comprise connector blocks (900A), brackets, deck divider (1000A) to connect the split pieces together. For instance, the equal or unequal parts of a split beam (100A) can be connected by means of connector blocks (900A), whereas the deck divider (1000A) allows to divide the deck in two or three parts and adds further robustness to the split subfloor design.

It is pertinent to note that the split beam (100A) is similarly constructed as a regular beam (100) described above, however, the beam (100A) may have additional notches on its surface, or a full notch one side and a half notch on the other side such that the half notches of two split beams (100A) when put together makes a full notch, The sizes of the split beams (100A) are generally smaller than the beams (100) described earlier. Similarly, other components described above such as split joists (200A), split joist box (300A), split rim joists (400A), and split deck boards (800A) and frame boards (700A) are constructed similarly as their counterparts described above however with additional notches on their surface, with a full notch on one side and a half notch on the other and are generally smaller in size.

The split design is advantageous especially when long decks are to be built. The pieces can be easily transported from one place to another especially when 12' or longer decks are to be built. The additional pieces such as filler blocks (1100A), deck dividers (1000A) and connector blocks (900A) further strengthen the deck and increases its longevity. The pieces can be easily bundled, pelleted and shipped which not only reduces cost but also reduces the chances of damage during transportation.

Figure 6A:
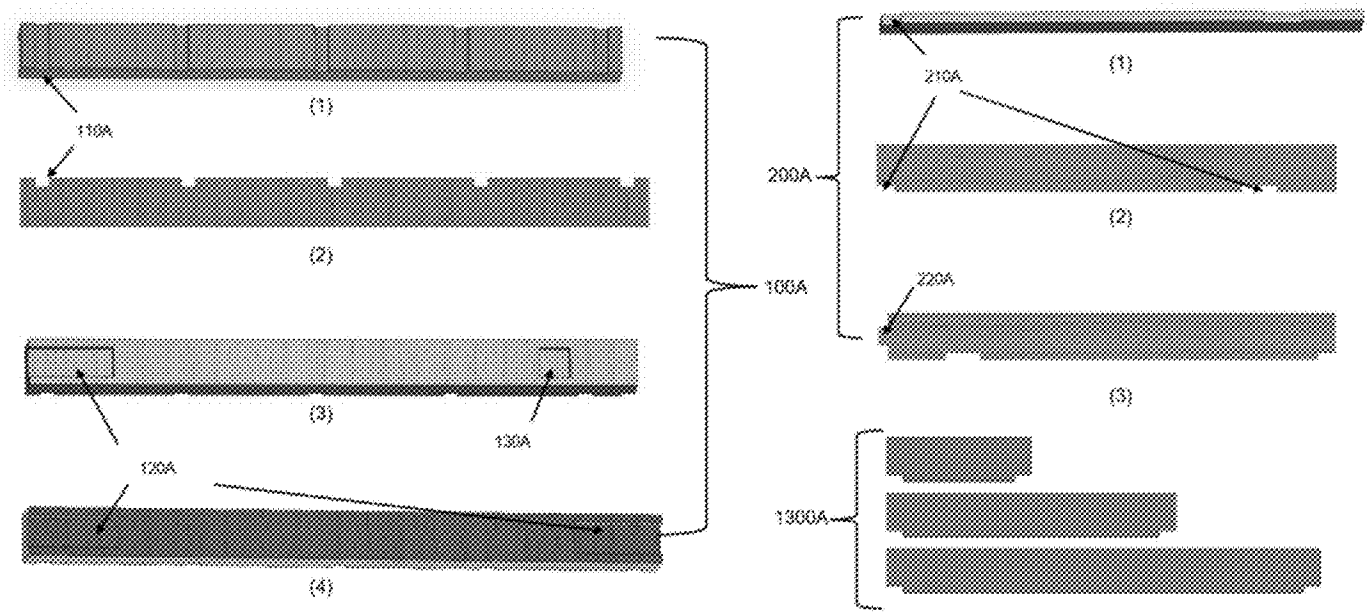
FIGS. 6A and 6B shows the various components of the split subfloor system.
Figure 6B:
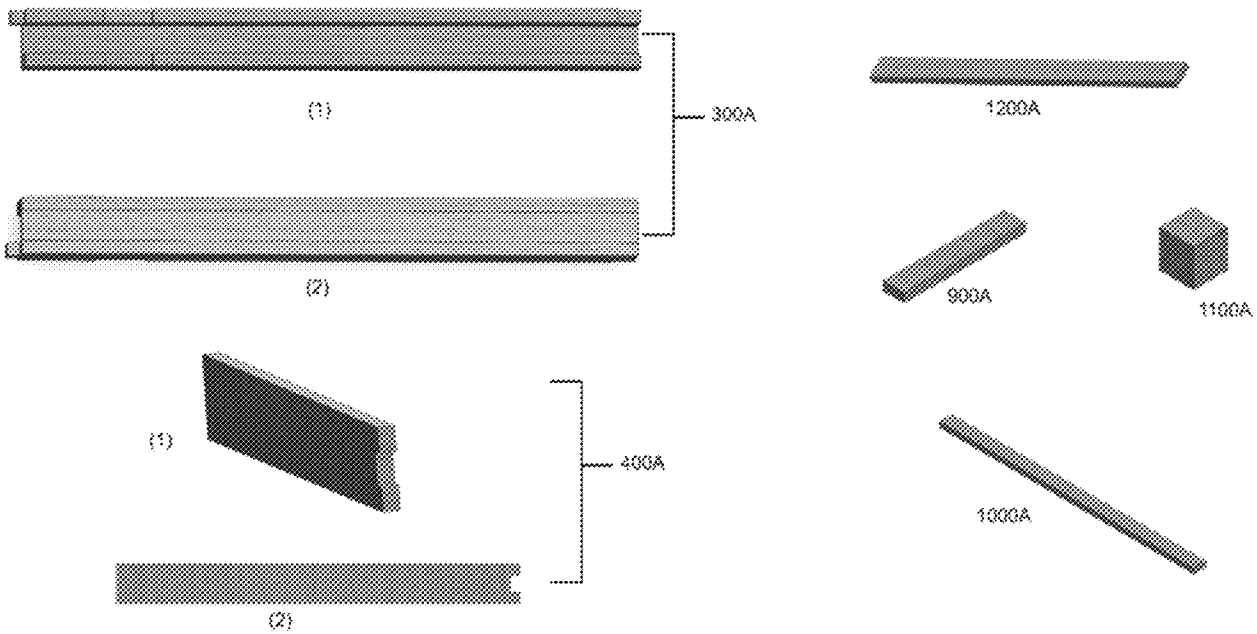

FIGS. 6A and 6B shows the various components of the split subfloor system. FIG. 6A 100A shows the various views of the split beam (100A). Specifically, 100A (1) shows the top view of the split beam (100A), 100A (2) shows the side view of the split beam (100A), and 100A(3) and 100A(4) shows the different bottom views of the split beam (100A). The surface notches (110A) of the split beam (100A) can be seen in 100A(1) and (2). The bottom notches may change depending on whether the split beam (100A) is being placed at the edges (of a 2-part or 3-part beam) or being used as a centre beam (for instance the centre beam piece in a 3-part split beam). The split beam (100A) may have one block notch (130A) and one half-connector notch (120A) if it's being used at the edges. Otherwise, the split beam has two half-connector notches (120A) if it's used as a centre beam, as shown in 100A(3) and (4).

FIG. 6A 200A shows the various views of the split joist (200A). Specifically, 200A(1) shows the bottom view of the split joist (200A). 200A (2) and (3) shows the side views of the joist (200A). The surface notches (210A) of the split beam (200A) can be seen in the figures. The surface notch (210A) may be a full notch or a half-notch depending on where it's placed. The rim support piece (220A) is shown in 200A (3). The rim support piece (220A) has the same function as the rim support piece noted above. FIG. 6A 1300A shows an exemplary version of the joist extension/connector piece (1300A).

FIG. 6B 300A shows the top and bottom views of the joist box or split frame unit (300A). The split joist box has a similar structure as the joist box (300) described earlier except that it's split in two or more pieces. The split frame units may have a rim support piece similar to the split joist (200A). FIG. 6B, also provides representative views of the split rim joist (400A), the connector block (900A), the filler block (1100A), the box piece (1200A) and the divider piece (1000A).

As an illustration, a split deck design will now be described. Depending on the size of the deck, several footings (500) are arranged in equidistant rows and columns. For instance, for a 12'×12' deck, nine footings (500) are arranged in three equidistant rows. Once the footings (500) are in place, a filler block (1100A) is placed or wedged in the central cavity of each footing (500). The filler block (1100A) fills the cavity of the footing (500) and allows the connector blocks (900A) to rest on its surface. The filler blocks (1100A) protrude slightly outside the footing cavity.

Once the filler blocks (1100A) are in place, a connector block (900A) is placed on each footing of the centre row. In case of a 12'×12' deck, with three rows of footings, a connector block (900A) is placed on three footings of the central row. However, in a 16'×16' deck, there may be four rows of footings (500), and a connector block (900A) may be placed on the $2^{nd}$ and the $3^{rd}$ rows. Once the connector blocks (900A) are in place, the split beams (100A) are placed in an orderly fashion. It is pertinent to note that each split beam (100A) is pre-notched. In a 12'×12' design, probably two split beams (100A) of 6' feet may be placed on the connector blocks to form a complete beam. The connector blocks (900A) lock the two beams (100A) in place to form one complete beam that spans the length of the subfloor system. In a 16'×16' deck, there could be three separate beam pieces of 6', 6' and 4', or four equal pieces of 4' each. In any event, the connector block (900A) allows the beam pieces to be held together in place on the footings (500). Deck screws may be used to further secure the connector block (900A) to the beams (100A). The dimensions of the connector blocks (900A) could vary depending on the size of the deck, however, in general the dimensions can be 3.5"×1.5"×20". The dimensions of the filler block (1100A) are generally 3.75"×3.50"×length/depth of the cavity.

Once the beams (100A) are in place, the split frame units or the joist box (300A) are placed such that the notches of the split frame units/joist box (300A) fit perfectly in the notches of the beams (100A). It is pertinent to note that the joist box (300A) is also split in two halves and the halves may be further secured by means of brackets or screws. Each half of the joist box (300A) sits on the beam (100A) and connects on the middle beam. Each half of the joist box (300A) has a full notch on one side and half notch on the other. The half notches of the halves/parts of the joist box connect in the centre to form a full notch. In some case, there would be a joist box (300A) on each side, placed perpendicular to the beams. In some cases, a joist box (300A) may be placed on each side as well as in the centre. Accordingly, in a 12'×12' deck, there could be three joist boxes (300A), one on each side and one in the centre.

Once the split joist box (300A) and the split beams (100A) are in place, the subfloor structure is then layered with split joist pieces (200A). The joists (200A) are placed parallel to the joist box (300A) and perpendicular to the beams (100A). Similar to the joist box (300A), the joist pieces (200A) are placed on the beam with their respective notches aligning perfectly. The halves or parts of the joist (200A) may be further secured by means of brackets or screws. Each half/piece of the joist (200A) sits on the beams (100A) and connects on the middle beam. Each half of the joist (200A) has a full notch on one side and half notch on the other. The half notches of the halves of the joists (200A) and the joist box (300A) connect in the centre to form a full notch.

In some cases, an additional joist extension piece (1300A) is provided, see FIG. 6A. The joist extension piece (1300A) sits on the beam in between the split joist (200A) or the split joist box (300A) that extends the length of the joist and the overall dimensions of the deck. The joist extension piece (1300A) has a half notch on each side and is generally placed where the half notches of the split joist (300A) meet. The arrangement is generally two split joist pieces connected by a joist extension piece. The half notch of the split joist (300A) connects with the first half notch of the joist extension piece (1300A) form a full complete notch. The half notch of a second split joist (300A) connects with the second half notch of the joist extension piece (1300A) to form a complete notch. That way, the length of the joist (300A) can be extended by using an appropriate length of joist extension piece (1300A).

For instance, in a 12'×12' deck a first half of the joist (200A) or joist box (300A) sits on the $1^{st}$ and $2^{nd}$ beam, and a second half sits on the $2^{nd}$ and $3^{rd}$ beam, and the two halves connect on the middle ($2^{nd}$ beam).

The subfloor system further comprises split rim joists (400A). Similar to the joists (200A), the rim joists (400A) are split in parts. The rim joists (400A) sit perpendicular to the joists (200A)/joist box (300A) and seals the sides of the joists (200A)/joist box (300A). The parts of the rim joist (400A) may be connected by means of brackets or screws.

Next the split picture frame boards (700A) are layered at the edge of the deck and filled with split deck boards (800A) throughout the remainder of the deck. The split frame boards (700A) sit perfectly on the split joist box (300A) and if there's a joist box (300A) in the middle of the deck, an additional picture frame board (700A) is placed on top of the middle joist box. The two halves or parts of the spilt frame boards (700A) meet in the centre of the joist box (300A) and are connected by means of brackets or screws. The split deck boards (800A) are then layered between the picture frame boards (700A) and perpendicular to the frame boards (700A). The split deck boards (800A) sit perfectly between two split picture boards (700A) and are secured by means of brackets or screws.

In some instances, the split joist box (300A) is first layered with a box piece (1200A) that sits perfectly in the groove on the surface of the joist box (300A). The box piece (1200A) plugs or fills the cavity of the joist box (300A). Once the joist boxes (300A) are plugged, the split picture frame boards (700A) are placed on the edges of the deck on the plugged joist box (300A) and a deck divider (1000A) is placed on the middle/central joist box (300A). The divider piece (1000A) is thinner compared to the picture boards. In this design, the joist boxes (300A) are first plugged with a box piece (1200A) and then layered with the split picture frame boards (700A) at the edges and the deck divider (1000A) in the centre. The deck boards (800A) are then layered between the split picture boards (700A) and the divider piece (1000A) in the centre. These components can be further secured by means of brackets or screws.

The length of the box piece (1200A) depends on the length of the joist box (300A). However, in general the dimensions can be 1.25"×3.50"×length of the joist box. The dimensions of the divider piece (1000A) are similar to the deck boards (800A) except that its width is slightly less, for instance, 3"-4", preferably 3.5".

FIG. 7A to 7R provides a detailed overview of the manufacture of a split subfloor and split deck system. FIG. 7(A) shows placement of the footings (500) and the filler blocks (1100A). FIG. 7(B) shows the placement of the connector blocks (900A). FIGS. 7(C) and 7(D) shows the placement of the split pre-notched beams (100A) on the footings (500). As shown in the figure, two split beam pieces connect at the connector block (900A). The underside/bottom of the split beam (100A) has a block notch (130A) and a half-connector notch (120A) as shown in FIG. 6A. Two half-connector notches (120A) make a full connector notch that receives the connector block (900A).

FIGS. 7(E) and 7(F) shows the placement of the split frame units or the split joist box (300A). FIGS. 7(G) and 7(H) shows the placement of the split joists (200A). FIGS. 7(I) and (J) shows the placement of the split rim joists (400A). FIGS. 7(K) and 7(L) shows the placement of box pieces (1200A). FIGS. 7(M) and 7(N) shows the placement of the frame boards (700A). FIGS. 7(O) and 7(P) shows the placement of a divider piece (1000A). FIGS. 7(Q) and 7(R) shows the placement of the deck boards (800A) in between the divider piece (1000A) and the frame boards (700A).

The sizing of each component of the split subfloor system, would be similar to the subfloor system described above, except that the length of the components may vary. For instance, the length of each split beam (100A) in a 12'×12' deck could be 6"×6"×6" or 6"×6"×4" instead of 6"×6"×12" for a beam (100) of the regular subfloor system.

It is pertinent to note that any sizing of the deck can be replicated in a similar manner. This design allows customization of the components without comprising on quality or robustness of the completed deck. Since the components are divided in halves or multiple parts, it's even easier to square the deck or move the deck from one location to another. The parts of the deck can be pelleted and ported to wherever the deck is being built.

In conclusion, the proposed subfloor system incorporates several innovative features that streamlines the subfloor installation process without compromising on subfloor/deck quality. In fact, each component of the proposed subfloor system is designed carefully for professional-quality results.

Firstly, the pre-notched beam (100) is designed to seamlessly fit into the concrete foundation i.e. footings (500) thus facilitating quick and accurate assembly. Secondly, the notched Joists (200) are precisely notched (201) on both sides to accommodate the beams (100), thereby ensuring proper alignment and support. In some cases, each beam (100) is equipped with metal brackets (104) already connected to the beam (100) to secure the joists (200) by minimal fastening means e.g. two screws for secure fastening, or galvanized nails or brackets.

The rim support pieces (203), rim support protrusions (209), male/female bracket arrangement, or dowel pin (403) alignment provides precise alignment and facilitates attachment of the final board that secures all the joists (200) together, thereby forming a sturdy subfloor frame.

Optionally, if the subfloor system is being employed to build a deck, the deck boards (800) and frame boards (700) can be pre-drilled, thereby enabling easy installation and ensuring consistent spacing and alignment.

The DIY deck system revolutionizes the process of deck construction by introducing innovative design elements and streamlined assembly techniques. Each component of the system is meticulously engineered to simplify installation and ensure professional-quality results.

Overall, the DIY portable subfloor system offers a comprehensive solution for homeowners as well as business owners seeking to construct professional-quality decks, stages or raised platforms quickly, efficiently, and with minimal specialized skills or experience required. The subfloor can be dismantled easily as one only needs to remove the fasteners and put aside each component one by one. Since, the beams (100), the joists (200), the frame unit (300) of joist/picture frame box (300), the rim joists (400), and the deck blocking piece (600) all fit like a puzzle, it can be taken apart in no time and moved to a different location.

While preferred embodiments of the present invention have been shown and described herein, it will be obvious to those skilled in the art that such embodiments are provided by way of example only. It is not intended that the invention be limited by the specific examples provided within the specification. While the invention has been described with reference to the aforementioned specification, the descriptions and illustrations of the embodiments herein are not meant to be construed in a limiting sense. Numerous variations, changes, and substitutions will now occur to those skilled in the art without departing from the invention. Furthermore, it shall be understood that all aspects of the invention are not limited to the specific depictions, configurations or relative proportions set forth herein which depend upon a variety of conditions and variables. It should be understood that various alternatives to the embodiments of the invention described herein may be employed in practicing the invention. It is therefore contemplated that the invention shall also cover any such alternatives, modifications, variations or equivalents. It is intended that the following claims define the scope of the invention and that methods and structures within the scope of these claims and their equivalents be covered thereby.

What is claimed is:

1. A subfloor system comprising:

a plurality of footings placed on the ground;

at least two pre-notched beams that rest on the plurality of footings;

at least two pre-notched joists that rest perpendicularly on the pre-notched beams;

at least two frame units that rest perpendicularly on the pre-notched beams in a direction parallel to the pre-notched joists;

wherein the pre-notched joists and the frame units are secured to the pre-notched beams by fastening means; and at least one rim joist secured to each end of the pre-notched joists and the frame units; wherein the pre-notched joist has a male bracket affixed at each end or wherein each end of the pre-notched joist has one or more dowel pin receiving cavities, wherein the male bracket or the dowel pin receiving cavities on the pre-notched joist receives the at least one rim joist.

2. The subfloor system of claim 1, wherein the plurality of footings are secured to the ground, wherein the plurality of footings are placed either in a square, a rectangular, a pentagon, or a hexagonal form on the ground.

3. The subfloor system of claim 2, wherein the plurality of footings may be concrete footings, buried post footings, screw/helical piles, deck blocks, precast cement footings, precast concrete deck footings, a combination thereof, or any other footing that provides a solid foundation for constructing the subfloor system, and/or wherein each footing of the plurality of footings has a groove or a bracket to receive the pre-notched beams.

4. The subfloor system of claim 3, wherein the pre-notched beams rest in the groove or the bracket of the plurality of footings.

5. The subfloor system of claim 4, wherein each pre-notched beam has an underside extension that fits in the groove of the footing; wherein the pre-notched beam has a flat undersurface with the underside extensions provided at each end; wherein the underside extension is equal to the length of the footing and does not run along the whole length of the pre-notched beam; or wherein each pre-notched beam has a flat underside surface that sits on the bracket of the footing and is secured to the bracket by fastening means.

6. The subfloor system of claim 1, wherein each pre-notched beam has a plurality of beam notches to receive the pre-notched joists, and/or wherein the number of beam notches is equal to the combined number of pre-notched joists and the number of frame units, and/or wherein each beam notch is equidistant from the other beam notch.

7. The subfloor system of claim 1, wherein each pre-notched beam has a half-notched end to receive the frame units.

8. The subfloor system of claim 6, wherein each pre-notched beam has a pair of brackets on the outside of the beam notch to hold the pre-notched joists in place.

9. The subfloor system of claim 7, wherein each pre-notched beam has one or more brackets on the outside of the half-notched end to hold the frame units in place.

10. The subfloor system of claim 1, wherein each pre-notched joist has at least two surface notches on one side of the pre-notched joist, and/or wherein the at least two surface notches are equidistant from the center of the pre-notched joist, and/or wherein each surface notch sits perpendicularly on the beam notch of each pre-notched beam, and/or wherein each end of the pre-notched joist has two identical half notches.

11. The subfloor system of claim 10, wherein the two identical half-notches form a rim support piece at each end of the pre-notched joist, wherein the two identical half-notches on the pre-notched joists receive a rim joist.

12. The subfloor system of claim 1, wherein each end of the pre-notched joist has an L-shaped notch, and/or wherein the L-shaped notch forms a rim-support protrusion on each end of the pre-notched joist, and/or wherein the L-shaped notch on the pre-notched joist receives a rim joist.

13. The subfloor system of claim 10, wherein the pre-notched joist has one or more central notches on a side opposite to the side which has the surface notches, and/or wherein the central notch is at the center of the pre-notched joist.

14. The subfloor system of claim 13, wherein the central notch of the pre-notched joist receive a deck blocking piece, wherein the deck blocking piece has a) one or more joist blocking groves, b) one or more half-frame blocking grooves, or c) a combination of both; that align with the central notch of the pre-notched joist.

15. The subfloor system of claim 1, wherein each frame unit receives at least two pre-notched joists and a central connecting piece that are affixed together and/or wherein each frame unit has corresponding half-notches, two L-shaped notches, rim support pieces, rim support protrusions, or central notches.

16. The subfloor system of claim 15, wherein the central connecting piece is affixed between the at least two pre-notched joists.

17. The subfloor system of claim 1, wherein each frame unit rests on the edges of the pre-notched beams.

18. The subfloor system of claim 1, wherein the pre-notched joist has identical half notches, an L-shaped notch, a male bracket, or a dowel pin receiving cavity, wherein the pre-notched joist receives a rim joist, wherein the rim joist sits perpendicular to the pre-notched joist.

19. The subfloor system of claim 11, wherein the at least one rim joist has a plurality of cavities along its surface that receive the rim support piece of the pre-notched joist, and/or wherein the rim joist has a U-shaped notch at each end to receive the rim support piece or rim support protrusion of the frame unit, and/or wherein the rim joist has a female bracket that attaches to the male bracket affixed at each end of the pre-notched joist, and/or wherein the rim joist has one or more dowel pins that fit in the dowel pin receiving cavities of the pre-notched joist.

20. The subfloor system of claim 1, wherein each of the pre-notched beam, the pre-notched joist, the frame unit, and the at least one rim joist of the subfloor system are divided in two or more pieces, wherein the two or more pieces connect to form a complete pre-notched beam, a complete pre-notched joist, and a complete pre-notched frame units, a complete rim joist.

21. A split subfloor system comprising:

a plurality of footings;

at least two split pre-notched beams that rest on the plurality of footings;

at least two split pre-notched joists that rest perpendicularly on the pre-notched beams;

at least two split frame units that rest perpendicularly on the pre-notched beams in a direction parallel to the pre-notched joists;

wherein the split pre-notched joists and the split frame units are secured to the pre-notched beams by fastening means; and at least one split rim joist secured to each end of the pre-notched joists and the split frame units, wherein the split pre-notched joist has a male bracket affixed at each end or wherein each end of the split pre-notched joist has one or more dowel pin receiving cavities, wherein the male bracket or the dowel pin receiving cavities on the split pre-notched joist receives the at least one split rim joist.

22. The subfloor system of claim 21, wherein the subfloor system additionally comprises:

a. a filler block that plugs a cavity of each footing;

b. a connector block that sits on the filler block in a direction similar to the split pre-notched beams; wherein the connector block connects the at least two split pre-notched beams;

c. a box piece that plugs a cavity formed by the split frame units;

d. a joist extension piece that sits on the split beam in a direction perpendicular to the split pre-notched beam; wherein the joist extension piece connects the at least two split pre-notched joists.

23. The subfloor system of claim 22, wherein the subfloor system comprises:

a. at least three spilt frame units, a first split frame unit on one end of the subfloor system, a second split frame unit on the other end of the subfloor system and a third frame unit at the center of the subfloor system;

b. at least three box pieces, a first box piece plugged in the first split frame unit, a second box piece plugged in the second split frame unit, and a third box piece plugged in the third split frame unit; and c. a divider piece placed on the third box piece that divides the subfloor system in two halves.

24. A portable deck, comprising:

a. the subfloor system according to claim 1, b. a deck floor comprising a plurality of deck boards affixed to the subfloor system by any fastening means.

25. The portable deck of claim 24, wherein the deck floor additionally comprises a deck frame affixed to the subfloor system within which the plurality of deck boards are placed, and/or wherein the deck frame is affixed to the frame units and the pre-notched joists of the subfloor system, and/or wherein the deck frame is constructed using frame boards or deck boards, or a combination of both.

26. The portable deck of claim 25, wherein the deck frame is constructed using at least four frame boards or deck boards, wherein each end of the board is pre-cut at an angle such that the ends of the boards align to form a square deck frame, and/or wherein the boards are wider than the frame units and the pre-notched joists of the subfloor system to create an overhang when affixed to the subfloor system, and/or wherein the deck boards or the deck frame boards are split in two or more pieces, wherein the two or more pieces of the deck board form a complete deck board, and the two or more pieces of the deck frame board forms a complete deck frame board.

27. A method of constructing a subfloor system comprising:

a) placing at least two pairs of footings on the ground to form a square;

b) placing one pre-notched beam on each pair of footing such that the pre-notched beams are parallel to each other;

c) placing one or more pre-notched joists on the pre-notched beams in a direction perpendicular to the pre-notched beams;

d) placing at least one frame unit perpendicularly on each end of the pre-notched beams, wherein the frame unit run parallel to the one or more pre-notched joists;

e) securing the ends of the pre-notched joists and the frame units with a rim joist by means of a male bracket and a corresponding female bracket or one or more dowel pin receiving cavities and corresponding one or more dowel pins; and f) affixing the pre-notched beams, the pre-notched joists, the frame units and the rim joists by affixing means.

28. The subfloor system of claim 12, wherein the rim joist has a plurality of cavities along its surface that receive the rim support protrusion of the pre-notched joist, and/or wherein the rim joist has a U-shaped notch at each end to receive the rim support piece or rim support protrusion of the frame unit, and/or wherein the rim joist has a female bracket that attaches to the male bracket affixed at each end of the pre-notched joist, and/or wherein the rim joist has one or more dowel pins that fit in the dowel pin receiving cavities of the pre-notched joist.

* * * * *